US012551085B2

(12) United States Patent
Lee et al.

(10) Patent No.: US 12,551,085 B2
(45) Date of Patent: Feb. 17, 2026

(54) DISHWASHER

(71) Applicant: SAMSUNG ELECTRONICS CO., LTD., Suwon-si (KR)

(72) Inventors: Inju Lee, Suwon-si (KR); Seungyong Yang, Suwon-si (KR); Junghee Lee, Suwon-si (KR); Sungjin Kim, Suwon-si (KR); Jinhyok An, Hwaseong-si (KR); Youngpyo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 127 days.

(21) Appl. No.: 18/401,175

(22) Filed: Dec. 29, 2023

(65) Prior Publication Data

US 2024/0148221 A1 May 9, 2024

Related U.S. Application Data

(63) Continuation of application No. PCT/KR2023/011807, filed on Aug. 10, 2023.

(30) Foreign Application Priority Data

Nov. 4, 2022 (KR) ..... 10-2022-0146529

(51) Int. Cl.
*A47L 15/42* (2006.01)
*A47L 15/44* (2006.01)

(52) U.S. Cl.
CPC ..... *A47L 15/4257* (2013.01); *A47L 15/4274* (2013.01); *A47L 15/4436* (2013.01); *A47L 15/4463* (2013.01); *A47L 15/449* (2013.01)

(58) Field of Classification Search
None
See application file for complete search history.

(56) References Cited

U.S. PATENT DOCUMENTS 7,231,928 B2 6/2007 Dingler et al.
7,275,552 B2 10/2007 DeWeerd et al.
(Continued)

FOREIGN PATENT DOCUMENTS

EP 0 486 828 B1 4/1995
EP 1 995 368 A2 11/2008
(Continued)

OTHER PUBLICATIONS

International Search Report dated Nov. 29, 2023 for International Application No. PCT/KR2023/011807.
(Continued)

*Primary Examiner* — Rita P Adhlakha
(74) *Attorney, Agent, or Firm* — STAAS & HALSEY LLP

(57) ABSTRACT

A dishwasher including a tub; a door configured to open and close the tub, the door including an outer frame forming an outer surface of the door, and an inner frame coupled to the outer frame and forming an inner surface of the door, with an inner space between the outer frame and the inner frame; and an automatic detergent dispenser coupled to the inner frame and configured to dispense a solid detergent while the tub is closed by the door, the automatic detergent dispenser including a storage compartment in which a plurality of solid detergents are stackable so as to be loaded along one direction, and a discharge duct including a discharge hole formed to communicate with an inner space, the discharge duct configured to discharge air, which flows from the tub into the automatic detergent dispenser, to the inner space through the discharge hole.

16 Claims, 23 Drawing Sheets

(56) References Cited

U.S. PATENT DOCUMENTS

| | | | |
|---|---|---|---|
| 8,356,610 | B2 | 1/2013 | Ertle et al. |
| 9,717,393 | B2 | 8/2017 | Delgado et al. |
| 10,561,295 | B2 | 2/2020 | Beshears, Jr. et al. |
| 11,284,776 | B2 | 3/2022 | Dirnberger et al. |
| 2008/0276969 | A1 | 11/2008 | Vanantwerp et al. |
| 2009/0090401 | A1 | 4/2009 | Feddema |
| 2021/0378482 | A1 | 12/2021 | Dirnberger et al. |
| 2022/0175212 | A1* | 6/2022 | Dirnberger ..... A47L 15/4436 |
| 2022/0233052 | A1 | 7/2022 | Buogo et al. |
| 2022/0273159 | A1 | 9/2022 | Buogo et al. |

FOREIGN PATENT DOCUMENTS

| | | | |
|---|---|---|---|
| EP | 2 044 877 | A1 | 4/2009 |
| EP | 2 777 472 | A1 | 9/2014 |
| EP | 3 016 570 | B1 | 10/2017 |
| EP | 3 769 656 | A1 | 1/2021 |
| EP | 3 547 891 | B1 | 7/2022 |
| JP | 2017-29307 | A | 2/2017 |
| KR | 1998-026613 | U | 8/1998 |
| KR | 20-0313947 | Y1 | 5/2003 |
| KR | 10-2010-0025359 | A | 3/2010 |
| KR | 10-2011-0052578 | A | 5/2011 |
| KR | 10-1969205 | | 8/2019 |
| KR | 20-2020-0000088 | U | 1/2020 |
| KR | 20-2020-0000474 | U | 3/2020 |
| KR | 20-2021-0000392 | U | 2/2021 |
| KR | 10-2022-0026821 | A | 3/2022 |
| KR | 10-2022-0026822 | A | 3/2022 |
| KR | 10-2022-0026823 | A | 3/2022 |
| KR | 10-2022-0080706 | A | 6/2022 |
| WO | WO 2005/060820 | A2 | 7/2005 |
| WO | WO 2016/034219 | A1 | 3/2016 |

OTHER PUBLICATIONS

Extended European Search Report issued Dec. 10, 2025 for Application No. 23885968.0.

* cited by examiner

DISHWASHER

CROSS-REFERENCE TO RELATED APPLICATION(S)

This application is a continuation application, under 35 U.S.C. § 111(a), of international application No. PCT/KR2023/011807, filed on Aug. 10, 2023, which claims priority to Korean Patent Application No. 10-2022-0146529, filed on Nov. 4, 2022, in the Korean Intellectual Property Office, the disclosures of which are incorporated by reference herein in their entireties.

BACKGROUND

1. Field

The disclosure relates to a dishwasher, and more particularly, to a dishwasher including a device configured to input detergent.

2. Description of Related Art

A dishwasher is a device that automatically removes food residues and the like on dishes using detergent and wash water.

The dishwasher includes a main body, a washing chamber formed by a tub disposed inside the main body, a storage container disposed inside the washing chamber to store dishes, and a spray unit configured to spray wash water to the storage container.

The storage container may be usually provided in two or three stages, and the spray unit may be provided in plurality and disposed to correspond to the storage container so as to spray wash water to each place, in which each storage container is disposed.

The dishwasher may include a washing process, a rinsing process, and a drying process. In the washing process, the spray unit may spray wash water, and at the same time, an automatic detergent dispenser may input detergent to the tub. Accordingly, dishes may be washed. In the rinsing process, wash water may be sprayed to remove the detergent. In the drying process, moisture remaining in the dishes may be removed.

The automatic detergent dispenser of the dishwasher may include a storage compartment so as to store various types of detergents, such as powder detergent or liquid detergent, in the storage compartment.

SUMMARY

Aspects of embodiments of the disclosure will be set forth in part in the description which follows and, in part, will be apparent from the description, or may be learned by practice of the presented embodiments.

According to an embodiment of the disclosure, a dishwasher includes a tub; a door configured to open and close the tub, the door including an outer frame forming an outer surface of the door, and an inner frame coupled to the outer frame and forming an inner surface of the door, with an inner space between the outer frame and the inner frame: and an automatic detergent dispenser coupled to the inner frame and configured to dispense a solid detergent toward an inside of the tub while the tub is closed by the door, the automatic detergent dispenser including a storage compartment in which a plurality of solid detergents are stackable so as to be loaded along one direction, and a discharge duct including a discharge hole formed to communicate with an inner space, the discharge duct configured to discharge air, which flows from the tub into the automatic detergent dispenser, to the inner space through the discharge hole.

According to an embodiment of the disclosure, the discharge duct may extend parallel to the one direction along which the plurality of solid detergents are loaded, and the discharge hole may be formed at one side of the discharge duct with respect to the one direction.

According to an embodiment of the disclosure, the discharge duct may be disposed in a direction perpendicular to the one direction with respect to the storage compartment.

According to an embodiment of the disclosure, the automatic detergent dispenser may include a discharge hole cover covering the discharge hole from an outside of the discharge duct.

According to an embodiment of the disclosure, the discharge hole cover may include a cover portion facing the discharge hole at a position spaced apart from the discharge hole.

According to an embodiment of the disclosure, the automatic detergent dispenser may include an air discharge guide to guide air discharged through the discharge hole to an outside of the discharge hole cover, and the air discharge guide may be inclined downward toward the outer frame while the tub is closed by the door.

According to an embodiment of the disclosure, the automatic detergent dispenser may include a housing coupled to the inner frame and in which the storage compartment and the discharge duct are disposed, a driver configured to drive the automatic detergent dispenser to discharge one solid detergent among the plurality of solid detergents into the tub, the driver disposed inside the housing, a control device configured to control the driver, and a wire configured to electrically connect the driver and the control device, at least a portion of the wire being disposed along the discharge duct.

According to an embodiment of the disclosure, the wire may pass through the discharge hole, and the housing may include a control device cover to cover a portion of the wire, the discharge hole, and the control device.

According to an embodiment of the disclosure, the automatic detergent dispenser may include a housing coupled to the inner frame, the housing may include a drain groove formed to have a concave shape on an outer surface of the housing, the storage compartment and the discharge duct may be disposed inside the housing, the discharge hole may be disposed on the outer surface of the housing, and the drain groove may be configured to prevent water, which flows from the tub into the inner space, from flowing into the discharge hole.

According to an embodiment of the disclosure, the drain groove may be disposed in the inner space, and configured to drain the water, which flows from the tub into the inner space, from the housing to a lower side of the inner space while the door is closed.

According to an embodiment of the disclosure, the drain groove may be arranged along an outer edge of the housing.

According to an embodiment of the disclosure, the discharge hole may be formed on one surface of the housing at a side toward the outer frame, the housing may include a housing rib disposed along the drain groove and formed to have a protruding shape, the housing rib may be disposed in a direction toward the outer frame with respect to the drain groove.

According to an embodiment of the disclosure, the storage compartment may include a storage compartment discharge hole to communicate with the inner space.

According to an embodiment of the disclosure, the storage compartment discharge hole may be at one side of the storage compartment along the one direction in which the plurality of solid detergents are loaded.

According to an embodiment of the disclosure, the automatic detergent dispenser may include an inlet communicating with the tub and configured so that one solid detergent among the plurality of solid detergents to be discharged, the one solid detergent having been discharged from the storage compartment, into the tub, and, while the tub is closed by the door, the plurality of solid detergents may be stacked in a vertical direction inside the storage compartment, the inlet may be disposed below the discharge duct, and the discharge hole may be formed at an upper side of the discharge duct.

According to an embodiment of the disclosure, the automatic detergent dispenser may include a seating member to seat a solid detergent discharged from the storage compartment, and from which the seated solid detergent may be discharged into the tub, and the discharge duct may extend between the seating member and the discharge hole.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
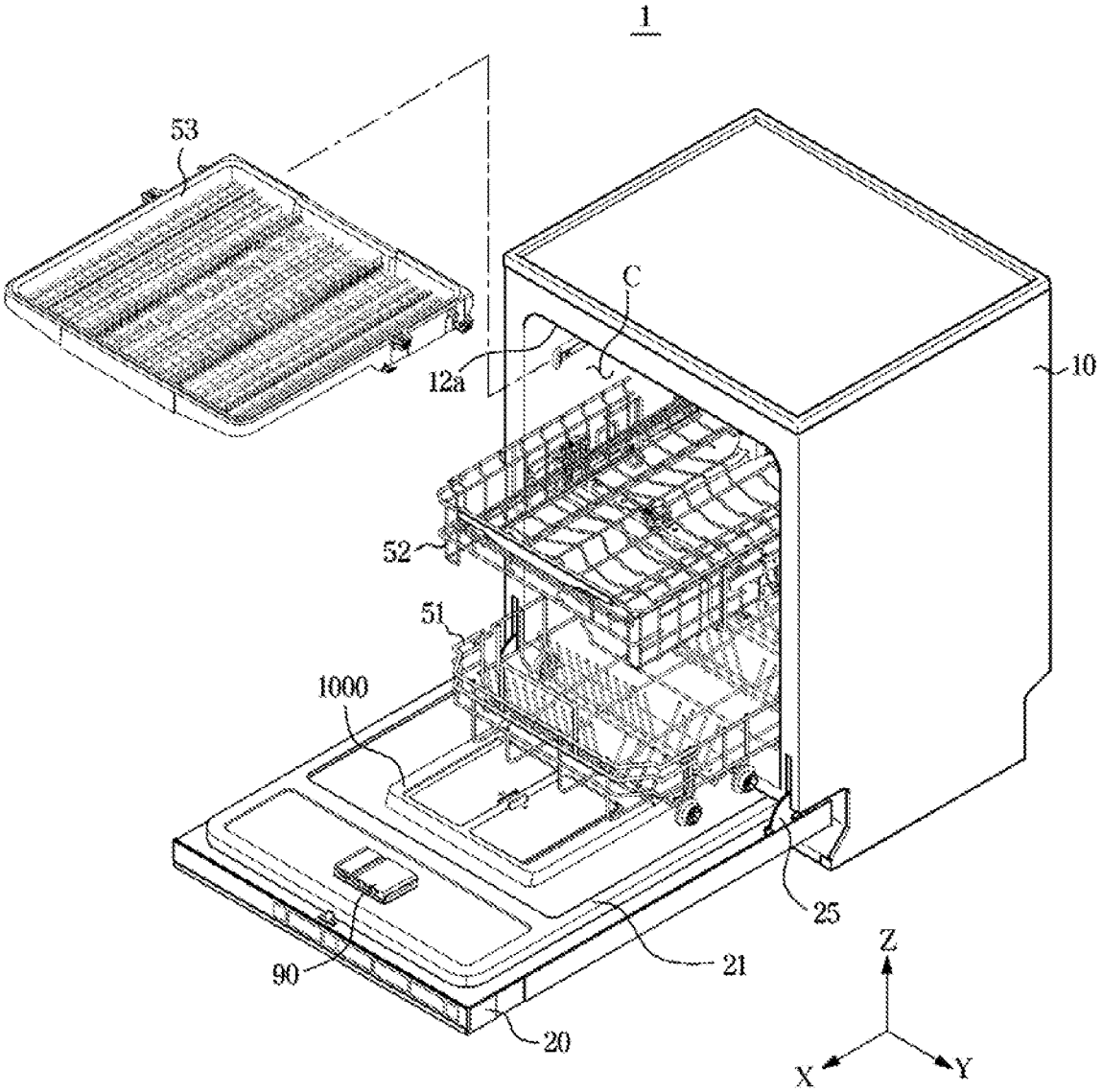
FIG. 1 is a perspective view of a state in which a door of a dishwasher according to an embodiment of the disclosure is opened.

The various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless they are definitely different in a context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In this disclosure, the terms "including", "having", and the like are used to specify features, numbers, steps, operations, elements, elements, or combinations thereof, but do not preclude the presence or addition of one or more of the features, elements, steps, operations, elements, elements, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

The terms "up and down direction", "height direction", "vertical direction", etc. used in the following description may refer to the Z-direction based on a perspective view of a dishwasher in FIG. 1, and "horizontal direction" may refer to any direction along the X-Y plane in the X-direction or the Y-direction based on the perspective view of FIG. 1.

The terms "first direction", "second direction", "third direction", etc. used in the following description are arbitrarily defined according to some standards to be described later, but are not limited thereto. In addition, "first direction", "second direction", and "third direction" may mean a direction comprehensively including all "first direction and opposite direction of first direction", "second direction and opposite direction of second direction", and "third direction and opposite direction of third direction".

Hereinafter "dish" may be used as a concept encompassing bowls, cups, cutlery, and various cooking utensils.

Embodiments of the disclosure may provide a dishwasher including an improved structure configured to input a solid detergent into a tub during a washing process.

Embodiments of the disclosure may provide a dishwasher capable of stacking and loading a plurality of solid detergents into an automatic detergent dispenser.

Embodiments of the disclosure may provide a dishwasher including an improved structure capable of discharging air introduced from a tub into an automatic detergent dispenser to an outside of the automatic detergent dispenser.

Embodiments of the disclosure may provide a dishwasher including an improved structure capable of discharging water into an inner space between an inner frame and an outer frame.

Embodiments of the disclosure may provide a dishwasher including an improved structure capable of preventing a solid detergent loaded in a storage compartment from being damaged and capable of preventing deterioration of a quality of the solid detergent.

Embodiments of the disclosure may provide a dishwasher including an improved structure capable of preventing damage to an automatic detergent dispenser and capable of increasing a lifetime of the automatic detergent dispenser.

Reference will now be made in detail to embodiments of the disclosure, examples of which are illustrated in the accompanying drawings.

Figure 2:
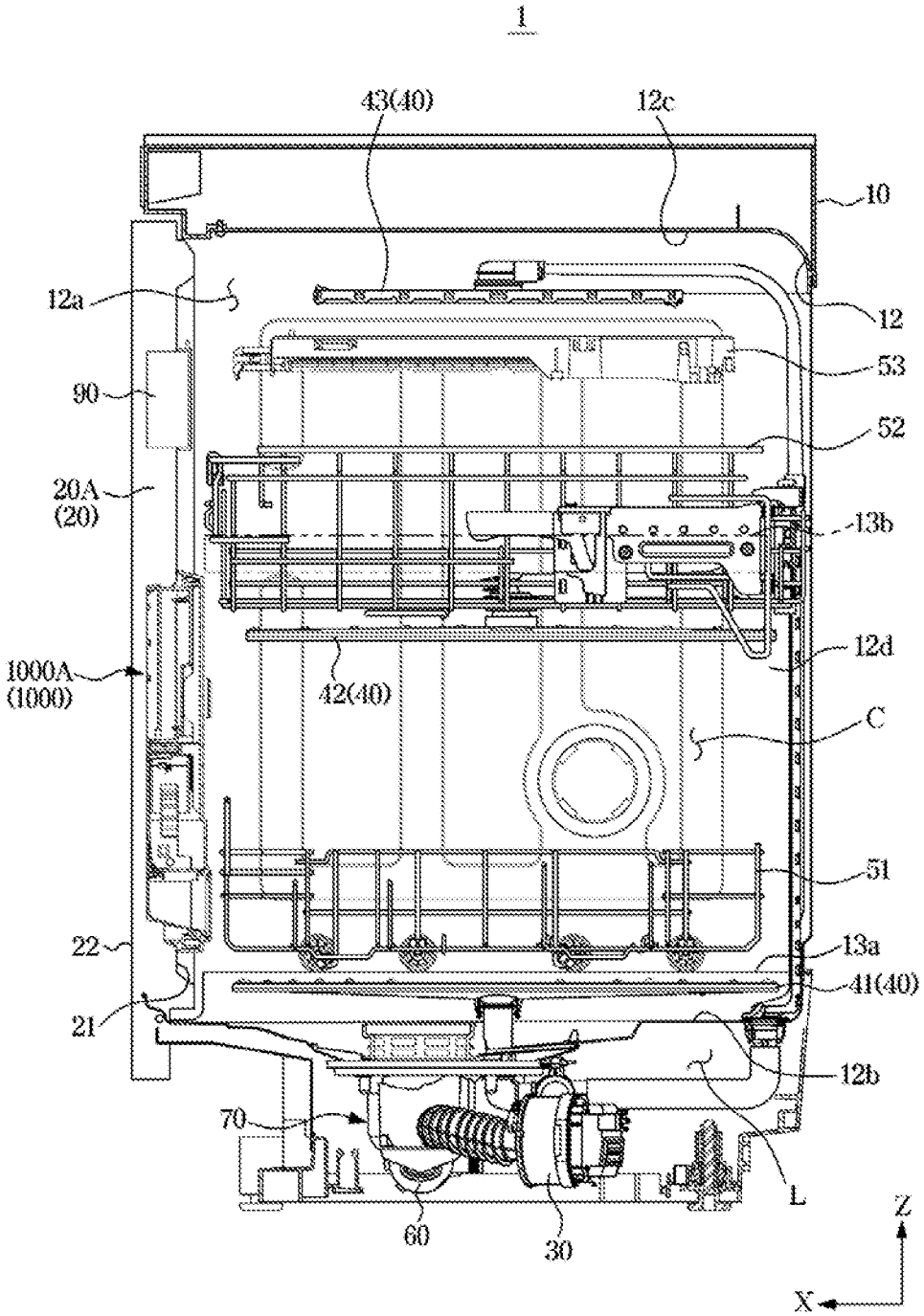
FIG. 2 is a schematic side cross-sectional view of the dishwasher according to an embodiment of the disclosure.
Figure 3:
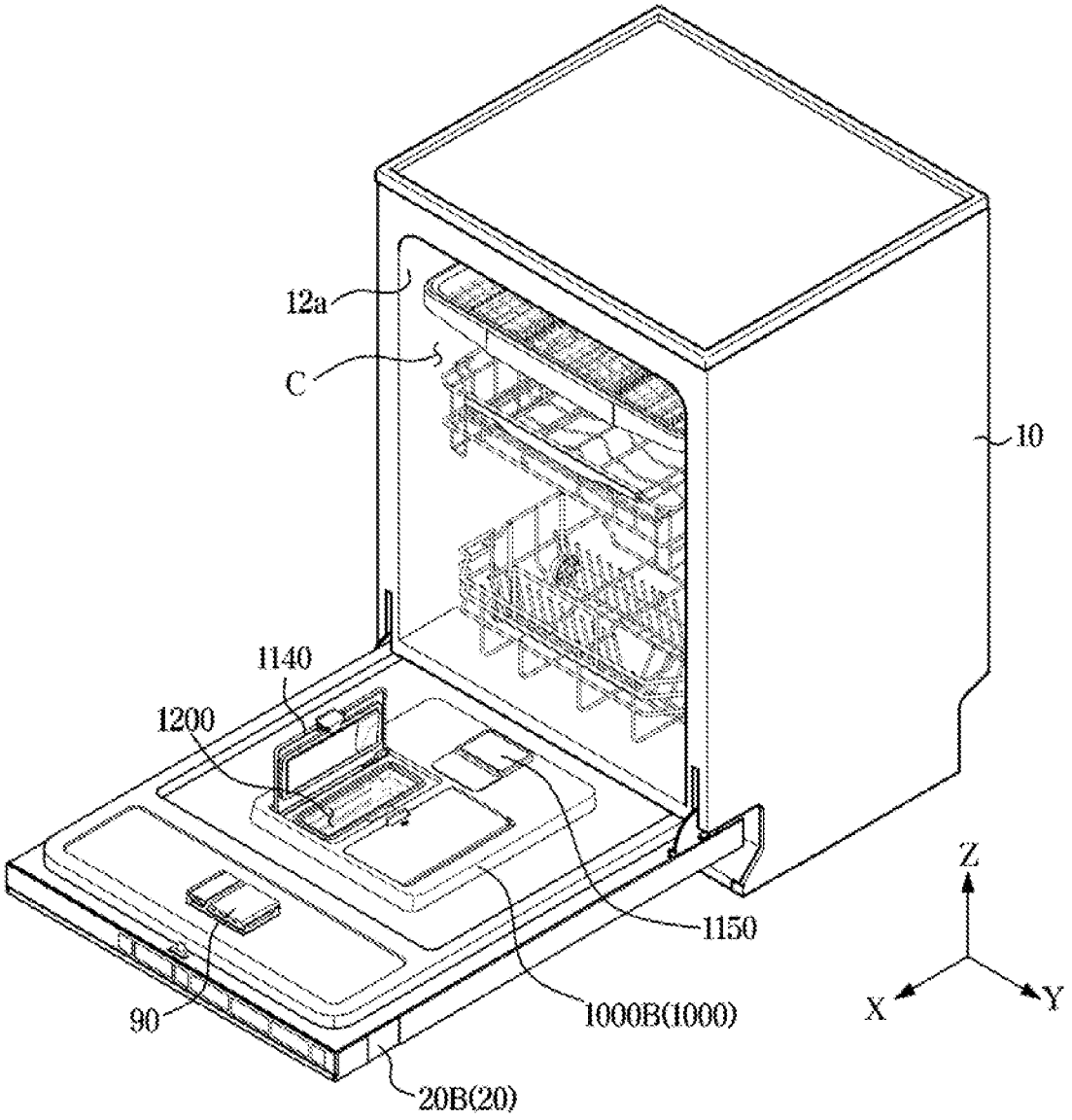
FIG. 3 is a perspective view illustrating a state in which a detergent is loaded into an automatic detergent dispenser of the dishwasher according to an embodiment of the disclosure.

FIG. 1 is a perspective view of a state in which a door of a dishwasher according to an embodiment is opened, FIG. 2 is a schematic side cross-sectional view of the dishwasher according to an embodiment, and FIG. 3 is a perspective view illustrating a state in which a detergent is loaded into an automatic detergent dispenser of the dishwasher according to an embodiment.

A dishwasher 1 may include a tub 12 arranged inside a main body 10. The tub 12 may be formed in a substantially box shape. One side of the tub 12 may be opened. The tub 12 may include an opening 12*a*. For example, a front surface of the tub 12 may be opened toward the first direction X.

The dishwasher 1 may further include a door 20 configured to open and close the opening 12*a* of the tub 12. The door 20 may be installed in the main body 10 to open and close the opening 12*a* of the tub 12. The door 20 may be rotatably installed in the main body 10 through a member such as a hinge 25. The door 20 may be removably mounted to the main body 10.

For example, the door 20 may be rotatably hinged to a lower portion of the main body 10. A rotation axis of the hinge 25 may extend in the second direction Y, which is the left and right direction of the main body 10, to allow the door 20 to be rotated in the front and rear directions in front of the main body 10.

For example, on the front side of the main body 10, the door 20 may be hinged to a hinge arranged on the left or right side of the main body 10 with respect to the second direction Y. The door 20 may be provided to be rotated from the second direction Y to the first direction X by the hinge arranged on the left and/or right side of the main body 10.

The door 20 may include an outer surface 22 forming an exterior of the dishwasher 1 together with the main body 10, and an inner surface 21 facing the inside of the tub 12 when the door 20 closes the tub 12.

The dishwasher 1 may further include a storage container arranged in the tub 12 to accommodate dishes. The storage container may include a plurality of baskets 51, 52 and 53.

The storage container may include an intermediate basket 52 positioned in the middle with respect to the height direction of the dishwasher 1, and a lower basket 51 positioned in a lower portion with respect to the height direction of the dishwasher 1. The intermediate basket 52 may be provided to be supported by an intermediate guide rack 13*b*. The lower basket 51 may be provided to be supported by a lower guide rack 13*a*. The intermediate guide rack 13*b* and the lower guide rack 13*a* may be installed on a side surface 12*d* of the tub 12 so as to be slidable toward the opening 12*a* of the tub 12. The side surface 12*d* of the tub 12 may include an inner surface of a right wall and an inner surface of a left wall of the tub 12.

Relatively large dishes may be stored in the lower basket 51 and the intermediate basket 52. However, the types of dishes accommodated in the lower and intermediate baskets 51 and 52 is not limited to relatively large dishes. That is, the plurality of baskets 51, 52 and 53 may accommodate not only relatively large dishes but also relatively small dishes.

The storage container may include an upper basket 53 positioned in an upper portion with respect to the height direction of the dishwasher 1. The upper basket 53 may be formed in a rack assembly to accommodate relatively small dishes. For example, the rack assembly may accommodate a cooking utensil such as a ladle, a knife, or a turner, or cutlery. In addition, the upper basket 53 may accommodate a small cup such as an espresso cup. However, the types of dishes accommodated in the upper basket 53 is not limited thereto.

The upper basket 53 may be provided to be supported by an upper guide rack. The upper guide rack may be installed on the side surface 12*d* of the tub 12. For example, the upper basket 53 may be slidably moved by the upper guide rack, and inserted into or withdrawn from a washing chamber C.

The storage container is not limited to the shape shown in FIGS. 1 and 2, and the storage container may not include the upper basket 53 according to the size of the tub 12. For example, the storage container may be implemented with the intermediate basket 52 and the lower basket 53.

The dishwasher 1 may include the washing chamber C, which is a space formed inside the tub 12. The washing chamber C may be defined as an inner space of the tub 12. The washing chamber C may correspond to a space surrounded by a lower surface 12*b*, an upper surface 12*c* and the side surface 12*d* of the tub 12, and the inner surface 21 of the door 20 when the door 20 closes the tub 12.

The washing chamber C may refer to a space in which dishes placed in the baskets 51, 52 and 53 are washed by wash water and dried.

The dishwasher 1 may include a spray device 40 configured to spray wash water. The spray device 40 may receive wash water from a sump assembly 70.

The spray device 40 may include a plurality of spray units 41, 42, and 43.

For example, the plurality of spray units 41, 42, and 43 may include a first spray unit 41 arranged under the lower basket 51 in the height direction of the dishwasher 1, a second spray unit 42 arranged under the intermediate basket 52 in the height direction of the dishwasher 1, and a third spray unit 43 arranged above the upper basket 53 in the height direction of the dishwasher 1.

Each of the plurality of spray units 41, 42, and 43 may be configured to spray wash water while rotating. Each of the first spray unit 41, the second spray unit 42, and the third spray unit 43 may be provided to spray wash water while rotating. The plurality of spray units 41, 42 and 43 may be referred to as a plurality of spray rotors. The first spray unit 41, the second spray unit 42, and the third spray unit 43, respectively, may be referred to as a first spray rotor 41, a second spray rotor 42, and a third spray rotor 43.

However, the spray device 40 may spray the wash water in a manner different from the above-described example. For example, unlike the second spray unit 42 and the third spray unit 43, the first spray unit 41 may be fixed to one side of the lower surface 12*b* of the tub 12. The first spray unit 41 may be configured to spray the wash water in a substantially horizontal direction by a fixed nozzle. A direction of the wash water, which is sprayed in a substantially horizontal direction from the nozzle of the first spray unit 41, may be changed by a conversion assembly (not shown) arranged thereon and then the wash water may move upward. The conversion assembly may be installed on a rail by a holder and may be provided to be movable in translation along the rail.

The dishwasher 1 may include the sump assembly 70.

The sump assembly 70 may be provided to receive wash water. The sump assembly 70 may collect wash water of the washing chamber C. For example, the lower surface 12*b* of the tub 12 may be inclined downward toward the sump assembly 70 to smoothly collect water to the sump assembly 70. The wash water of the washing chamber C may flow along the slope of the lower surface 12*b* of the tub 12 and smoothly flow into the sump assembly 70.

The sump assembly 70 may include a circulation pump 30 configured to pump wash water stored in the sump assembly 70 to the spray device 40.

The sump assembly 70 may include a drain pump 60 configured to drain wash water and foreign substances (e.g., food residues) remaining in the sump assembly 70.

The sump assembly 70 may pump the collected wash water and supply the wash water to the spray device 40. The sump assembly 70 may be connected to the spray device 40 to supply wash water to the spray device 40.

The sump assembly 70 may be independently connected to the first spray unit 41, the second spray unit 42, and the third spray unit 43. For example, the sump assembly 70 may be independently connected to connectors connected to the first spray unit 41, the second spray unit 42, and the third spray unit 43. The connector may be provided in the shape of a connection port, duct, or the like.

For example, the second spray unit 42 and the third spray unit 43 may be provided with one connector, and in this case, wash water supplied through the one connector may flow into a connector. Wash water flowing into the connector may be branched during moving, and the branched wash water may be provided to at least one of the second spray unit 42 and the third spray unit 43.

The dishwasher 1 may include an alternating device (not shown) configured to selectively supply wash water to the spray device 40. The alternating device (not shown) may be driven to selectively supply wash water to each connector connected to each of the spray devices 41, 42, and 43. For example, the alternating device (not shown) may selectively supply wash water to at least one of a connector connected to the first spray device 41 and a connector connected to the second spray device 42.

The dishwasher 1 may include a machine room L, which is a space provided below the tub 12. The machine room L may be a place in which a component for circulating wash water is disposed.

For example, at least a part of the sump assembly 70 may be arranged in the machine room L. Most of the sump assembly 70 may be arranged in the machine room L. As for a volume of the sump assembly 70, a volume of the sump assembly 70 located in the washing chamber C may be less than a volume of the sump assembly 70 located in the machine room L. By reducing the volume of the sump assembly 70 occupying the washing chamber C, the volume of the washing chamber C may be secured. Accordingly, a capacity of the washing chamber C may be increased, and thus a storage capacity of the dishes may be improved.

The dishwasher 1 may include an automatic detergent dispenser 1000 configured to input a solid detergent into the tub 12. The dishwasher 1 may include a detergent box 90 provided to input not only a solid detergent but also powder detergent or liquid detergent into the tub 12.

When a user inputs information related to a washing mode of the dishwasher 1 through an inputter of the dishwasher 1 or a mobile device, a control device 1900, which will be described later, may control the dishwasher 1 to selectively input the detergent stored in the detergent box 90 into the tub 12 based on the user input obtained from a main control device. The information related to the washing mode may include information related to a small amount washing mode in which a small number of dishes is washed or information related to a quick washing mode in which a washing time is minimized.

The solid detergent means a solid detergent that is formed to have a predetermined shape. The solid detergent may have an approximate block shape, and thus the solid detergent may be referred to by various terms such as detergent block and block-type detergent. The shape of the solid detergent is not limited to a specific shape or size, and may have various shapes.

The automatic detergent dispenser 1000 may be provided to allow a plurality of solid detergents to be loaded. The automatic detergent dispenser 1000 may be provided to allow one of a plurality of solid detergents to be input into the tub 12 while the dishwasher 1 washes dishes.

For example, the dishwasher 1 may be provided to wash dishes through a pre-washing operation, a main washing operation, a rinsing operation, and a drying operation. The automatic detergent dispenser 1000 may be configured to input a solid detergent into the tub 12 before or at the start of the main washing operation.

The detergent box 90 may be provided to accommodate powder detergent or liquid detergent. The detergent box 90 may be provided to allow detergent to be input into the tub 12 while the dishwasher 1 washes dishes.

The dishwasher 1 may be configured to allow one detergent, which is selected by a user between detergent stored in the detergent box 90 and solid detergents loaded in the automatic detergent dispenser 1000, to be input to the tub 12.

The automatic detergent dispenser 1000 may be disposed on the inner surface 21 of the door 20. The automatic detergent dispenser 1000 may be provided to be coupled to the inner surface 21 of the door 20.

The detergent box 90 may be disposed on the inner surface 21 of the door 20. When the door 20 closes the tub 12, the automatic detergent dispenser 1000 and the detergent box 90 may be arranged in the third direction Z, which is the vertical direction.

Because the automatic detergent dispenser 1000 is disposed on the door 20, the automatic detergent dispenser 1000 may be provided to be rotated together with the door 20 by the rotation of the door 20.

When a position in which the door 20 closes the tub 12 is defined as a first position 20A of the door 20, and a position in which the door 20 opens the tub 12 is defined as a second position 20B of the door 20, the door 20 may be configured to open and close the tub 12 by moving between the first position 20A and the second position 20B.

The second position 20B of the door 20 may be defined as any position among positions at which the door 20 opens the tub 12, and it is appropriate that the second position 20B is a position in which dishes stored in the tub 12 are allowed to be withdrawn to the outside of the tub 12. For example, the second position 20B of the door 20 may be a position in which an extension direction of the inner surface 21 of the door 20 corresponds to the first direction X.

The automatic detergent dispenser 1000 may be interlocked with the door 20 so as to be moved between a first position 1000A of the automatic detergent dispenser 1000 corresponding to the first position 20A of the door 20, and a second position 1000B of the automatic detergent dispenser 1000 corresponding to the second position 20B of the door 20.

When the door 20 closes the tub 12, the automatic detergent dispenser 1000 may be disposed at the first position 1000A, and when the door 20 opens the tub 12, the automatic detergent dispenser 1000 may be disposed at the second position 1000B.

As illustrated in FIG. 3, a user can load a plurality of solid detergents into the automatic detergent dispenser 1000 when the automatic detergent dispenser 1000 is disposed at the second position 1000B.

A user can open a storage compartment cover 1140 of the automatic detergent dispenser 1000 and load a plurality of solid detergents into a storage compartment 1200.

In the conventional manner, whenever the dishwasher washes dishes, a user has to load the detergent into the automatic detergent dispenser or the detergent box, which causes inconvenience to the user. On the other hand, the automatic detergent dispenser 1000 of the dishwasher 1 according to an embodiment may be configured to allow a plurality of solid detergents to be loaded into the automatic detergent dispenser 1000 at the one-time loading by a user, and when the dishwasher 1 performs the washing process, one solid detergent among the plurality of solid detergents may be input into the tub 12 for one time-washing process.

Because a plurality of solid detergents remains inside the automatic detergent dispenser 1000 during the washing process of the dishwasher 1, moisture may flow into the automatic detergent dispenser 1000 during the washing process, and accordingly, the plurality of solid detergents may be damaged.

Because the automatic detergent dispenser 1000 is moved between the first position 1000A and the second position 1000B, a plurality of solid detergents loaded in the automatic detergent dispenser 1000 may be separated from the stored position.

Hereinafter the automatic detergent dispenser 1000 capable of relieving the above difficulties will be described in detail.

Figure 4:
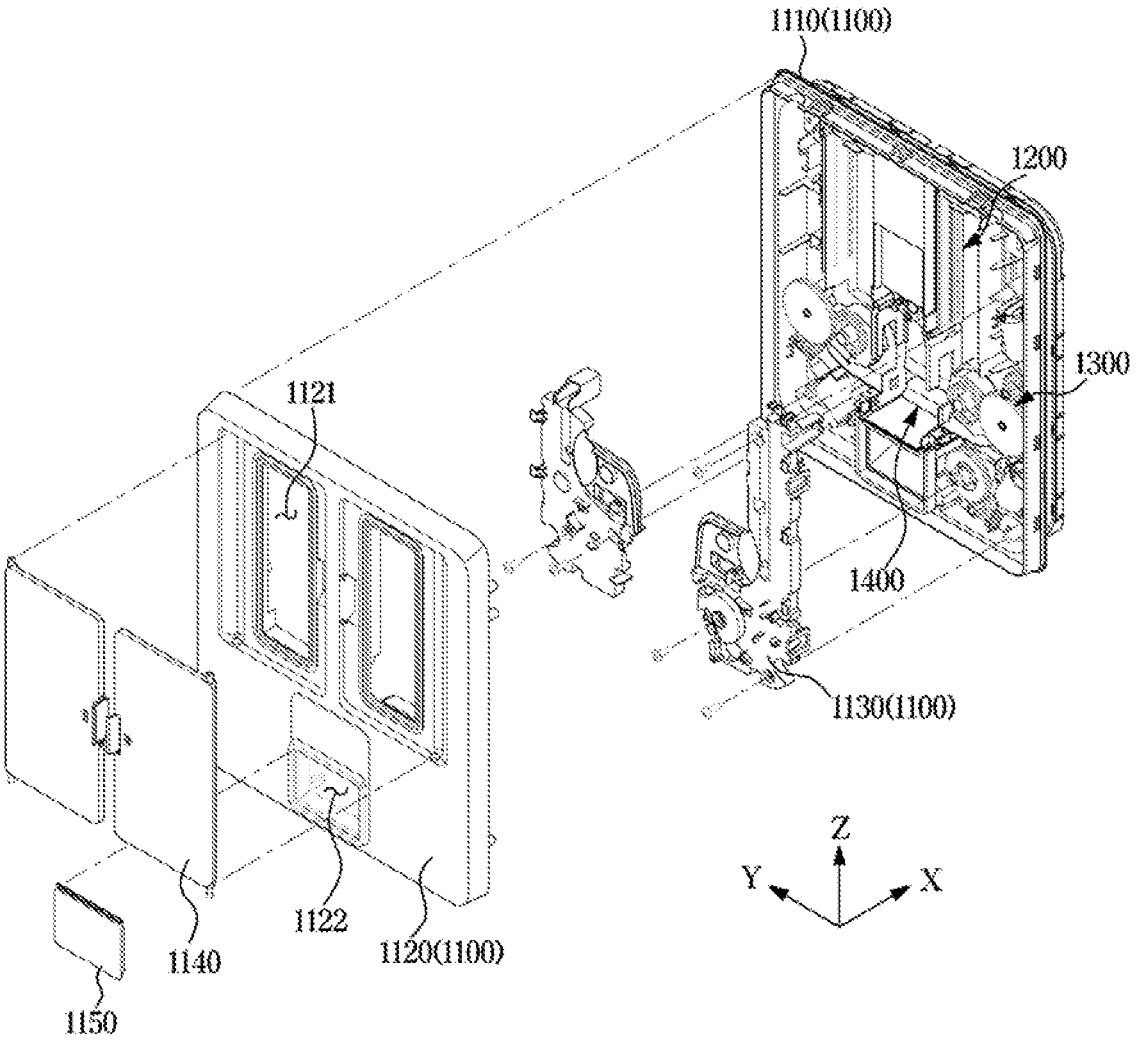
FIG. 4 is an exploded perspective view of the automatic detergent dispenser of the dishwasher according to an embodiment of the disclosure.
Figure 5:
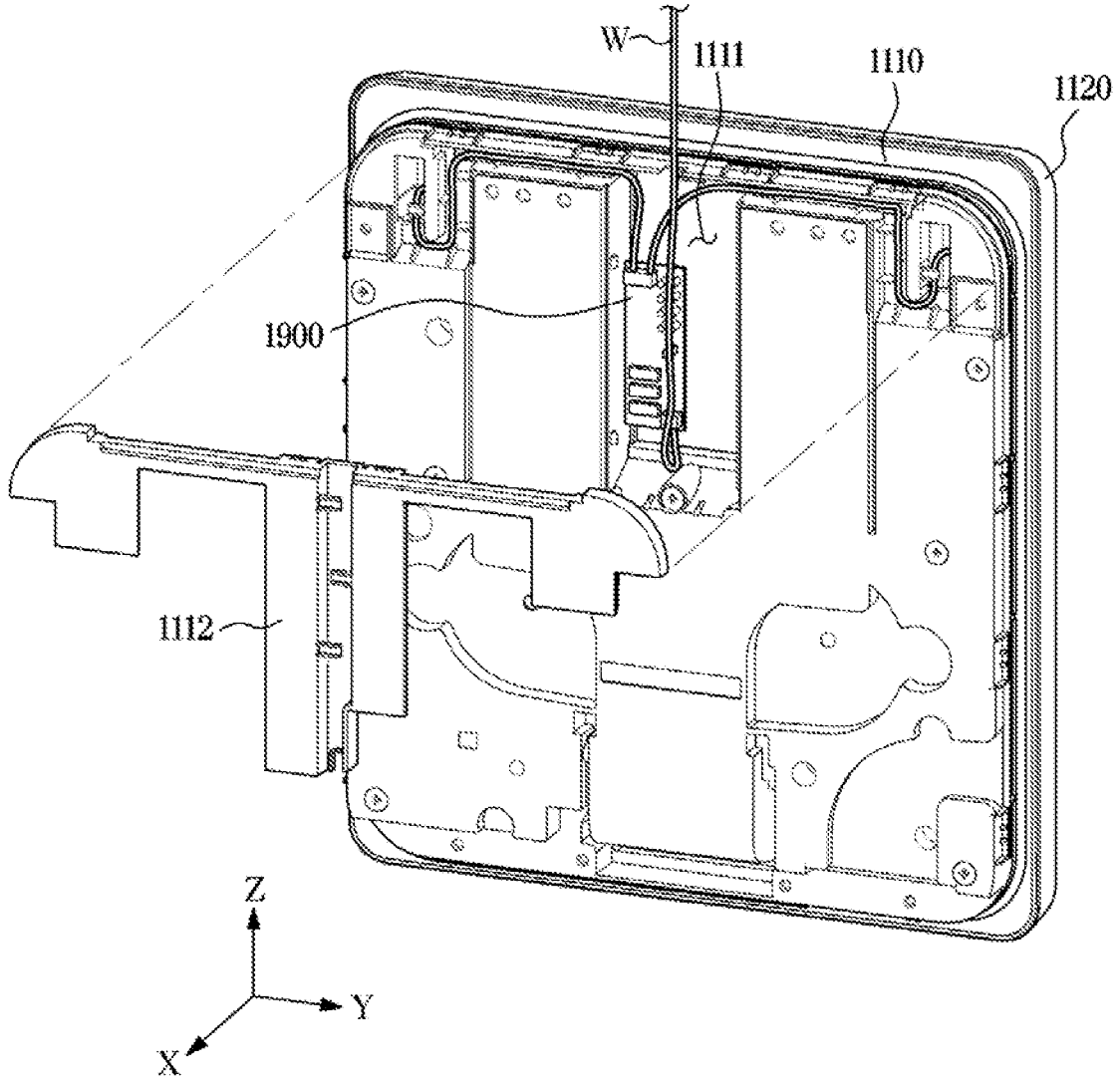
FIG. 5 is an exploded perspective view of the automatic detergent dispenser of the dishwasher according to an embodiment of the disclosure when viewed from another angle.
Figure 6:
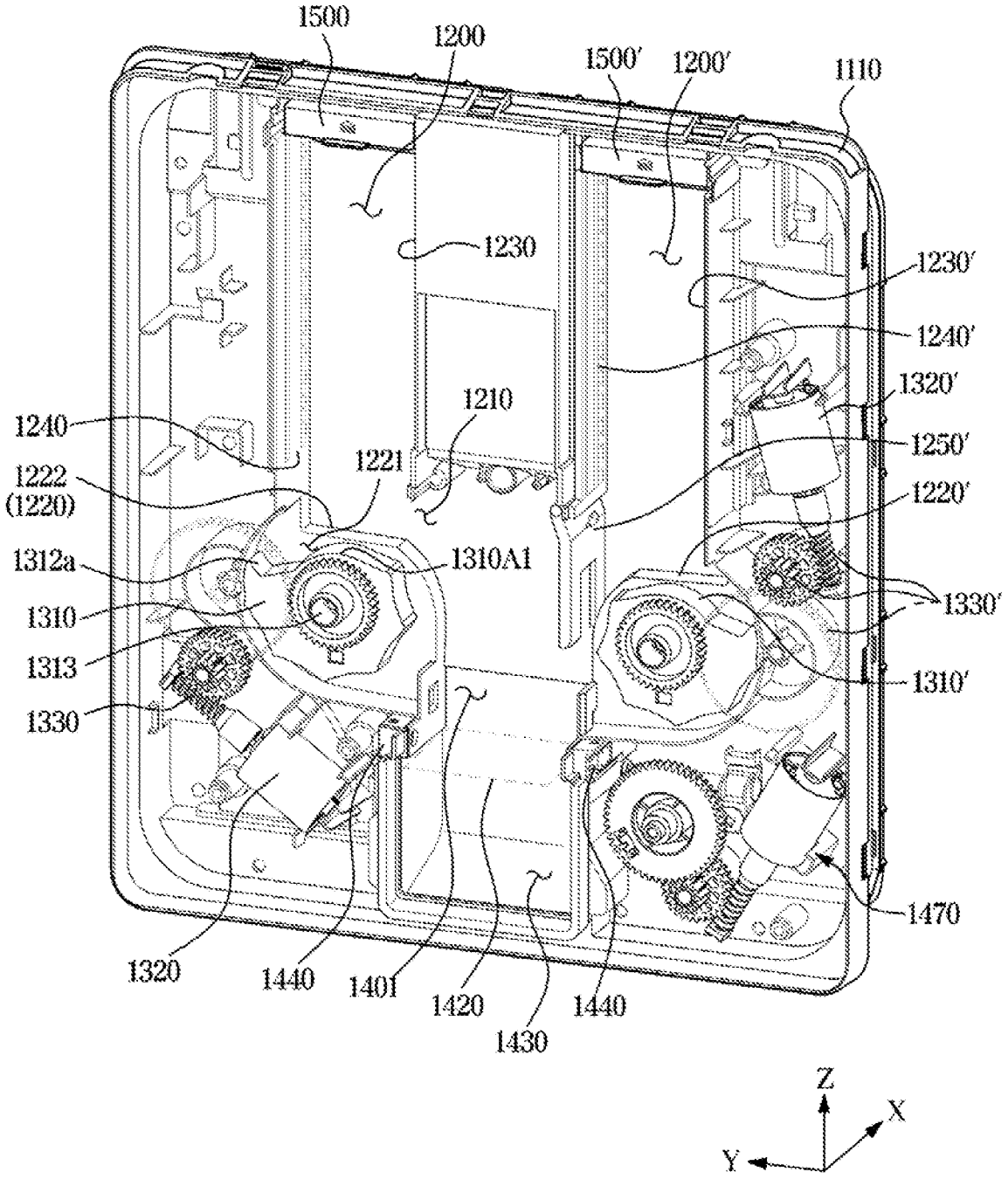
FIG. 6 is a perspective view of a state in which some components of the automatic detergent dispenser of the dishwasher according to an embodiment of the disclosure are removed.
Figure 7:
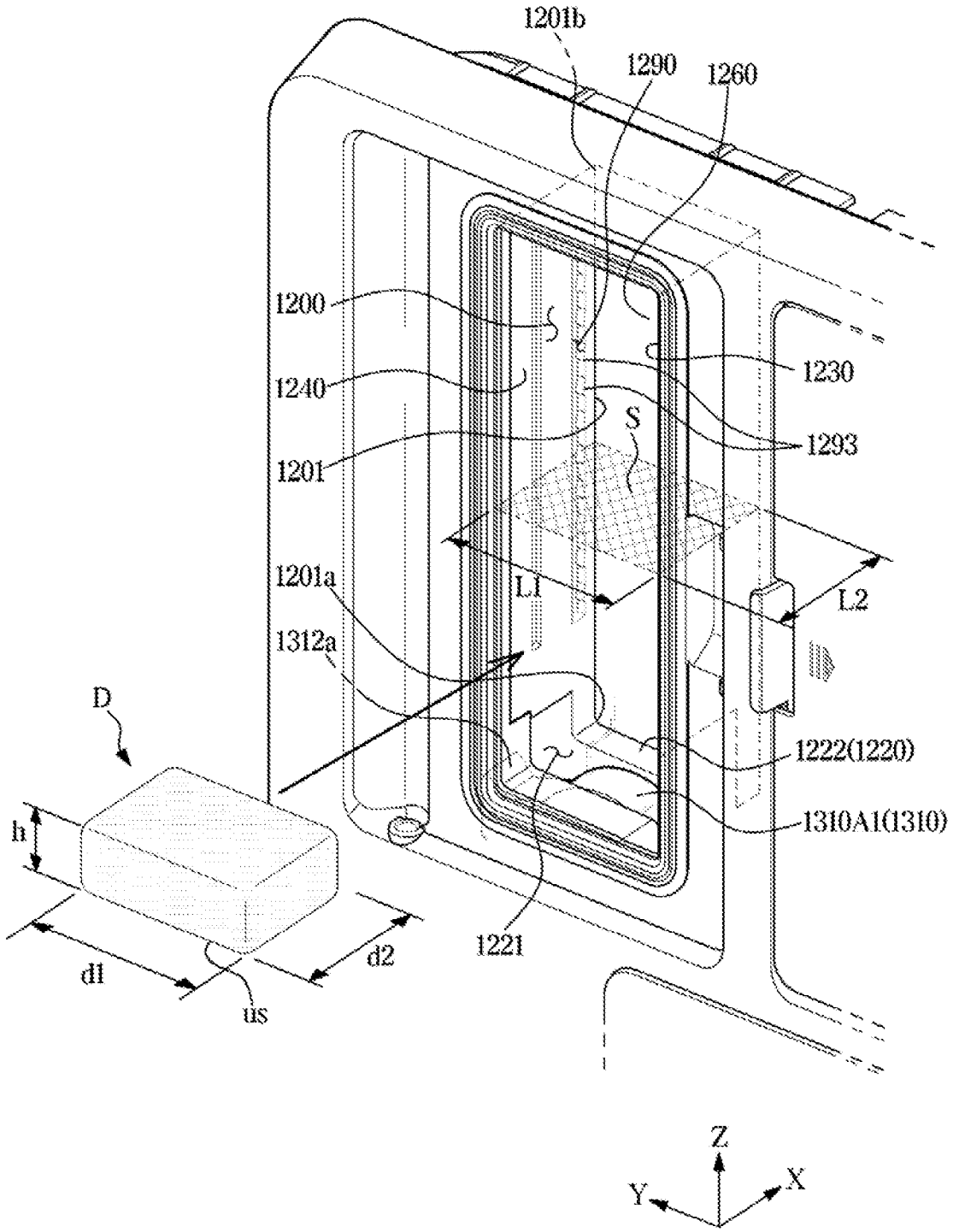
FIG. 7 is an enlarged perspective view of some components of the automatic detergent dispenser of the dishwasher according to an embodiment of the disclosure.
Figure 8:
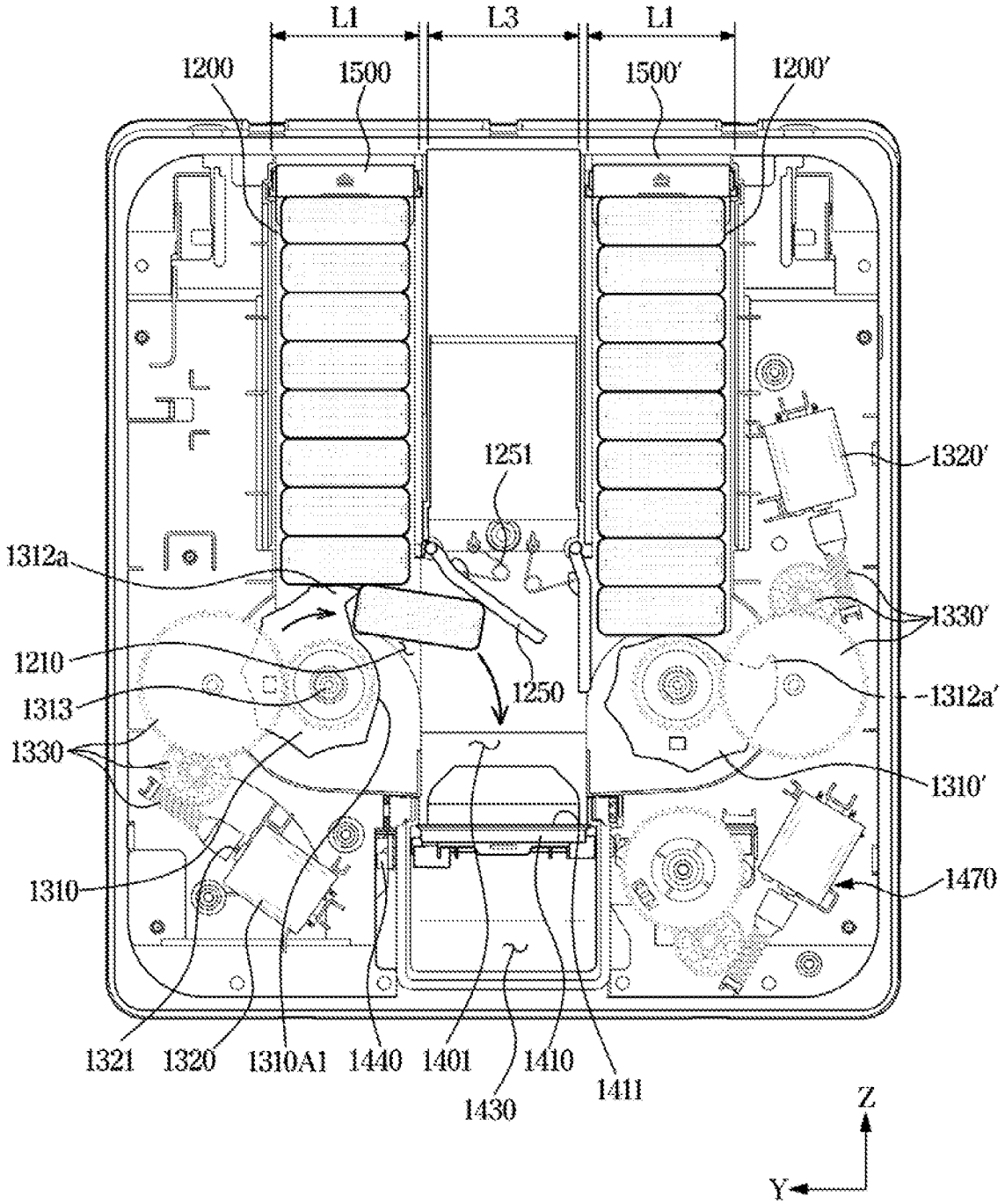
FIG. 8 is a view illustrating a state in which a solid detergent loaded in a first storage compartment is discharged from the first storage compartment in a state in which some components of the automatic detergent dispenser of the dishwasher according to an embodiment of the disclosure are removed.

FIG. 4 is an exploded perspective view of the automatic detergent dispenser of the dishwasher according to an embodiment, FIG. 5 is an exploded perspective view of the automatic detergent dispenser of the dishwasher according to an embodiment when viewed from another angle, FIG. 6 is a perspective view of a state in which some components of the automatic detergent dispenser of the dishwasher according to an embodiment are removed, FIG. 7 is an enlarged perspective view of some components of the automatic detergent dispenser of the dishwasher according to an embodiment, and FIG. 8 is a view illustrating a state in which a solid detergent loaded in a first storage compartment is discharged from the first storage compartment in a state in which some components of the automatic detergent dispenser of the dishwasher according to an embodiment are removed.

As illustrated in FIGS. 4 and 5, the automatic detergent dispenser 1000 may include a housing 1100.

The housing 1100 may include a first housing 1110 forming the storage compartment 1200 to be described later and a second housing 1120 coupled to the first housing 1110.

The first housing 1110 may be provided to be coupled to the inner surface 21 of the door 20.

The second housing 1120 may be coupled to the first housing 1110 in the first direction X when the automatic detergent dispenser 1000 is disposed at the first position 1000A.

The second housing 1120 may form the storage compartment 1200 together with the first housing 1110. The second housing 1120 may include a storage compartment opening 1121 provided to open the storage compartment 1200 to the outside. The second housing 1120 may include an inlet 1122 communicating with a seating member 1400 to be described later and configured to allow a solid detergent to be discharged from the automatic detergent dispenser 1000 and input into the tub 12.

The housing 1100 may include an intermediate housing 1130 disposed between the first housing 1110 and the second housing 1120 and provided to support an ejector 1300 and the like disposed inside the housing 1100.

For example, components such as the ejector 1300 may be seated on the first housing 1110 and supported by the intermediate housing 1130. Alternatively, components such as the ejector 1300 may be seated on the second housing 1120 and supported by the intermediate housing 1130.

For example, the intermediate housing 1130 may be integrally formed with the first housing 1110. Alternatively, the intermediate housing 1130 may be integrally formed with the second housing 1120.

The housing 1100 may include the storage compartment cover 1140 disposed on the second housing 1120 and configured to open and close the storage compartment opening 1121.

The housing 1100 may include an inlet cover 1150 disposed on the second housing 1120 and configured to open and close the inlet 1122.

The first housing 1110 may include a control device seating member 1111 disposed in a direction opposite to the direction in which the first housing 1110 is coupled to the second housing 1120, and on which the control device 1900 configured to control the automatic detergent dispenser 1000 is seated.

For example, the control device seating member 1111 may be disposed on an outer side of an inside of the housing 1100 formed by coupling the second housing 1120 to the first housing 1110. For example, the control device seating member 1111 may be disposed inside the housing 1100 formed by coupling the second housing 1120 to the first housing 1110.

The first housing 1110 may include a control device cover 1112 covering the control device seating member 1111 from the outside. The control device cover 1112 is not disposed in the inner space of the housing 1100, which is formed by the combination of the first and second housings 1110 and 1120, but is disposed outside the inner space of the housing 1100. Accordingly, when it is required to replace the control device 1900, the control device 1900 may be easily replaced without disassembling the first and second housings 1110 and 1120.

The control device 1900 may control the driving of the ejector 1300 and a seating member door 1410, which will be described later, and may control the automatic detergent dispenser 1000 based on sensing values of various sensors.

The control device 1900 may be configured to communicate with the main control device of the dishwasher 1. For example, the control device 1900 and the main control device may constitute a controller of the dishwasher 1.

The main control device may obtain a user input through an inputter of the dishwasher 1 or a mobile device, and may control driving of the dishwasher 1 based on the obtained user input.

The main control device may transmit information about the received user input to the control device 1900. The control device 1900 may control the automatic detergent dispenser 1000 based on information about the input received from the main control device.

The automatic detergent dispenser 1000 may include a wire W electrically connecting the control device 1900 to electronic components configured to drive the automatic detergent dispenser 1000. The wire W may electrically connect the electronic components (a driving motor 1320, a seating member door driver 1470 and various sensors) configured to drive the automatic detergent dispenser 1000 to allow one of the plurality of solid detergents loaded in the storage compartments 1200 and 1200' to be input into the tub 12, and the control device 1900.

For example, the wire W may electrically connect the main control device and a power supplier of the dishwasher 1 to the control device 1900. For example, the wire W may be provided to electrically connect only some of components such as various electronic components and the control device 1900 of the automatic detergent dispenser 1000 or the main control device of the dishwasher 1.

For example, at least some of components of various electronic components, sensors and the control device 1900 of the automatic detergent dispenser 1000 or the main control device of the dishwasher 1 may be configured to transmit and receive signals to each other by wireless communication without being electrically connected through the wire W.

The control device 1900 may control the automatic detergent dispenser 1000 based on values sensed by various sensors of the automatic detergent dispenser 1000. This will be described later in detail.

As illustrated in FIGS. 6 to 8, the automatic detergent dispenser 1000 may include the storage compartment 1200 in which a plurality of solid detergents is loaded.

When the automatic detergent dispenser 1000 is disposed at the first position 1000A, the storage compartment 1200 may be provided to allow a plurality of solid detergents to be stacked in the third direction Z corresponding to the vertical direction. For example, the storage compartment 1200 may be provided with the plurality of storage compartments 1200 and 1200'. However, for convenience of description, a single storage compartment 1200 will be described.

The storage compartment 1200 may correspond to a space formed by the first housing 1110 and the second housing 1120. In order to allow the plurality of solid detergents to be stacked and loaded in the third direction Z, the storage compartment 1200 may be provided with a space including a long side 1201 extending in the third direction Z when the automatic detergent dispenser 1000 is disposed at the first position 1000A.

For example, the storage compartment 1200 may be provided as a space formed by the first housing 1110. Alternatively, the storage compartment 1200 may be provided as a space formed by the second housing 1120.

When the storage compartment cover 1140 opens the storage compartment opening 1121, the storage compartment 1200 may be opened to the outside through the storage compartment opening 1121. As shown in FIG. 3, when the automatic detergent dispenser 1000 is placed at the second position 1000B, a user can open the storage compartment cover 1140 and input a plurality of solid detergents into the storage compartment 1200 so as to load the plurality of solid detergents into the storage compartment 1200.

The automatic detergent dispenser 1000 is disposed on the inner surface 21 of the door 20, and thus when the door 20 is opened, the automatic detergent dispenser 1000 may be disposed outside the washing chamber C and thus a user can easily input the detergent.

The storage compartment 1200 may have a predetermined volume or more to store a plurality of solid detergents. As described above, the automatic detergent dispenser 1000 is disposed on the inner surface 21 of the door 20, and thus when a volume of the storage compartment 1200 increases in the first direction X, a volume of the washing chamber C may be reduced. In order to prevent the volume of the storage compartment 1200 from increasing in the first direction X, the storage compartment 1200 may be provided to allow a plurality of solid detergents to be stacked in the third direction Z corresponding to the vertical direction when the automatic detergent dispenser 1000 is at the first position 1000A.

When the automatic detergent dispenser 1000 is disposed at the first position 1000A, the plurality of solid detergents may be loaded in the storage compartment 1200 so as to be stacked and arranged only in the third direction Z without being arranged in the first direction X.

The storage compartment 1200 may be formed to allow the plurality of solid detergents to be stacked only in the third direction Z. Accordingly, it is possible to maximally secure the space of the washing chamber C with respect to the first direction X as described above, and it is possible to secure the space of the storage compartment 1200 of the automatic detergent dispenser 1000 with respect to the second direction Y.

The storage compartment 1200 may be formed to allow a plurality of solid detergents to be stacked only in the third direction Z, and thus a driving configuration of the ejector 1300 such as a transmission member 1330 of the automatic detergent dispenser 1000 or an electronic configuration such as the control device 1900 may be arranged in the second direction Y in the storage compartment 1200. Accordingly, the volume of the automatic detergent dispenser 1000 in the second direction Y may be minimized.

Accordingly, on the inner surface 21 of the door 20, an additional component other than the automatic detergent dispenser 1000 may be disposed outside the automatic detergent dispenser 1000 in the second direction Y, and thus a ratio of the volume of the inner space of the tub 12 to the volume of the main body 10 of the dishwasher 1 may be increased.

However, it is not limited thereto, and a plurality of solid detergents may be loaded in the storage compartment 1200 to be stacked and arranged only in the second direction Y, which is the left and right direction, when the automatic detergent dispenser 1000 is disposed at the first position 1000A.

The automatic detergent dispenser 1000 may include the ejector 1300 configured to move one of the plurality of solid detergents, which is loaded on the storage compartment 1200, to the outside of the storage compartment 1200 so as to be discharged from the storage compartment 1200. For example, the ejector 1300 may be provided with a plurality of ejectors 1300 and 1300' corresponding to the number of the plurality of storage compartments 1200 and 1200'. However, for convenience of description, it will be described based on a single ejector 1300.

When the automatic detergent dispenser 1000 is disposed at the first position 1000A, the ejector 1300 may be configured to allow a single solid detergent, which is disposed at the lowest position in the third direction Z among the plurality of solid detergents stacked in the third direction Z, to be discharged to the outside of the storage compartment 1200.

The ejector 1300 may be disposed on one side 1201*a* of the long side 1201 with respect to an extension direction of the long side 1201. When the automatic detergent dispenser 1000 is disposed at the first position 1000A, the one side 1201*a* of the long side 1201 may be disposed on a lower side in the third direction Z, and the other side 1201*b* of the long side 1201 may be disposed on an upper side.

The ejector 1300 may be disposed below the storage compartment 1200 with respect to the third direction Z to allow a single solid detergent, which is disposed at the lowest position in the third direction Z among the plurality of solid detergents stacked in the third direction Z, to be discharged from the storage compartment 1200.

When the automatic detergent dispenser 1000 is disposed at the first position 1000A, the ejector 1300 may discharge a solid detergent, which is closest to a lower surface 1220 of the storage compartment 1200 among the plurality of solid detergents, to the outside of the storage compartment 1200.

For example, the ejector 1300 may be configured to press the solid detergent seated on the lower surface 1220 of the storage compartment 1200 among the plurality of solid detergents. That the solid detergent is seated on the lower surface 1220 means that the solid detergent is supported by the lower surface 1220 or that the solid detergent is placed in contact with the lower surface 1220. Accordingly, that the solid detergent is seated on the lower surface 1220 means that the solid detergent is placed in a position in which the solid detergent is pressed and then discharged from the storage compartment 1200 by the ejector 1300.

The storage compartment 1200 may include a storage compartment outlet 1210 provided to discharge one solid detergent to the outside of the storage compartment 1200 by the ejector 1300.

The storage compartment outlet 1210 may be arranged below the storage compartment 1200 to allow one solid detergent, which is disposed at the lowest position in the third direction Z among the plurality of solid detergents stacked in the third direction Z, to be discharged to the outside of the storage compartment 1200.

The storage compartment outlet 1210 and the ejector 1300 may be disposed below the storage compartment 1200 so as to discharge one solid detergent disposed at the lowest position among the plurality of solid detergents stacked in the third direction Z to the outside of the storage compartment 1200.

The storage compartment 1200 is provided to allow a plurality of solid detergents to be stacked in the third direction Z, and thus when the lowest solid detergent among the plurality of solid detergents is discharged to the outside of the storage compartment 1200, the plurality of solid detergents may be moved downward in the stacking direction by gravity.

Because all of the plurality of solid detergents is moved downward, the solid detergent, which is disposed directly above the solid detergent discharged to the outside of the storage compartment 1200, may be moved adjacent to the lower surface 1220 of the storage compartment 1200 and then disposed in a space in which the discharged solid detergent was located. The solid detergent may be discharged to the outside of the storage compartment 1200 by the ejector 1300 in the next washing process of the dishwasher 1.

That is, when the automatic detergent dispenser 1000 is disposed at the first position 1000A, the storage compartment 1200 may be provided to allow a plurality of solid detergents to be stacked in the third direction Z, and the ejector 1300 may be arranged on the lower side of the storage compartment 1200. Accordingly, the plurality of solid detergents may be discharged to the outside of the storage compartment 1200 in the stacking order from the lowest solid detergent in the third direction Z.

However, the ejector 1300 is not limited thereto, and the ejector 1300 may be configured to discharge one solid detergent, which is disposed at the highest position in the third direction Z among the plurality of solid detergents stacked in the third direction Z, from the storage compartment 1200.

As shown in FIG. 7, when a solid detergent D has a shape in which a horizontal length d1 and a vertical length d2 are greater than a height h, the solid detergent D may be loaded on the storage compartment 1200 to be stacked in the height h direction in the storage compartment 1200.

As for the solid detergent D described below, it is assumed that the horizontal length d1 is greater than the vertical length d2 and the height h.

For example, the solid detergent D may be loaded in the storage compartment 1200 in such a way that a direction formed by the smallest length among the horizontal length d1, the vertical length d2, and the height h of the solid detergent D corresponds to the stacking direction of the plurality of solid detergents.

This is to maximize the number of solid detergents D that may be loaded into the storage compartment 1200.

For example, when the automatic detergent dispenser 1000 is disposed at the first position 1000A, the solid detergent D may be loaded in the storage compartment 1200 in such a way that a surface of the solid detergent D formed in the horizontal length d1 and the vertical length d2 directions corresponds to a cross-sectional area S of the storage compartment 1200 formed in the first direction X and the second direction Y.

For example, the plurality of solid detergents D may be stacked inside the storage compartment 1200 with respect to the height h direction of the solid detergent D.

The solid detergent may have various sizes according to components, functions, or manufacturing companies of the solid detergent, but a volume of the solid detergent may be determined in proportion to the volume of the washing chamber of the dishwasher. Because the volume of the washing chamber is provided within a predetermined range, the volume of the solid detergent may also be provided within a predetermined range, and accordingly, the horizontal length, the vertical length, and the height of the solid detergent may be similarly designed regardless of the types of the solid detergent.

A solid detergent D described below may be defined as a suitable solid detergent D that may be loaded into the automatic detergent dispenser 1000 of the dishwasher 1 according to an embodiment, and the horizontal length d1, the vertical length d2, and the height h of the solid detergent D may be defined as an approximate value of a horizontal length, a vertical length, and a height of various solid detergents that may be loaded into the automatic detergent dispenser 1000 of the dishwasher 1. Further, the horizontal length d1, the vertical length d2, and the height h of the solid detergent D may be defined as a changeable value within a predetermined range. For example, the horizontal length d1 and the vertical length d2 may be defined based on dimensions provided in the first direction X and the second direction Y, and the horizontal length may also be defined as d2, and the vertical length may also be defined as d1.

An area S of the storage compartment 1200 (hereinafter it is referred to as a cross-sectional area of the storage compartment 1200) in the first direction X and the second direction Y in a state in which the automatic detergent dispenser 1000 is disposed at the first position A may be provided as a size in which the solid detergent D is easily loaded and stacked in the third direction Z.

The cross-sectional area S of the storage compartment 1200 may be formed by a pair of sides having a horizontal length L1 extending in the second direction Y and a pair of sides having a vertical length L2 extending in the first direction X when the automatic detergent dispenser 1000 is disposed at the first position A. For example, the horizontal length L1 and the vertical length L2 may be defined based on the dimension provided in the first direction X and the second direction Y, and the horizontal length may also be defined as L2, and the vertical length may also be defined as L1.

The horizontal length L1 of the cross-sectional area S of the storage compartment 1200 may be a length in the second direction Y between a right surface 1230 and a left surface 1240 of the storage compartment 1200, and the vertical length L2 of the cross-sectional area S of the storage compartment 1200 may be a length in the first direction X between an inner surface 1260 and the storage compartment opening 1121 of the storage compartment 1200.

When the solid detergent D is loaded into the storage compartment 1200, the solid detergent D may be arranged to allow one side having the horizontal length d1 of the solid detergent D to correspond to a side having the horizontal length L1 of the cross-sectional area S of the storage compartment 1200, and to allow the other side having the vertical length d2 of the solid detergent D to correspond to a side having the vertical length L2 of the cross-sectional area S of the storage compartment 1200.

As described above, because the vertical length d2 of the solid detergent D is formed to be less than the horizontal length d1, the horizontal length L1 of the cross-sectional area S may be formed to be greater than the vertical length L2. Further, because the horizontal length d1 of the solid detergent is formed to be greater than the length of the height h of the solid detergent D, the vertical length L2 of the cross-sectional area S may be formed to be greater than the height h of the solid detergent D.

The horizontal length L1 of the cross-sectional area S may be greater than the horizontal length d1 of the solid detergent D by approximately 10% to 30% of the horizontal length d1 of the solid detergent D.

The vertical length L2 of the cross-sectional area S may be greater than the vertical length d2 of the solid detergent D by approximately 10% to 30% of the vertical length d2 of the solid detergent D.

In order to allow the plurality of solid detergents to stably descend inside the storage compartment 1200 while maintaining a stacked arrangement when the solid detergent disposed at the lowest position in the third direction Z is moved out of the storage compartment 1200 by the ejector 1300, the cross-sectional area S of the storage compartment 1200 may be formed to have the above-mentioned value.

When the horizontal and vertical lengths L1 and L2 of the cross-sectional area S are formed to be greater than the horizontal and vertical lengths d1 and d2 of the solid detergent D by a length that is less than 10% of the horizontal and vertical lengths d1 and d2 of the solid detergent D, a plurality of solid detergents may be stuck inside the storage compartment 1200 while being moved downward inside the storage compartment 1200. Accordingly, it is difficult for the plurality of solid detergents to be stably moved downward.

For example, when the solid detergent disposed at the lowest position in the third direction Z among the plurality of stacked solid detergents is moved downward, the solid detergent may be stuck on the inside of the storage compartment 1200 without being seated on the lower surface 1220 of the storage compartment 1200. Accordingly, even when the ejector 1300 is driven, a pressing member 1312*a*, which will be described later, may not easily press the solid detergent disposed at the lowest position in the third direction Z, and thus the solid detergent may not be discharged from the storage compartment 1200.

When the horizontal and vertical lengths L1 and L2 of the cross-sectional area S are formed to be greater than the horizontal and vertical lengths d1 and d2 of the solid detergent D by a length that is more than 30% of the horizontal and vertical lengths d1 and d2 of the solid detergent D, the detergents may be rotated while being moved downward in the storage compartment 1200, and thus the stacked arrangement of the detergents may be broken.

For example, as the cross-sectional area S is formed to be greater than the solid detergent, the solid detergent may be rotated or moved in an oblique direction with respect to the third direction Z when being moved downward, and thus the solid detergent may be moved in the first direction X and the second direction Y without being moved in the third direction. Accordingly, the stacked arrangement of the plurality of solid detergents may not be maintained.

Therefore, the horizontal and vertical lengths L1 and L2 of the cross-sectional area S may be formed to be greater than the horizontal and vertical lengths d1 and d2 of the solid detergent D by approximately 10% to 30% of the horizontal and vertical lengths d1 and d2 of the solid detergent D.

Because the vertical length L2 of the cross-sectional area S of the storage compartment 1200 is formed to be greater than the vertical length d2 of the solid detergent D, the automatic detergent dispenser 1000 may have a predetermined thickness in the direction in which the vertical length L2 extends.

Accordingly, when the door 20 is disposed at the first position 20A, the automatic detergent dispenser 1000 may protrude from the door 20 toward the inside of the tub 12 in the first direction X and thus the inner space of the tub 12 may be reduced.

Particularly, as for the lower basket 51 disposed at a height substantially corresponding to the automatic detergent dispenser 1000 in the third direction Z, when the door 20 is disposed at the first position 20A, the lower basket 51 may collide with the automatic detergent dispenser 1000 with respect to the first direction X. To prevent this, the automatic detergent dispenser 1000 may be arranged to be spaced apart from the lower basket 51 in the first direction X when the automatic detergent dispenser 1000 is disposed at the first position 1000A. For example, when the automatic detergent dispenser 1000 is disposed at the first position 1000A, the automatic detergent dispenser 1000 may be arranged to be spaced apart from the intermediate basket 52 with respect to the first direction X.

In addition, the door 20 is disposed at the second position 20B, and accordingly, the lower basket 51 may be withdrawn toward the front of the tub 12 in the first direction X. When the lower basket 51 is withdrawn forward, the withdrawal of the lower basket 51 may be limited by the thickness of the automatic detergent dispenser 100 because the automatic detergent dispenser 1000 has a predetermined thickness in the extension direction of the vertical length L2.

The automatic detergent dispenser 1000 may be provided to be coupled to the inner surface 21 of the door 20. When the automatic detergent dispenser 1000 is coupled to the inner surface 21, at least a portion of the automatic detergent dispenser 1000 may be inserted into the inside of the door 20 in the first direction X.

Accordingly, when the automatic detergent dispenser 1000 is disposed at the first position 1000A, a predetermined separation distance between the automatic detergent dispenser 1000 and the lower basket 51 may be easily generated in the first direction X.

Accordingly, when the automatic detergent dispenser 1000 is disposed at the second position 1000B, the protrusion of the automatic detergent dispenser 1000 may be minimized in the third direction Z, and thus the lower basket 51 may be easily withdrawn in the first direction X without limitation of the automatic detergent dispenser 1000.

For example, the automatic detergent dispenser 1000 may be coupled to the inner surface 21 of the door 20 in such a way that, when the automatic detergent dispenser 1000 is disposed at the second position 1000B, the upper end of the automatic detergent dispenser 1000 in the third direction Z is positioned lower than the lower end of the lower basket 51 in the third direction Z. Accordingly, when the lower basket 51 slides out of the tub 12 and is withdrawn while the automatic detergent dispenser 1000 is disposed at the second position 1000B, the lower basket 51 may be withdrawn from the tub 12 without colliding with the automatic detergent dispenser 1000.

The ejector 1300 may include a pressing member 1310 configured to press and move one solid detergent, which is disposed at the lowest position in the third direction Z among the plurality of solid detergents stacked in the third direction Z, to the outside of the storage compartment 1200.

The pressing member 1310 may include a cam member configured to be rotated so as to press the solid detergent. Hereinafter the pressing member 1310 will be referred to as a cam member 1310.

The cam member 1310 may include a presser 1312*a* provided to protrude from a rim of the cam member 1310 and configured to press the solid detergent while being rotated by the rotation of the cam member 1310.

The presser 1312*a* may be rotated according to the rotation of the cam member 1310 and moved into the storage compartment 1200, and configured to press one solid detergent, which is disposed at the lowest position in the third direction Z among the plurality of solid detergents stacked in the third direction Z, so as to be moved to the outlet 1210. The cam member 1310 may move the solid detergent by pressing the solid detergent toward the direction of rotation of the cam member 1310.

For convenience of description, the rotation direction and the left and right sides of the cam member 1310 will be described based on the state shown in FIG. 8. The right side in FIG. 8 may be a direction corresponding to the left side in FIG. 1, and the left side in FIG. 8 may be a direction corresponding to the right side in FIG. 1. Accordingly, the left and right sides in FIG. 1 may be opposite to the left and right sides in FIG. 8 with respect to the second direction Y. However, for convenience of description, it will be described based on the left and right sides shown in FIG. 8.

In addition, the cam member 1310 to be described below will be described as an example of the cam member 1310 of the ejector 1300 disposed on the left side of the second direction Y shown in FIG. 8.

The ejector 1300 may be disposed below the storage compartment 1200, and thus when a rotation direction of the cam member 1310 is a clockwise direction, the cam member 1310 may move a solid detergent, which is seated on the lower surface 1220 of the storage compartment 1200, to the right side while the cam member 1310 rotates clockwise.

In order to discharge the solid detergent, which is moved to the right side, to the outside of the storage compartment 1200, the storage compartment outlet 1210 may be disposed below the right surface 1230 of the storage compartment 1200.

The storage compartment 1200 may include a penetration member 1221 formed on the lower surface 1220 of the storage compartment 1200 and provided to allow the presser 1312*a* to be moved from the outside of the storage compartment 1200 to the inside of the storage compartment 1200.

The penetration member 1221 may be provided to extend not only to the lower surface 1220 of the storage compartment 1200 but also to the lower side of the right surface 1230 and the left surface 1240 of the storage compartment 1200.

The presser 1312*a* may be rotated by the rotation of the cam member 1310 and moved into the storage compartment 1200 through the lower side of the left surface 1240 and the penetration member 1221 of the lower surface 1220, and then moved to the outside of the storage compartment 1200 through the lower side of the right surface 1230 and the penetration member 1221 of the lower surface 1220 according to the rotation of the cam member 1310.

The presser 1312*a* may be provided to be rotated while pressing the solid detergent seated on the lower surface 1220, so as to allow the solid detergent to be moved to the right side.

The penetration member 1221 may be provided in such a way that at least a portion of the lower surface 1220 is opened, as illustrated in FIG. 7. As at least a portion of the lower surface 1220 is opened, the cam member 1310 disposed below the storage compartment 1200 may be rotated and the presser 1312*a* may be moved into the storage compartment 1200 through the penetration member 1221.

The penetration member 1221 may be provided in such a way that not all but at least a portion of the lower surface 1220 is opened For example, an area of a portion, in which the penetration member 1221 is formed, in the lower surface 1220 may be less than an area of a portion, which is closed in the third direction Z, in the lower surface 1220. Hereinafter the lower surface 1222 closed in the third direction Z is referred to as a support surface 1222. This is because the support surface 1222 supports the solid detergent located at the lowest position in the third direction Z.

For example, the penetration member 1221 may be provided to extend from the center of the lower surface 1220 with respect to the first direction X to the second direction Y. Accordingly, the front and rear sides of the penetration member 1221 with respect to the first direction X may be provided as the support surface 1222.

This is to allow the solid detergent located at the lowest position in the third direction Z to be stably positioned on the lower surface 1220 when the plurality of solid detergents is stacked. The support surface 1222 may support the solid detergent located at the lowest position in the third direction Z to allow the solid detergent to be disposed adjacent to the lower surface 1220, and thus the presser 1312*a* may easily press the solid detergent while the presser 1312*a* is moved through the penetration member 1221.

Particularly, the support surface 1222 may be formed in the front and rear of the penetration member 1221 in the first direction X, and the support surface 1222 may allow one solid detergent, which is disposed at the lowest position in the third direction Z, to be supported by the storage compartment 1200 horizontally in the third direction Z.

Accordingly, when the solid detergent is moved to the outside of the storage compartment 1200 by the presser 1312*a*, the solid detergent may be moved in the second direction Y in a substantially horizontal state with respect to the third direction Z.

For example, the support surface 1222 may guide the solid detergent, which is moved in the second direction Y, to be moved in a horizontal state with respect to the third direction Z. Based on FIG. 7, the solid detergent D may be loaded into the storage compartment 1200 in a state in which a lower surface (us) of the solid detergent D in the third direction Z is in contact with the support surface 1222. When the solid detergent D is pressed toward the second direction Y by the presser 1312*a*, the lower surface (us) of the solid detergent D may be guided by the support surface 1222 and then moved to the storage compartment outlet 1210 while the solid detergent D is maintained in a substantially horizontal state with respect to the third direction Z.

When the solid detergent is moved in the second direction Y while being inclined with respect to the third direction Z, the solid detergent may be rotated, or moved to another direction without being moved to the second direction Y by the center of gravity. Accordingly, the solid detergent may not be moved toward the storage compartment outlet 1210 and may not be discharged to the outside of the storage compartment 1200.

As for the cam member 1310, the rim of the cam member 1310 with respect to a rotation direction of the cam member 1310 may include a plurality of cam regions that is partitioned in the rotation direction of the cam member 1310. When a cam region, in which a rim having a shortest radius from a rotating shaft 1313 of the cam member 1310 is disposed, among the plurality of cam regions is defined as a first cam region 1310A1, the first cam region 1310A1 may be disposed on an upper end of the cam member 1310 when the dishwasher 1 does not perform the washing process.

The presser 1312*a* may protrude to a predetermined height in a radial direction of the cam member 1310 with respect to the first cam region 1310A1.

The presser 1312*a* may protrude to a predetermined height in the radial direction of the cam member 1310 with respect to the first cam region 1310A1, so as to allow a pressing force, which is capable of transferring the solid detergent D to the storage compartment outlet 1210, to be transferred to the solid detergent D.

The presser 1312*a* may protrude to a predetermined height in the radial direction of the cam member 1310 with respect to the first cam region 1310A1, and thus when the cam member 1310 is rotated, the presser 1312*a* may press the solid detergent D, which is disposed at the lowest position in the third direction Z without pressing a solid detergent disposed above the solid detergent D at the lowest position.

For example, the presser 1312*a* may protrude by 15 mm in the radial direction of the cam member 1310 with respect to the first cam region 1310A1.

When the first cam region 1310A1 of the cam member 1310 is disposed on the upper end of the cam member 1310, the first cam region 1310A1 may be disposed at a lower position than the support surface 1222 in the third direction Z. This is to allow, when the solid detergent located at the lowest position among the plurality of solid detergents is disposed on the lower surface 1220 of the storage compartment 1200, the solid detergent to be located in the storage compartment 1200 in a substantially horizontal state with respect to the third direction Z while preventing one side of the solid detergent from being pressed upward with respect to the third direction Z by the cam member 1310.

A cam member 1310' of an ejector 1300' disposed on the right side with respect to the second direction Y shown in FIG. 8 may be configured to be rotatable counterclockwise with respect to the direction shown in FIG. 8. Accordingly, the solid detergent loaded in the storage compartment 1200' disposed on the right side may be provided to be discharged to the left side of the storage compartment 1200'. This will be described later in detail.

The rotating shaft 1313 of the cam member 1310 may be provided to extend in the first direction X when the automatic detergent dispenser 1000 is disposed at the first position 1000A. The cam member 1310 may be disposed in such a way that the radial direction of the cam member 1310 is disposed in a direction perpendicular to the first direction X, and accordingly, when the cam member 1310 is disposed inside the housing 1100, a volume of the cam member 1310 may be minimized in the first direction X. As described above, this is to maximize the volume of the washing chamber C in the first direction X.

The ejector 1300 may include the driving motor 1320 configured to generate a rotational force to drive the cam member 1310. The driving motor 1320 may be arranged in such a way that a rotating shaft 1321 of the driving motor 1320 extends in a direction substantially perpendicular to the first direction X when the automatic detergent dispenser 1000 is disposed at the first position 1000A. Accordingly, when the driving motor 1320 is disposed inside the housing 1100, a volume of the driving motor 1320 in the first direction X may be minimized. As described above, this is to maximize the volume of the washing chamber C in the first direction X.

The ejector 1300 may include the transmission member 1330 configured to transmit a rotational force generated by the driving motor 1320 to the pressing member 1310.

The transmission member 1330 may include a plurality of gears. Because the rotating shaft 1313 of the cam member 1310 is arranged to extend in the first direction X and the rotating shaft 1321 of the driving motor 1320 is arranged to extend in a direction perpendicular to the first direction X, the transmission member 1330 may include a worm gear configured to vertically change a transmission direction of the driving force. For example, the transmission member 1330 may include a bevel gear.

When the transmission member 1330 includes a worm gear, it is possible to prevent the cam member 1310 from being arbitrarily rotated by an external force.

The worm gear of the transmission member 1330 is arranged to extend in a direction perpendicular to the first direction X in which the rotating shaft 1313 of the cam member 1310 extends, and thus when the transmission member 1330 is arranged in the housing 1100, a volume of the transmission member 1330 in the first direction X may be minimized. As described above, this is to maximize the volume of the washing chamber C in the first direction X.

The transmission member 1330 may connect the cam member 1310 and the driving motor 1320 to transfer the rotational force generated by the driving motor 1320 to the cam member 1310, and at this time, the transmission member 1330 may be configured to allow the cam member 1310 to be rotated with an appropriate rotational speed. For example, the transmission member 1330 may be configured to reduce the rotational speed of the rotating shaft 1321 of the driving motor 1320. The transmission member 1330 may be configured in various ways according to design factors such as a target rotational speed of the cam member 1310 and a rotational speed of the driving motor 1320.

The automatic detergent dispenser 1000 may include a holder 1500 provided to allow the plurality of solid detergents to be maintained in the stacked state inside the storage compartment 1200 when the automatic detergent dispenser 1000 is disposed at the first position 1000A and the second position 1000B or during the automatic detergent dispenser 1000 is moved between the first position 1000A and the second position 1000B.

The holder 1500 may be moved in a direction, in which the long side 1201 of the storage compartment 1200 extends, by guides formed on the both side surfaces 1230 and 1240 of the storage compartment 1200.

In the storage compartment 1200, the holder 1500 may be provided to be movable toward the plurality of solid detergents in a direction in which the plurality of solid detergents is stacked. This is because the direction, in which the plurality of solid detergents is stacked, corresponds to the direction in which the long side 1201 of the storage compartment 1200 extends.

The holder 1500 may be disposed above the plurality of solid detergents in the storage compartment 1200 when the automatic detergent dispenser 1000 is disposed at the first position 1000A.

The holder 1500 may be movable from the upper side to the lower side of the storage compartment 1200 when the automatic detergent dispenser 1000 is disposed at the first position 1000A. The holder 1500 may be moved downward inside the storage compartment 1200 by gravity when the automatic detergent dispenser 1000 is disposed at the first position 1000A.

When the automatic detergent dispenser 1000 is disposed at the first position 1000A, the stacking direction of the plurality of solid detergents may correspond to the third direction Z, and the holder 1500 may be moved in the third direction Z by gravity. Accordingly, the holder 1500 may be provided to press the solid detergent, which is disposed at the highest position in the third direction Z among the plurality of solid detergents, downward.

The holder 1500 may include a weight member having a weight greater than a predetermined weight so as to be moved in the third direction Z by gravity. For example, the weight member may be integrally provided with the holder 1500. Alternatively, the weight member may be provided to be coupled to the holder 1500.

For example, the holder 1500 may be formed of a heavy material so as to have a weight greater than a predetermined weight.

The holder 1500 may be provided to have a weight greater than or equal to a predetermined weight and may be provided to press the plurality of solid detergents downward with respect to the third direction Z.

When the solid detergent, which is located at the lowest position in the third direction Z among the plurality of solid detergents, is discharged to the outside of the storage compartment 1200 by the ejector 1300, the plurality of solid detergents may be moved downward by gravity in the third direction Z corresponding to the stacking direction. The holder 1500 may press the plurality of solid detergents downward by gravity, and the holder 1500 may guide the downward movement of the plurality of solid detergents.

For example, when one of the plurality of solid detergents stacked in the third direction Z is separated from the arrangement and accordingly, some of the solid detergents are supported on the both side surfaces 1230 and 1240 of the storage compartment 1200, the downward movement of the plurality of solid detergents may be limited. In this case, the holder 1500 may guide the downward movement of the plurality of solid detergents by pressing the plurality of solid detergents downward.

As described above, the automatic detergent dispenser 1000 may be provided to allow a plurality of solid detergents to be stacked in the third direction Z when the automatic detergent dispenser 1000 is disposed at the first position 1000A, and thus it is possible to increase the space efficiency of the automatic detergent dispenser 1000 and the dishwasher 1 in the first direction X and the second direction Y.

In addition, the automatic detergent dispenser 1000 may be provided to allow the plurality of solid detergents to be easily and sequentially discharged from the bottom in the direction of gravity as the plurality of solid detergents is disposed in the direction of gravity.

However, when the door 20 is rotated from the first position 20A to the second position 20B to open the tub 12 or disposed at the second position 20B, the direction in which the plurality of solid detergents is stacked may be arranged to be directed to a direction different from the third direction Z.

At this time, because the stacking direction of the plurality of solid detergents is directed to a direction different from the direction of gravity, one of the plurality of solid detergents may be separated from the stacked structure, and the stacked arrangement of the plurality of solid detergents in the third direction Z may be broken.

For example, as described above, the solid detergent D may be loaded into the storage compartment 1200 in such a way that one surface of the solid detergent D, which is formed in the horizontal length d1 and vertical length d2 directions, faces the cross-sectional area S of the storage compartment 1200 formed in the first direction X and the second direction Y.

For example, the surface of the solid detergent D formed in the horizontal length d1 and vertical length d2 directions may be provided in a curved surface rather than a flat surface. Accordingly, when the plurality of solid detergents D is stacked, the plurality of solid detergents, which face to each other in the stacking direction, may be arranged to allow curved faces thereof to face each other, and thus when the stacking direction of the plurality of solid detergents is directed to a direction different from the direction of gravity, the plurality of solid detergents may be separated from the stacked arrangement.

That is, when the plurality of solid detergents D is stacked to allow the curved surface thereof to face each other, it is more difficult to maintain the stacked state. Accordingly, when the stacking direction corresponds to the gravity direction, the holder 1500 may press the plurality of solid detergents D to the stacking direction, and when the stacking direction is different from the gravity direction, the holder 1500 may support the plurality of solid detergents D so as to maintain the arrangement of the plurality of solid detergents D.

Even when the door 20 is disposed at the first position 20A again in a state in which the stacked arrangement of the plurality of solid detergents is broken, the movement of the plurality of solid detergents in the direction of gravity may be restricted. Further, the solid detergent, which is disposed at the lowest position in the third direction Z among the plurality of solid detergents, may be abnormally seated on the lower surface 1220 of the storage compartment 1200, and thus the solid detergent may not be discharged to the outside of the storage compartment 1200 by the ejector 1300.

That the solid detergent is abnormally seated on the lower surface 1220 means a state in which, when the solid detergent is placed on the lower surface 1220, the ejector 1300 fails to press the solid detergent or means that the solid detergent is placed at a position in which the solid detergent is prevented from being discharged to the outside of the storage compartment 1200 even when the solid detergent is pressed by the ejector 1300.

To prevent this, the holder 1500 may prevent the stacked arrangement of the plurality of solid detergents from being broken when the stacking direction of the plurality of solid detergents is directed to a direction different from the third direction Z due to the movement of the door 20.

The holder 1500 may be provided to maintain the stacked arrangement of the plurality of solid detergents while the door 20 is moved from the first position 20A to the second position 20B, or even when the door 20 is disposed at the second position 20B.

When the stacking direction of the plurality of solid detergents is directed to a direction different from the third direction Z, the holder 1500 may be provided to support the solid detergent disposed at the highest position in the third direction Z among the plurality of solid detergents.

When the stacking direction of the plurality of solid detergents is directed to a direction different from the third direction Z, the holder 1500 may be provided to be fixed at a position adjacent to the solid detergent disposed at the highest position in the third direction Z among the plurality of solid detergents.

When the stacking direction of the plurality of solid detergents is directed to a direction different from the third direction Z, the movement of the solid detergent, which is disposed at the highest position in the third direction Z among the plurality of solid detergents, may be blocked by the temporarily fixed holder 1500, and thus it is possible to prevent the solid detergent, which is disposed at the highest position in the third direction Z among the plurality of solid detergents, from being separated from the stacked arrangement.

The storage compartment 1200 may include a guide rail 1290 provided to guide the movement of the holder 1500 inside the storage compartment 1200.

The holder 1500 may be guided by the guide rail 1290 and translated in the extension direction of the long side 1201 of the storage compartment 1200.

The guide rail 1290 may be provided to allow the holder 1500 to be moved downward in the third direction Z when the automatic detergent dispenser 1000 is disposed at the first position 1000A.

For example, the holder 1500 may include a guide protrusion inserted into the guide rail 1290. The guide protrusion of the holder 1500 may be inserted into the guide rail 1290 and moved along the extension direction of the guide rail 1290.

The guide rail 1290 may be provided to extend in the extension direction of the long side 1201 of the storage compartment 1200. The holder 1500 may be configured to be moved along the extension direction of the guide rail 1290.

The guide rail 1290 may include a stopper 1293 provided to limit the movement of the holder 1500 when the automatic detergent dispenser 1000 is not positioned at the first position 1000A.

While the door 20 is moved from the first position 20A to the second position 20B, the movement of the holder 1500 may be limited in the storage compartment 1200 as the movement of the guide protrusion of the holder 1500 is limited by the stopper 1293.

Further, the holder 1500 may be provided to maintain the stacked arrangement of the plurality of solid detergents even when the door 20 is disposed at the second position 20B.

When the stacking direction of the plurality of solid detergents is directed to a direction different from the third direction Z, the holder 1500 may be provided to support the solid detergent disposed at the highest position in the third direction Z among the plurality of solid detergents.

When the stacking direction of the plurality of solid detergents is directed to a direction different from the third direction Z, the holder 1500 may be provided to be fixed to a position adjacent to the solid detergent disposed at the highest position in the third direction Z among the plurality of solid detergents.

Accordingly, when the stacking direction of the plurality of solid detergents is directed to a direction different from the third direction Z, the holder 1500 may be temporarily fixed to the inside of the storage compartment 1200 by the stopper 1293, and the movement of the solid detergent, which is disposed at the highest position in the third direction Z among the plurality of solid detergents, may be limited by the fixed holder 1500.

Even when the stacking direction of the plurality of solid detergents is directed to a direction different from the third direction Z, the stacked arrangement of the plurality of solid detergents may be maintained by the holder 1500. Accordingly, even when the plurality of solid detergents is stacked in the third direction Z in the state in which the automatic detergent dispenser 1000 is disposed at the first position 1000A, the automatic detergent dispenser 1000 may be configured to allow one of the plurality of solid detergents to be discharged to the outside of the storage compartment 1200 and then input to the tub 12.

The automatic detergent dispenser 1000 may include the seating member 1400 provided to seat one solid detergent discharged from the storage compartment 1200.

The seating member 1400 may be provided to communicate with the storage compartment outlet 1210. The seating member 1400 may include a seating member inner space 1401 provided to communicate with the storage compartment outlet 1210.

One of the plurality of solid detergents may be discharged from the storage compartment 1200 through the storage compartment outlet 1210 and moved to the seating member inner space 1401.

The seating member may include a discharge guide 1430 connected to the tub 12. The discharge guide 1430 may be provided as a space connected to the seating member inner space 1401.

For example, the seating member inner space 1401 and the discharge guide 1430 may be formed as one space, and the seating member inner space 1401 and the discharge guide 1430 may be partitioned by a seating member opening 1420 that is opened or closed by a seating member door 1410 described later.

For example, a lower end of the seating member inner space 1401 in the third direction Z may be formed as the seating member opening 1420, and the discharge guide 1430 may be a region that is formed from the seating member opening 1420 to the lower side with respect to the third direction Z.

The seating member 1400 may be provided to allow one solid detergent, which is moved to the seating member inner space 1401, to be temporarily seated on the seating member 1400 and then to be input into the tub 12.

The seating member 1400 may include the seating member opening 1420 that is connected to the discharge guide 1430 through which the seating member inner space 1401 is connected to the tub 12. The seating member opening 1420 may be provided to open toward the third direction Z when the automatic detergent dispenser 1000 is disposed at the first position 1000A.

The seating member 1400 may include the seating member door 1410 configured to open and close the seating member opening 1420. When the seating member door 1410 closes the seating member opening 1420, the seating member door 1410 may be provided to form a lower surface of the seating member inner space 1401.

The seating member door 1410 may include a seating surface 1411 on which the solid detergent is seated when the seating member door 1410 closes the seating member opening 1420. The seating surface 1411 may be disposed to face upward in the third direction Z when the seating member door 1410 closes the seating member opening 1420.

For example, the seating member opening 1420 may be defined as a surface closed by the seating member door 1410 in the seating member inner space 1401. Accordingly, a region formed above the upper surface of the seating member opening 1420 may be defined as the seating member inner space 1401, and a region formed below the lower surface of the seating member opening 1420 may be defined as the discharge guide 1430. When the seating member door 1410 closes the seating member opening 1420, the seating surface 1411 may be disposed on the seating member opening 1420, and accordingly, the seating surface 1411 may be defined as the lower surface of the seating member inner space 1401.

For example, the lower surface of the seating member inner space 1401 may be defined as the seating member opening 1420, but when the seating member door 1410 closes the seating member opening 1420, the lower surface of the seating member inner space 1401 may be defined as the seating member door 1410.

The seating member door 1410 may be provided to seal the seating member inner space 1401 from the outside when the seating member door 1410 closes the seating member opening 1420. Further, the seating member door 1410 may connect the seating member inner space 1401 and the tub 12 when the seating member door 1410 opens the seating member opening 1420.

The seating member 1400 may include the seating member door driver 1470 configured to open and close the seating member door 1410.

For example, the seating member door driver 1470 may include a driving motor and a transmission member.

For example, the transmission member of the seating member door driver 1470 may include a plurality of gears. For example, when the driving motor is rotated in one direction, the plurality of gears may transmit a rotational force in one direction to the seating member door 1410. The seating member door 1410 may be rotated in one direction by the received rotational force, so as to open the seating member opening 1420 in a state in which the seating member door 1410 closes the seating member opening 1420.

For example, when the driving motor is rotated in the opposite direction, the plurality of gears may transmit the rotational force in the opposite direction to the seating member door 1410. The seating member door 1410 may be rotated in the opposite direction by the received rotational force, so as to close the seating member opening 1420 in a state in which the seating member door 1410 opens the seating member opening 1420.

The seating member opening 1420 may communicate with the inlet 1122 by the discharge guide 1430. One solid detergent located in the seating member inner space 1401 may be discharged from the seating member inner space 1401 through the seating member opening 1420, and then discharged from the seating member opening 1420 to the outside of the automatic detergent dispenser 1000 through the inlet 1122. Accordingly, the solid detergent may be input to the tub 12.

The seating member 1400 may include the discharge guide 1430 formed between the seating member opening 1420 and the inlet 1122 and provided to guide the movement in which the solid detergent is moved from the seating member opening 1420 to the inlet 1122.

One solid detergent discharged from the storage compartment 1200 may be temporarily seated on the seating member 1400, and particularly, the solid detergent may be located on the seating surface 1411 of the seating member door 1410 forming the lower surface of the seating member inner space 1401.

The inlet 1122 may be opened and closed by the inlet cover 1150. The inlet cover 1150 may open the inlet 1122 while the solid detergent discharged along the discharge guide 1430 presses the inlet cover 1150.

The solid detergent may pass through the inlet 1120 while pressing the inlet cover 1150, and then move to the tub 12.

When the seating member door 1410 opens the seating member opening 1420, the solid detergent placed on the seating member door 1410 may be moved downward by gravity, and then discharged to the outside of the seating member inner space 1401 through the seating member opening 1420.

The automatic detergent dispenser 1000 may be configured to allow one solid detergent, which is discharged from the storage compartment 1200, to be moved to the outside of the storage compartment 1200 through the seating member 1400 without being immediately discharged to the outside of the automatic detergent dispenser 1000.

The storage compartment 1200 may include an intermediate door 1250 configured to open and close the storage compartment outlet 1210. The intermediate door 1250 may be configured to prevent a solid detergent, which is loaded into the storage compartment 1200, from being moved to the seating member 1400 by an external force without being discharged from the storage compartment 1200 by the ejector 1300.

The intermediate door 1250 may be biased in a direction to close the storage compartment outlet 1210. The intermediate door 1250 may include an elastic member 1251, and the intermediate door 1250 may be biased toward the storage compartment outlet 1210 by the elastic member 1251 to allow the intermediate door 1250 to close the storage compartment outlet 1210.

The solid detergent, which is pressed by the ejector 1300 and moved to the storage compartment outlet 1210 among the plurality of solid detergents loaded into the storage compartment 1200, may open the intermediate door 1250 by pressing the intermediate door 1250. As the intermediate door 1250 is opened, the solid detergent may be moved to the seating member 1400 through the storage compartment outlet 1210.

Even when the solid detergent is moved toward the storage compartment outlet 1210 by an external force, not by the pressing of the ejector 1300, the solid detergent may be blocked by the intermediate door 1250 and thus the solid detergent may not pass through the storage compartment outlet 1210 and may not be discharged from the storage compartment 1200.

When the solid detergent is moved by the presser 1312*a* and collides with the intermediate door 1250, the ejector 1300 may press the solid detergent to allow the biased intermediate door 1250 to be opened by the pressing of the solid detergent.

A force by which the intermediate door 1250 closes the storage compartment outlet 1210 by the elastic member 1251 may be set to be less than a force by which the solid detergent presses the door 1250 by the pressing of the ejector 1300.

As the seating member 1400 is formed between the storage compartment outlet 1210 and the tub 12, the storage compartment outlet 1210 may be connected to the tub 12 through the seating member 1400 without being directly connected to the tub 12.

When the storage compartment outlet 1210 is directly connected to the tub 12, the water remaining in the tub 12 may flow into the storage compartment 1200 through the storage compartment outlet 1210, and thus the plurality of solid detergents loaded inside the storage compartment 1200 may be damaged or deformed by the water.

In order to prevent this, the storage compartment outlet 1210 may be provided to be bypassed to the tub 12 through the seating member 1400 without being directly connected to the tub 12.

When it is required to input the solid detergent to the tub 12, the seating member 1400 may open the seating member opening 1420 to allow the seating member inner space 1401 to communicate with the tub 12. The seating member door 1410 may close the seating member opening 1420 at a stage when the solid detergent is not input into the tub 12, so as to minimize a flow of water, which remains in the tub 12, into the seating member inner space 1401.

The seating member 1400 may include a seating member sensor 1440 configured to detect whether a solid detergent is seated on the seating member 1400.

Because the storage compartment 1200 is provided to communicate with the seating member 1400, it is inevitable that the seating member sensor 1440 detects whether the solid detergent discharged from the storage compartment 1200 is seated on the seating member 1400.

The seating member sensor 1440 may be provided as a position sensor. For example, the seating member sensor 1440 may include an optical sensor.

The seating member sensor 1440 may detect whether or not the solid detergent is located in the seating member 1400, and the control device 1900 (refer to FIG. 5) of the dishwasher 1 may control the automatic detergent dispenser 1000 based on a value detected by the seating member sensor 1440.

The control device 1900 may receive information related to whether the solid detergent is loaded in the storage compartment 1200, whether the solid detergent is seated on the seating member 1400 after the ejector 1300 is driven in a state in which the solid detergent is loaded in the storage compartment 1200, and whether the solid detergent is discharged from the seating member 1400 after the solid detergent is seated on the seating member 1400, and control the automatic detergent dispenser 1000 based on the received information.

The control device 1900 may be configured to communicate with the main control device of the dishwasher 1 and configured to allow the controller to control the dishwasher 1 based on the received information.

For example, the control device 1900 and the main control device may be subordinate components of the controller, and both the dishwasher 1 and the automatic detergent dispenser 1000 may be controlled by the controller. However, in the following description, it is assumed that the automatic detergent dispenser 1000 is controlled by the control device 1900 only for the control of the automatic detergent dispenser 1000.

For example, when the seating member sensor 1440 fails to detect the solid detergent after the ejector 1300 is driven, the control device 1900 may determine that the solid detergent is not discharged from the storage compartment 1200 because the solid detergent is not loaded into the storage compartment 1200, or determine that the solid detergent is not discharged from the storage compartment 1200 due to a malfunction of the ejector 1300 even when the solid detergent is loaded into the storage compartment 1200. Based on the determination, the control device 1900 may control the automatic detergent dispenser 1000.

For example, the control device 1900 may allow the ejector 1300 to be driven again to move the solid detergent to the seating member 1400. In addition, the control device 1900 may communicate with the main control device, and the controller may control the dishwasher 1 not to perform the washing process of the dishwasher 1 based on a communication value.

For example, when the seating member sensor 1440 continuously fails to detect the solid detergent after the control device 1900 controls the ejector 1300 to be driven again, the control device 1900 may communicate with the main control device, and the controller may control the dishwasher 1 not to perform the washing process of the dishwasher 1 based on a communication value. Further, the controller may control a display to inform a user that there is no solid detergent in the storage compartment 1200.

For example, the display may be implemented as a display positioned on the main body 10 of the dishwasher 1. For example, the display may be implemented in a separate device configured to communicate with the dishwasher 1.

For example, when the seating member sensor 1440 fails to detect the solid detergent after the detection state is maintained since the seating member sensor 1440 detects the solid detergent in the seating member, the control device 1900 may determine that the solid detergent is discharged from the seating member 1400 and then input to the tub 12, and the control device 1900 may control the automatic detergent dispenser 1000 based on the determination. For example, the control device 1900 may communicate with the main control device, and the controller may control the dishwasher 1 to perform the washing process of the dishwasher 1 based on the communication value.

As the seating member sensor 1440 senses the position of the solid detergent in the seating member 1400, the control device 1900 may be configured to identify all of the above situations, and thus it is possible to minimize the number of additional sensors configured to detect a position of a solid detergent. That is, even when a position sensor, which is configured to additionally detect a position of the solid detergent, is not placed to the storage compartment 1200 or the discharge guide 1430, the control device 1900 may be configured to determine all of whether the solid detergent is located in the storage compartment 1200, or whether the solid detergent is located in the seating member inner space 1401 or whether the solid detergent is located in the outside of the seating member 1400, by placing the seating member sensor 1440 on the seating member 1400. This will be described later in detail.

As described above, the storage compartment 1200 may be provided in plurality. For example, two storage compartments 1200 may be provided.

Hereinafter for convenience of description, the storage compartment 1200 disposed on the left side in the second direction Y with respect to FIG. 8 is defined as a first storage compartment 1200, and a storage compartment 1200' disposed on the right side is defined as a second storage compartment 1200'. In addition, a configuration of the first storage compartment 1200 is defined as a first configuration, and a configuration of the second storage compartment 1200' is defined as a second configuration. For example, the intermediate door 1250 of the first storage compartment 1200 is defined as a first intermediate door 1250 and an intermediate door 1250' of the second storage compartment 1200' is defined as a second intermediate door 1250'.

In addition, an ejector configured to discharge a solid detergent stored in the first storage compartment 1200 is defined as a first ejector 1300, and an ejector configured to discharge a solid detergent stored in the second storage compartment 1200' is defined as a second ejector 1300'. In addition, a holder 1500 disposed inside the first storage compartment 1200 is defined as a first holder 1500, and a holder 1500 disposed inside the second storage compartment 1200' is defined as a second holder 1500'.

The first and second storage compartments 1200 and 1200' may be provided to be spaced apart from each other in the second direction Y. The first and second storage compartments 1200 and 1200' include long sides extending in the third direction Z when the automatic detergent dispenser 1000 is disposed at the first position 1000A, respectively. Accordingly, when the first and second storage compartments 1200 and 1200' are provided to be spaced apart from each other in the second direction Y, the first and second storage compartments 1200 and 1200' may be efficiently arranged inside the automatic detergent dispenser 1000.

Due to the first and second storage compartments 1200 and 1200', a user can load a large number of solid detergents into the automatic detergent dispenser 1000 at one time.

The seating member 1400 may be disposed between the first storage compartment 1200 and the second storage compartment 1200' in the second direction Y. The first storage compartment 1200 may be provided to communicate with the seating member 1400 as described above, and the second storage compartment 1200' may also be provided to communicate with the seating member 1400.

Accordingly, the first and second storage compartments 1200 and 1200' may communicate with the tub 12 through a single seating member 1400 arranged between the first storage compartment 1200 and the second storage compartment 1200' in the second direction Y.

This is to minimize the expansion of the automatic detergent dispenser 1000 in the second direction Y as the first and second storage compartments 1200 and 1200' share the seating member 1400. That is, when a plurality of seating members 1400 is provided to correspond to the first and second storage compartments 1200 and 1200', the automatic detergent dispenser 1000 may increase in volume in the second direction Y due to the plurality of seating members. However, as for the automatic detergent dispenser 1000, the first and second storage compartments 1200 and 1200' may communicate with each other through a single seating member 1400 as described above, and thus it is possible to minimize the length of the automatic detergent dispenser 1000 in the second direction Y.

Based on FIG. 8, the first storage compartment 1200 may be disposed on the left side of the seating member 1400 and the second storage compartment 1200' may be disposed on the right side of the seating member 1400 with respect to the second direction Y.

As described above, while the first cam member 1310 is rotated clockwise, the first cam member 1310 may move a solid detergent seated on the first lower surface 1220 of the first storage compartment 1200 to the right side of the first storage compartment 1200, and as the first storage compartment outlet 1210 is disposed below the first right surface 1230 of the first storage compartment 1200, the solid detergent may be moved to the seating member 1400 disposed on the right side of the first storage compartment 1200.

The first cam member 1310 may be provided to be rotated in a clockwise direction by interlocking with the first driving motor 1320 and the first transmission member 1330.

Conversely, a second cam member 1310' may be rotated counterclockwise. Unlike the first ejector 1300, the second ejector 1300' may be configured to move the solid detergent loaded in the second storage compartment 1200' to the left side.

The second cam member 1310' may be configured to be rotated in a counterclockwise direction by interlocking with a second driving motor 1320' and a second transmission member 1330'.

While the second cam member 1310' is rotated counterclockwise, the second cam member 1310' may move a solid detergent seated on a second lower surface 1220' of the second storage compartment 1200' to the left side of the second storage compartment 1200', and as a second storage compartment outlet 1210' is disposed below the second left surface 1240' of the second storage compartment 1200', the solid detergent may be moved to the seating member 1400 disposed on the left side of the second storage compartment 1200'.

The second storage compartment 1200' may include a second penetration member 1221' formed on the second lower surface 1220' of the second storage compartment 1200' and provided to allow a second presser 1312*a*' to be moved from the outside of the second storage compartment 1200' to the inside of the second storage compartment 1200'.

The second penetration member 1221' may be provided to extend not only to the second lower surface 1220' of the second storage compartment 1200' but also to the lower side of a second right surface 1230' and a second left surface 1240' of the second storage compartment 1200'.

The second presser 1312*a*' may be rotated by the rotation of the second cam member 1310' and moved into the second storage compartment 1200' through the lower side of the second right surface 1230' and the second penetration member 1221' of the second lower surface 1220', and then moved to the outside of the second storage compartment 1200' through the lower side of the second left surface 1240' and the second penetration member 1221' of the second lower surface 1220'.

The second presser 1312*a*' may be provided to be rotated while pressing the solid detergent seated on the second lower surface 1220', so as to allow the solid detergent to be moved to the left side.

The first rotating shaft 1313 of the first cam member 1310 may be disposed between the first left surface 1240 and the first right surface 1230 of the first storage compartment 1200 in the second direction Y. For example, the first rotating shaft 1313 of the first cam member 1310 may be disposed at the center of the left surface 1240 and the right surface 1230 of the first storage compartment 1200 in the second direction Y.

A second rotating shaft 1313' of the second cam member 1310' may be disposed between the second left surface 1240' and the second right surface 1230' of the second storage compartment 1200' in the second direction Y. For example, the second rotating shaft 1313' of the second cam member 1310' may be disposed at the center of the second left surface 1240' and the second right surface 1230' of the second storage compartment 1200' in the second direction Y.

A reason why the first and second rotating shafts 1313 and 1313' of the first and second cam members 1310 and 1310' are respectively at the center of the first and second storage compartments 1200 and 1200' disposed in the second direction Y as mentioned above, is to stably support and press the solid detergent when the first and second pressers 1312*a* and 1312*a*' of the first and second cam members 1310 and 1310' are rotated.

When the first and second rotating shafts 1313 and 1313' of the first and second cam members 1310 and 1310' are disposed outside the center of the first and second storage compartments 1200 and 1200' in the second direction Y, the first and second pressers 1312*a* and 1312*a*' may pass through the first and second penetration members 1221 and 1221' with a predetermined length or less of the first and second pressers 1312*a* and 1312*a*' and thus it is difficult for the first and second pressers 1312*a* and 1312*a*' to stably support the solid detergent, in a section in which the first and second pressers 1312*a* and 1312*a*' pass through the first and second penetration members 1221 and 1221' by the rotation of the first and second cam members 1310 and 1310'.

In a section in which the first and second pressers 1312*a* and 1312*a*' enter or exit the first and second storage compartments 1200 and 1200' by passing through the first and second penetration members 1221 and 1221', the first and second pressers 1312*a* and 1312*a*' may pass through the first and second penetration members 1221 and 1221' with a predetermined length or less of the first and second pressers 1312*a* and 1312*a*' and thus it is difficult for the first and second pressers 1312*a* and 1312*a*' to stably support the solid detergent loaded into the first and second storage compartments 1200 and 1200'.

To prevent this, the first and second rotating shafts 1313 and 1313' of the first and second cam members 1310 and 1310' may be respectively disposed at the center of the first and second storage compartments 1200 and 1200' in the second direction Y in order that the first and second pressers 1312*a* and 1312*a*' pass through the first and second penetration members 1221 and 1221' and are rotated with a predetermined length or more of the first and second pressers 1312*a* and 1312*a*', in a section in which the first and second pressers 1312*a* and 1312*a*' enter or exit the first and second storage compartments 1200 and 1200' through the first and second penetration members 1221 and 1221'.

When the first and second rotating shafts 1313 and 1313' of the first and second cam members 1310 and 1310' are not respectively disposed at the center of the first and second storage compartments 1200 and 1200' in the second direction Y, the volume of the automatic detergent dispenser 1000 in the second direction Y may increase. Accordingly, it is appropriate that the first and second rotating shafts 1313 and 1313' of the first and second cam members 1310 and 1310' are respectively disposed at the center of the first and second storage compartments 1200 and 1200' in the second direction Y.

The first ejector 1300 and the second ejector 1300' may be provided to be driven in a mirror-symmetrical direction in the second direction Y with respect to the seating member 1400. The first cam member 1310 and the second cam member 1310' may be configured to be rotated in opposite directions to each other so as to be mirror symmetrical about the seating member 1400.

In order that the first storage compartment 1200 and the second storage compartment 1200' are disposed on opposite sides of the seating member 1400 with respect to the second direction Y and the solid detergent discharged from the first and second storage compartments 1200 and 1200' is moved to the seating member 1400, the first ejector 1300 and the second ejector 1300' may be provided to be driven in a mirror-symmetrical direction Y with respect to the seating member 1400 in the second direction.

A width L1 of the first storage compartment 1200 in the second direction Y (or referred to as the horizontal length) may be substantially the same as a width L1 of the second storage compartment 1200'.

The width L1 of the first and second storage compartments 1200 and 1200' in the second direction Y may substantially correspond to a width L3 of the seating member 1400. When the solid detergent is discharged from the first and second storage compartments 1200 and 1200 in a state in which the width L3 of the seating member 1400 in the second direction Y is excessively less than the width L1 of the first and second storage compartments 1200 and 1200', the solid detergent may be stuck in the seating member inner space 1401 without being seated on the seating member door 1410.

Conversely, when the width L3 of the seating member 1400 in the second direction Y is excessively greater than the width L1 of the first and second storage compartments 1200 and 1200', the volume of the seating member 1400 in the second direction Y may increase more than necessary and thus the volume of the automatic detergent dispenser 1000 in the second direction Y may increase more than necessary.

Therefore, as described above, it is appropriate that the width L3 of the seating member 1400 may have a length corresponding to the width L1 of the first and second storage compartments 1200 and 1200' having a cross-sectional area S in accordance with the size of the solid detergent, in the second direction Y.

Hereinafter the operation of the automatic detergent dispenser 1000 will be described in detail.

Figure 9:
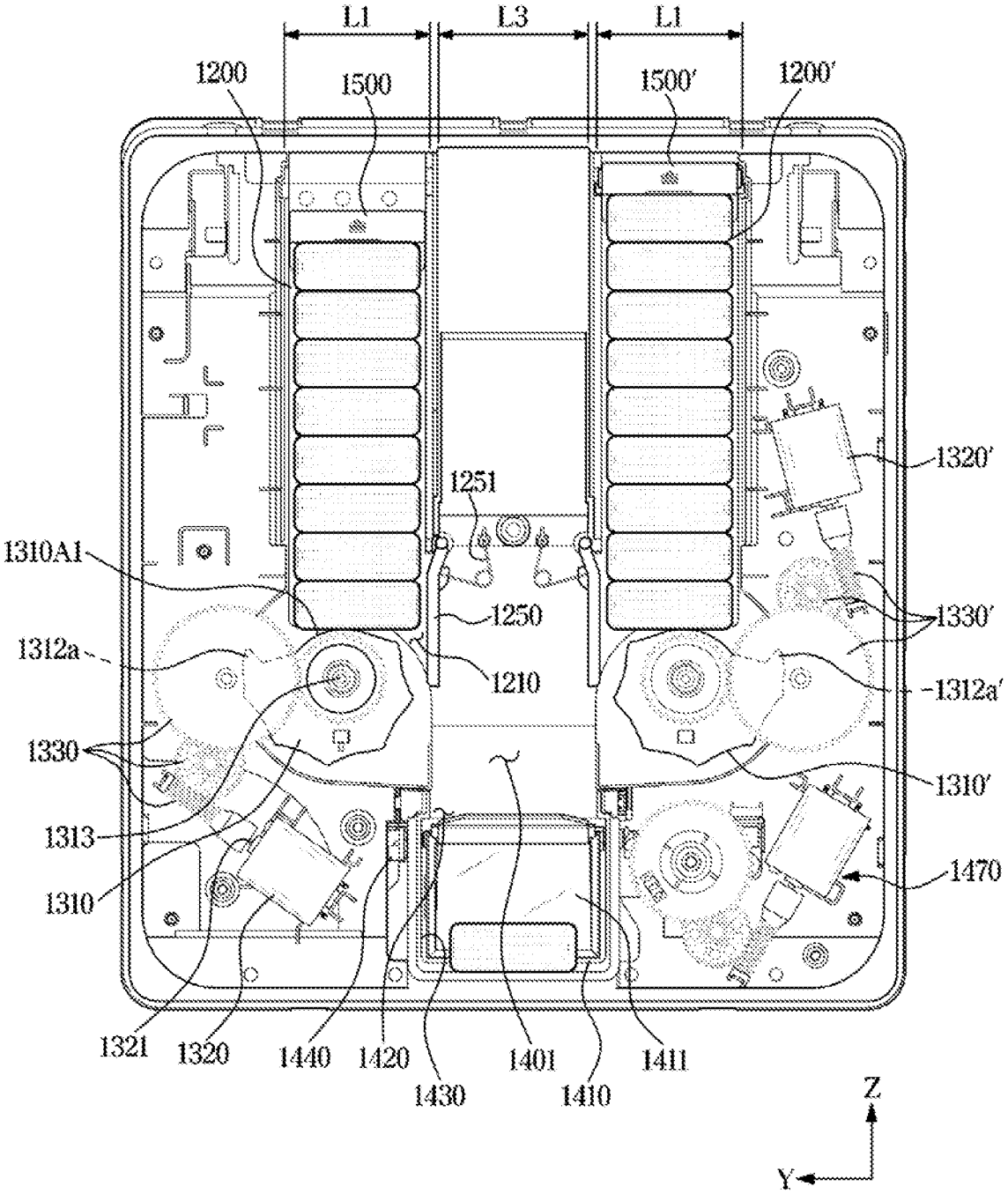
FIG. 9 is a view illustrating a state in which a solid detergent is discharged from the automatic detergent dispenser in a state in which some components of the automatic detergent dispenser of the dishwasher according to an embodiment of the disclosure are removed.

FIG. 8 is a view illustrating a state in which a solid detergent loaded in a first storage compartment is discharged from the first storage compartment in a state in which some components of the automatic detergent dispenser of the dishwasher according to an embodiment are removed, and FIG. 9 is a view illustrating a state in which a solid detergent is discharged from the automatic detergent dispenser in a state in which some components of the automatic detergent dispenser of the dishwasher according to an embodiment are removed.

As shown in FIG. 8, the control device 1900 may control the first ejector 1300 or the second ejector 1300' to allow one of the plurality of solid detergents stacked in one of the first storage compartment 1200 and the second storage compartment 1200' to be moved to the seating member 1400.

For example, the control device 1900 may control the first ejector 1300 to be driven. The control device 1900 may control the first ejector 1300 to be driven again or control the second ejector 1300' to be driven based on the sensing value of the seating member sensor 1440. A description thereof will be described later in detail.

By driving the first driving motor 1320, the control device 1900 may control the first ejector 1300 to allow the first cam member 1310 to be rotated clockwise.

By driving the second driving motor 1320', the control device 1900 may control the second ejector 1300' to allow the second cam member 1310' to be rotated clockwise.

The control device 1900 may control the position of the first cam member 1310 to allow the first cam region 1310A1 of the first cam member 1310 to be arranged at the upper end in the third direction Z before the first cam member 1310 is rotated and the first presser 1312*a* is moved into the storage compartment 1200.

When the first cam region 1310A1 of the first cam member 1310 is arranged at the upper end of the first cam member 1310 in the third direction Z, the first cam region 1310A1 may be disposed below the first support surface 1222 of the storage compartment 1200 in the third direction Z as described above. Accordingly, the solid detergent located at the lowest position in the third direction Z among the plurality of solid detergents loaded in the first storage compartment 1200 may be stably seated on the first support surface 1222, and thus the first presser 1312*a* may stably move the solid detergent to the second direction Y by the rotation of the first cam member 1310.

For example, when a part of the first cam member 1310 protrudes higher than the first support surface 1222 in the third direction Z through the first penetration member 1221, the solid detergent located at the lowest position in the third direction Z among the plurality of solid detergents loaded in the first storage compartment 1200 may not be horizontally disposed in the third direction Z. Accordingly, when the solid detergent is moved in the second direction Y, the solid detergent may be rotated or moved to another direction without being moved to the second direction Y by the center of gravity. Accordingly, the solid detergent may not be moved toward the first storage compartment outlet 1210 and may not be discharged to the outside of the first storage compartment 1200.

Accordingly, the control device 1900 may control the position of the first cam member 1310 to allow the first cam region 1310A1 of the first cam member 1310 to be arranged at the upper end in the third direction Z when the dishwasher 1 does not performs the washing process. Thereafter, when the dishwasher 1 performs the washing process, the control device 1900 may communicate with the main control device and the control device 1900 may control the first ejector 1300 to allow the first cam member 1310 to be rotated clockwise based on a communication value.

The first presser 1312*a* may be interlocked with the rotation of the first cam member 1310 and moved into the first storage compartment 1200, and accordingly, the solid detergent located at the lowest position in the third direction Z may be moved to the right side with respect to the second direction Y by the first presser 1312*a*.

The solid detergent may be pressed by the first presser 1312*a* and moved to the first storage compartment outlet 1210, and while the solid detergent opens the first intermediate door 1250 provided to close the first storage compartment outlet 1210, the solid detergent may be discharged to the outside of the first storage compartment 1200 through the first storage compartment outlet 1210.

Thereafter, the solid detergent may be disposed on the seating member 1400, particularly, on the seating member door 1410.

The seating member sensor 1440 may detect the position of the solid detergent, that is, whether or not the solid detergent is located in the seating member inner space 1401. Particularly, the seating member sensor 1440 may be arranged on the seating member door 1410 in the third direction Z and configured to detect whether the solid detergent is located on the seating member door 1410.

The control device 1900 may receive information on the position of the solid detergent located on the seating member door 1410 by the seating member sensor 1440 and communicate with the main control device, and the controller may control the dishwasher 1 to allow the dishwasher 1 to perform the washing process based on the communicated value.

For example, the washing process of the dishwasher 1 may be divided into the pre-washing operation, the main washing operation, the rinsing operation, and the drying operation. The controller may control the dishwasher 1 to allow the dishwasher 1 to perform the pre-washing operation based on the communicated value.

For example, when the seating member sensor 1440 fails to detect the solid detergent after driving the first ejector 1300 once, the control device 1900 may transmit the information that no solid detergent is detected to the main control device. The controller may control the dishwasher 1 to allow the dishwasher 1 not to perform the pre-washing operation of the washing process based on the communicated value. This is because, in some cases, a user can open the door 20 to load the solid detergent into the automatic detergent dispenser 1000. Accordingly, the controller may control the dishwasher 1 not to start the washing process itself when no solid detergent is placed in the seating member 1400.

For example, when the seating member sensor 1440 fails to detect the solid detergent after driving the first ejector 1300 once, the control device 1900 may additionally drive the first ejector 1300 once again, which is different from the above description. As described above, the controller may control the dishwasher 1 to allow the dishwasher 1 not to perform the washing process.

This is to drive the first ejector 1300 again to move the solid detergent to the second direction Y by the first presser 1312*a* so as to allow the solid detergent to be discharged to the outside of the first storage compartment 1200 when the solid detergent, which is disposed at the lowest position in the third direction Z among the plurality of solid detergents loaded into the first storage compartment 1200, is not stably seated on the first support surface 1222 and moved to another direction without being moved to the second direction Y by the first presser 1312*a* and thus the solid detergent is not discharged to the first storage compartment outlet 1210.

Thereafter, the control device 1900 may receive information on the position of the solid detergent located on the seating member door 1410 by the seating member sensor 1440 and communicate with the main control device, and the controller may control the dishwasher 1 to allow the dishwasher 1 to perform the washing process based on the communicated value.

As illustrated in FIG. 9, when the dishwasher 1 performs the main washing operation of the washing process by the controller, the control device 1900 may open the seating member door 1410 to allow the solid detergent to be discharged from the seating member inner space 1401 and to be input to the tub 12 through the discharge guide 1430.

When the seating member door 1410 opens the seating member opening 1420, the solid detergent may be moved to the discharge guide 1430 through the seating member opening 1420, and the solid detergent may be discharged from the automatic detergent dispenser 1000 along the discharge guide 1430 through the inlet 1122.

For example, the seating member door 1410 may open the seating member opening 1420 while rotating downward, and the solid detergent placed on the seating member door 1410 may be moved to the discharge guide 1430 by passing through the seating member opening 1420 while the solid detergent is moved downward according to the rotation of the seating member door 1410.

The control device 1900 may rotate the seating member door 1410 to allow the seating member door 1410 to open the seating member opening 1420, and after a predetermined time elapses, the control device 1900 may rotate the seating member door 1410 to the opposite direction to allow the seating member door 1410 to close the seating member opening 1420, again.

This is because while the seating member opening 1420 is opened for a predetermined period of time, water may flow from the tub 12 into the storage compartment 1200 through the seating member 1400. To prevent this, the control device 1900 may control opening and closing of the seating member door 1410.

The control device 1900 may control the seating member door driver 1470 to open and close the seating member door 1410. The seating member door driver 1470 may transmit a rotational force, which is in one direction or the opposite direction, to the seating member door 1410 under the control of the control device 1900, so as to drive the seating member door 1410 to open and close the seating member opening 1420.

When the control device 1900 receives information that no solid detergent is located in the seating member 1400 from the seating member sensor 1440 after the control device 1900 controls the seating member door 1410 to be opened and closed, the control device 1900 may communicate with the main control device and the controller may control the dishwasher 1 to perform the main washing operation of the washing process based on the communicated value.

This is to prevent the dishwasher 1 from performing the main washing operation in a state in which the solid detergent is not discharged from the seating member inner space 1401 due to adhesion of the solid detergent to the seating member door 1410 even when the seating member door 1410 opens and closes the seating member opening 1420.

The control device 1900 may receive information that no solid detergent is located in the seating member 1400 from the seating member sensor 1440 after the control device 1900 controls the seating member door 1410 to be opened and closed, and the control device 1900 may control the position of the first cam member 1310 to allow the first cam region 1310A1 of the cam member 1310 to be disposed at the upper end in the third direction Z.

Accordingly, as the solid detergent located at the lowest position in the third direction Z among the plurality of solid detergents is discharged to the outside of the first storage compartment 1200, the plurality of solid detergents loaded in the first storage compartment 1200 may be moved downward and a solid detergent, which is positioned directly above the discharged solid detergent, may be stably placed on the support surface 1222.

By repeating the above-described process, the control device 1900 may control the automatic detergent dispenser 1000 to allow the solid detergent to be automatically input into the tub 12 in response to the dishwasher 1 performing the washing process.

When receiving information that no solid detergent is detected by the seating member sensor 1440 after driving the first ejector 1300, the control device 1900 may drive the first ejector 1300 one more time and receive information on whether or not the solid detergent is detected from the seating member sensor 1440, as described above.

When receiving information that no solid detergent is detected by the seating member sensor 1440 even after driving the first ejector 1300 one more time, the control device 1900 may drive the second ejector 1300' based on the information.

Because all of the plurality of solid detergents loaded in the first storage compartment 1200 is discharged from the first storage compartment 1200, the seating member sensor 1440 may fail to detect the solid detergent even after the control device 1900 controls the first ejector 1300 to be driven twice.

Accordingly, the control device 1900 may control the second ejector 1300' to be driven. The feature of driving the second ejector 1300' by the control device 1900 is the same as the feature of driving the first ejector 1300 by the control device 1900, and thus a description thereof will be omitted.

In the above description, the configuration and operation of the automatic detergent dispenser 1000 of the dishwasher 1 according to an embodiment of the disclosure have been described with reference to FIGS. 1 to 9. However, the disclosure is not limited thereto, and the contents described above are merely examples of the dishwasher and the automatic detergent dispenser according to the disclosure.

For example, when the automatic detergent dispenser 1000 is at the first position 1000A, the plurality of solid detergents may be stacked and loaded in a direction different from the third direction Z that is a direction different from the vertical direction of the dishwasher 1, in the storage compartment 1200.

For example, when the automatic detergent dispenser 1000 is at the first position 1000A, the automatic detergent dispenser 1000 may include a storage compartment including a long side extending in the second direction Y, which is the left and right direction of the dishwasher 1. A plurality of solid detergents may be stacked and loaded in the second direction Y inside the storage compartment. The automatic detergent dispenser 1000 may include a holder configured to move the plurality of solid detergents, which is stacked in the second direction Y inside the storage compartment, to the second direction Y. For example, the holder may include an elastic member, and thus the holder may move the plurality of solid detergents to the second direction Y toward a cam member of an ejector. The cam member may press one of the plurality of solid detergents to be discharged to the outside of the storage compartment. For example, the solid detergent may be discharged to a direction perpendicular to the second direction Y and then moved to the lower side of the storage compartment. One solid detergent discharged to the outside of the storage compartment may be introduced into the tub 12 through a seating member or the like.

As an example, when the automatic detergent dispenser 1000 is at the first position 1000A, the automatic detergent dispenser 1000 may include storage compartments 1200 and 1200' in which a plurality of solid detergents is stacked and loaded in the third direction Z, as illustrated in FIGS. 1 to 9. However, unlike those shown in FIGS. 1 to 9, the automatic detergent dispenser 1000 may be provided to allow a plurality of solid detergents to be moved upward in the storage compartments 1200 and 1200' and then discharged. The automatic detergent dispenser 1000 may include a holder arranged inside the storage compartments 1200 and 1200' and configured to move the plurality of solid detergents to the upper side. For example, the holder may include an elastic member, and thus the holder may move the plurality of solid detergents to the upper side. A cam of an ejector may be disposed above the storage compartments 1200 and 1200', and one solid detergent disposed at the highest position among the plurality of solid detergents may be moved out of the storage compartment 1200 by the cam of the ejector. One solid detergent moved to the outside of the storage compartment 1200 may be introduced into the tub 12 through a seating member or the like.

For convenience of description, hereinafter it is assumed that when the automatic detergent dispenser 1000 is at the first position 1000A, the plurality of solid detergents is stacked and loaded in the third direction Z, which is the vertical direction, inside the storage compartments 1200 and 1200'. Further, it is assumed that the plurality of solid detergents is moved from top to bottom along the third direction Z in the storage compartments 1200 and 1200' and it is assumed that one solid detergent in the lowest position among the plurality of solid detergents is firstly discharged from the storage compartments 1200 and 1200'.

The term "third direction", which refers to the direction in which the plurality of solid detergents is stacked and loaded inside the storage compartments 1200 and 1200', is only a term for defining the stacking direction of the plurality of solid detergents. Therefore, the stacking direction of the plurality of solid detergents is not limited by the term "third direction". For example, the stacking direction of the plurality of solid detergents may be referred to as a "first direction" as needed, and even in this case, the term "first direction" may represent the Z direction shown in the drawings according to an embodiment of the disclosure (it is assumed that the automatic detergent dispenser 1000 is at the first position 1000A) and the like.

Figure 10:
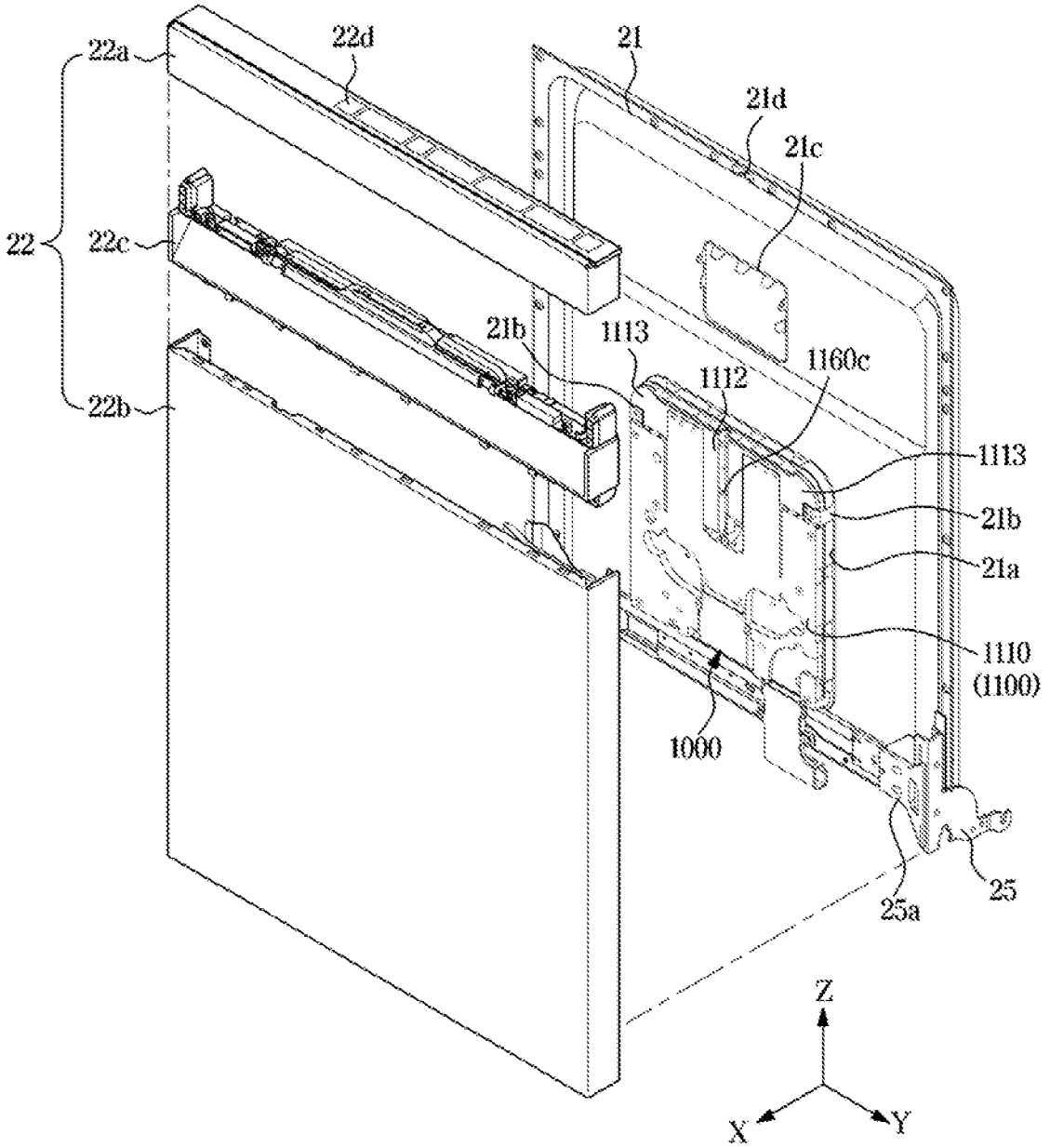
FIG. 10 is an exploded perspective view illustrating a coupling relationship between the door and the automatic detergent dispenser of the dishwasher according to an embodiment of the disclosure.
Figure 11:
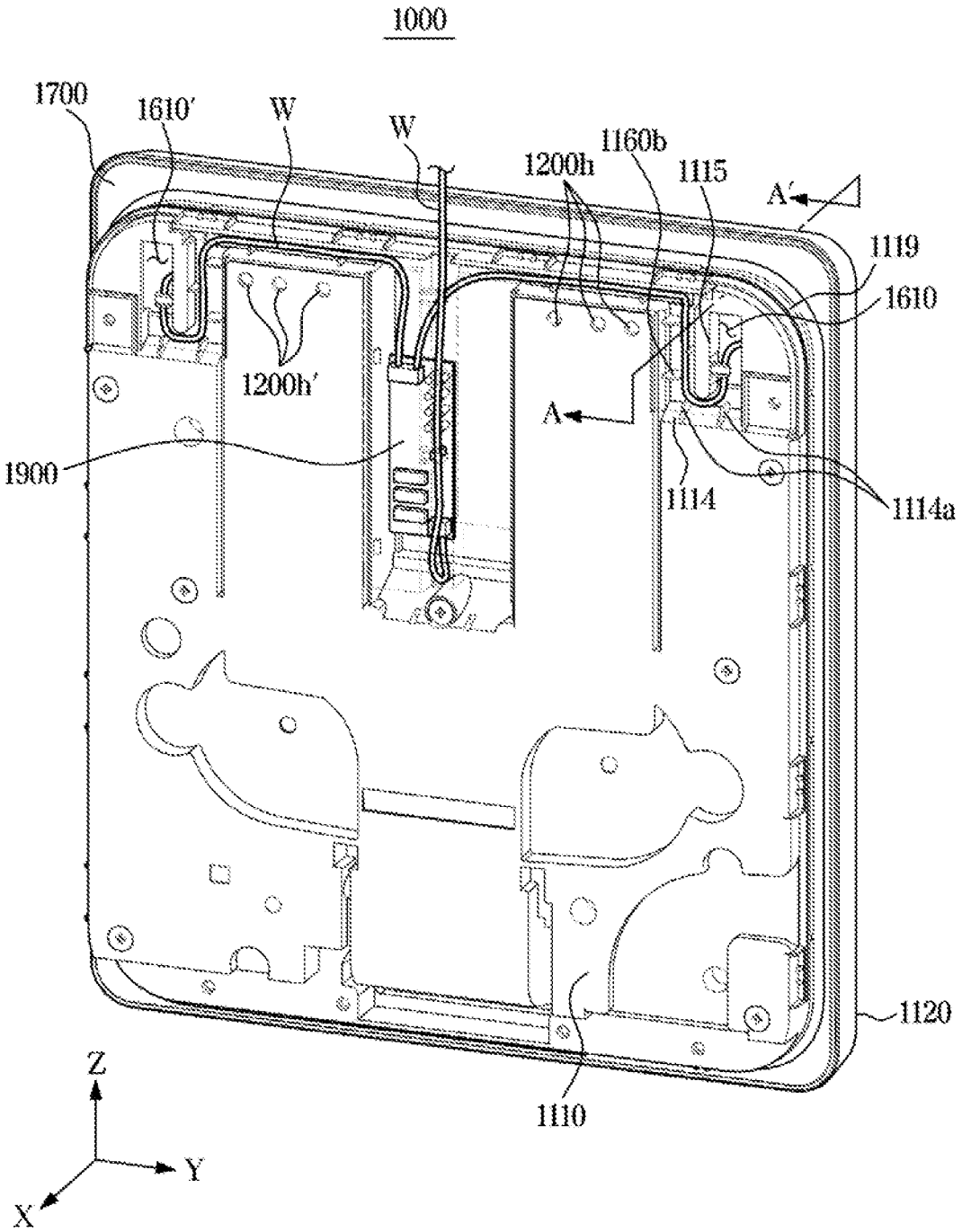
FIG. 11 is a perspective view illustrating the automatic detergent dispenser of the dishwasher according to an embodiment of the disclosure.
Figure 12:
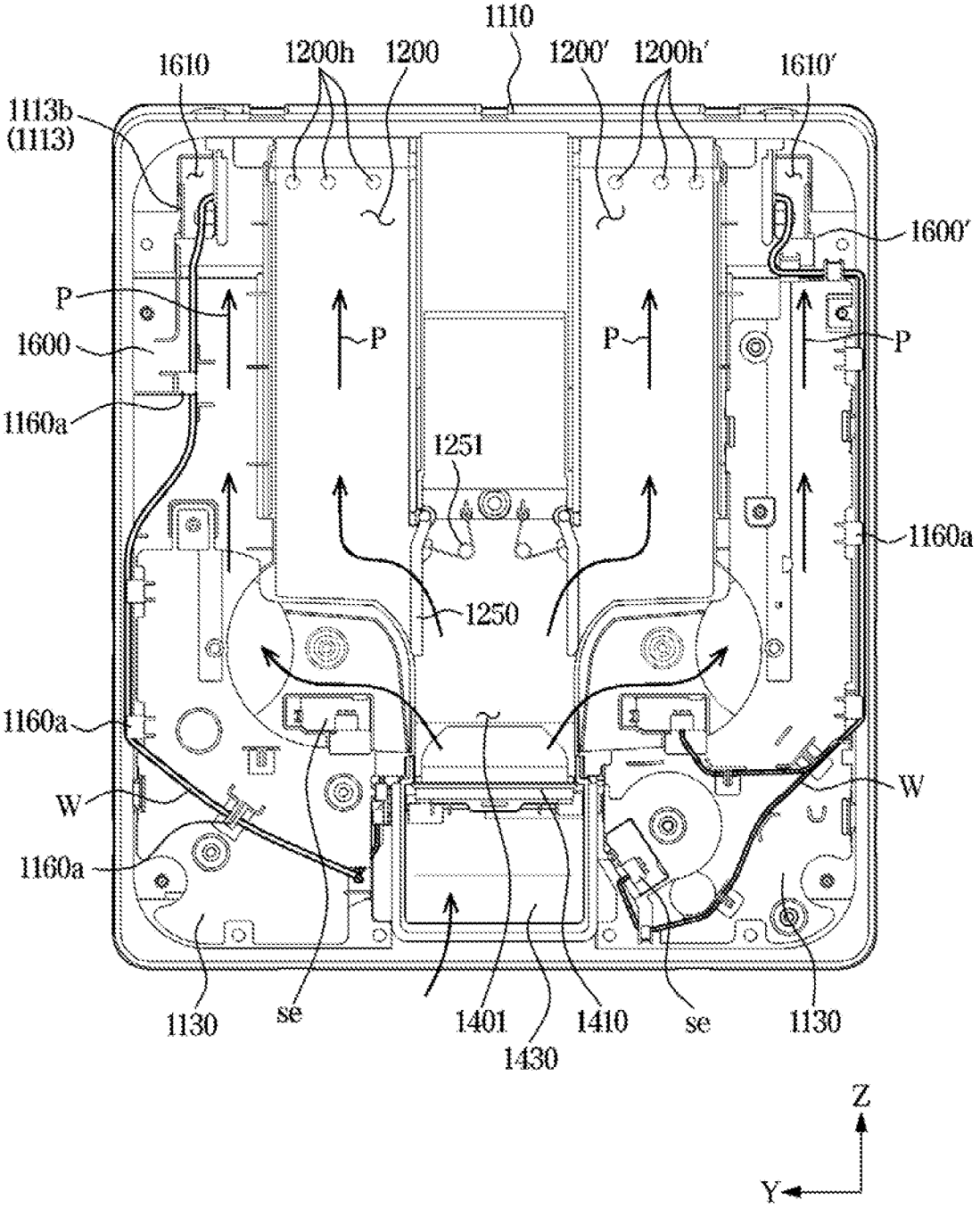
FIG. 12 is a view illustrating a state in which some components of the automatic detergent dispenser of the dishwasher according to an embodiment of the disclosure are removed.
Figure 13:
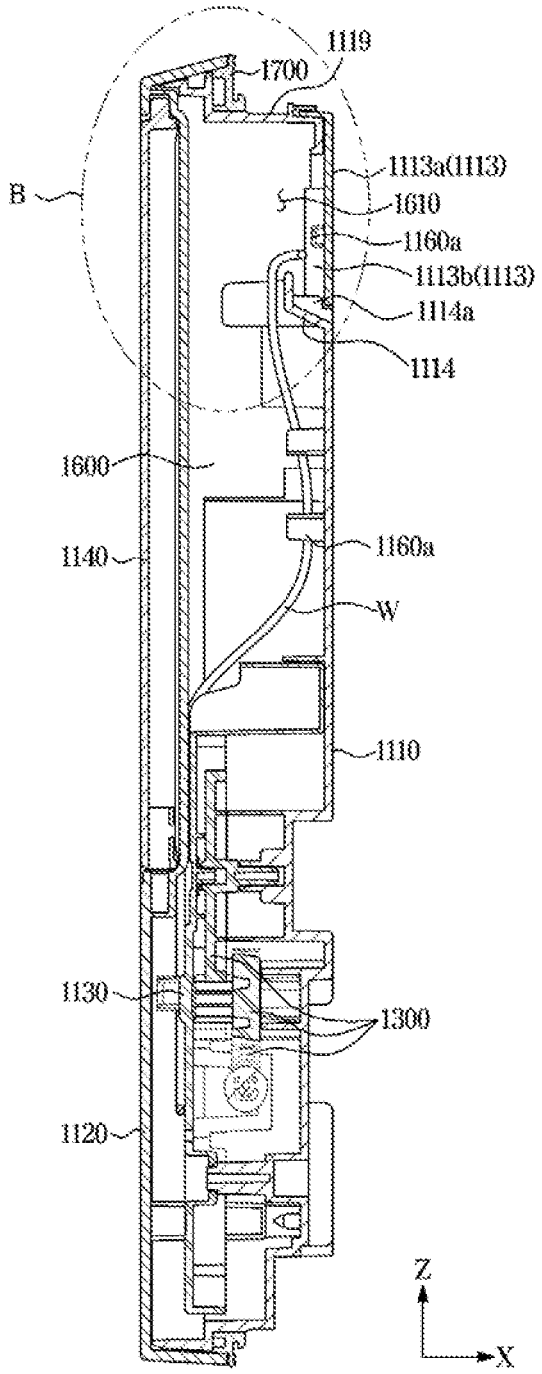
FIG. 13 is a side cross-sectional view taken along a line A-A' of FIG. 11.
Figure 14:
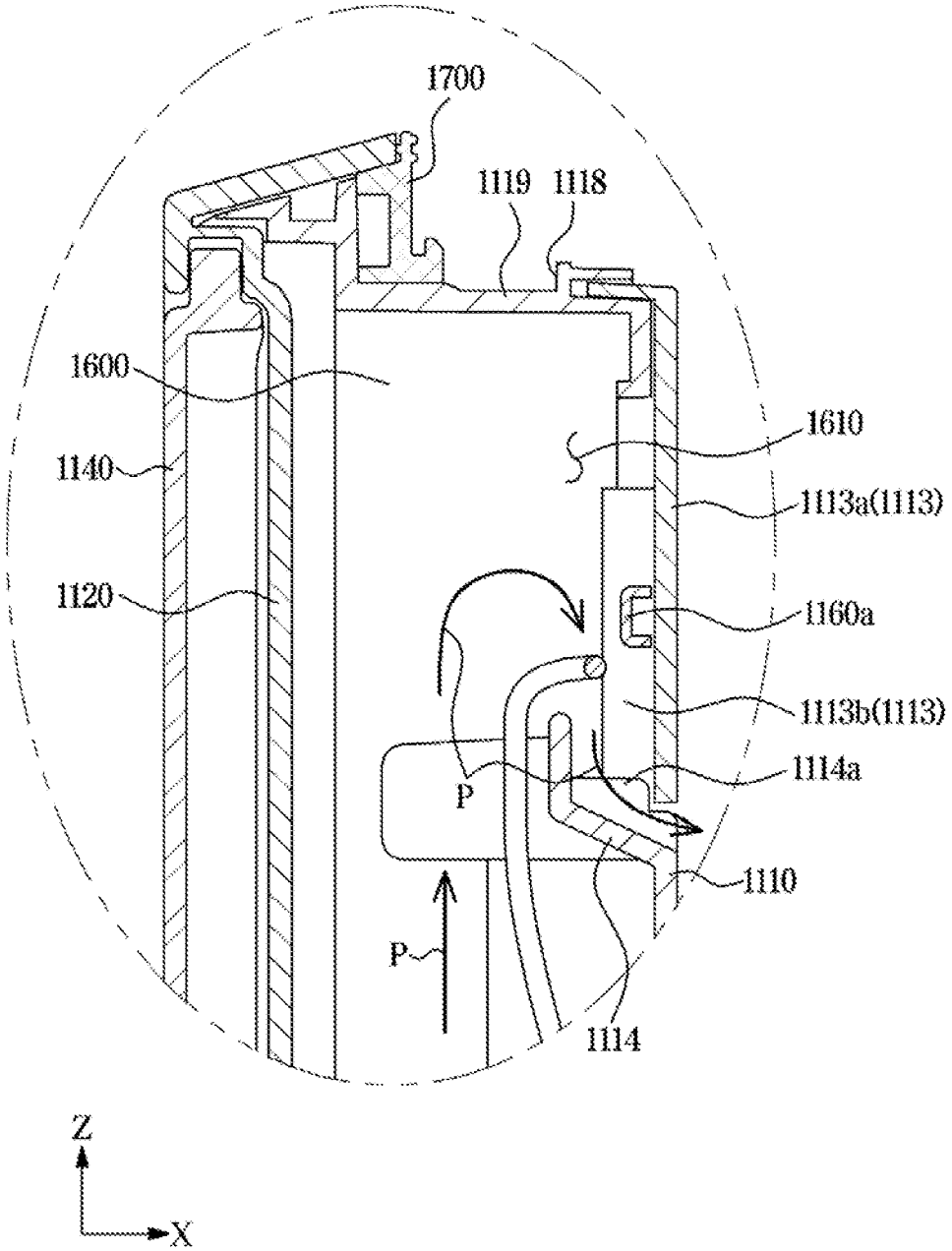
FIG. 14 is an enlarged view of a portion B of FIG. 13.

FIG. 10 is an exploded perspective view illustrating a coupling relationship between the door and the automatic detergent dispenser of the dishwasher according to an embodiment, FIG. 11 is a perspective view illustrating the automatic detergent dispenser of the dishwasher according to an embodiment, FIG. 12 is a view illustrating a state in which some components of the automatic detergent dispenser of the dishwasher according to an embodiment are removed, FIG. 13 is a side cross-sectional view taken along a line A-A' of FIG. 11, and FIG. 14 is an enlarged view of a portion B of FIG. 13.

Referring to FIGS. 10 to 14, the door 20 may include the outer surface 22 forming the exterior of the dishwasher 1 together with the main body 10, and the inner surface 21 facing the inside of the tub 12 when the door 20 closes the tub 12. The door 20 may include an outer frame 22 forming the outer surface 22 of the door 20. The door 20 may include an inner frame 21 forming the inner surface 21 of the door 20.

The outer frame 22 may include a first outer frame member 22*a*, a second outer frame member 22*b*, and a handle member 22*c* disposed between the first outer frame member 22*a* and the second outer frame member 22*b*. The first outer frame member 22*a*, the second outer frame member 22*b*, and the handle member 22*c* may be coupled to each other to form the front exterior of the door 20.

The first outer frame member 22*a* may form an upper portion of the outer frame 22. The second outer frame member 22*b* may form a lower portion of the outer frame 22.

The handle member 22*c* may be formed to be gripped by a user when the user opens and closes the door 20. For example, as shown in FIG. 10, the handle member 22*c* may include a shape inclined with respect to the first outer frame member 22*a* or the second outer frame member 22*b* and thus a user can easily grip the handle member 22*c*.

The outer frame 22 may include a display 22*d*. The display 22*d* may display information about the state of the dishwasher 1 (e.g., operating state and operating time of the dishwasher 1, and remaining amount of solid detergent loaded in the automatic detergent dispenser 1000, etc.) to a user. The display 22*d* may be provided to receive information for controlling the dishwasher 1 from a user. In other words, the display 22*d* may be configured to provide a user interface (UI). However, it is not limited thereto, and separately from the display 22*d*, a manipulator (not shown) configured to receive information for controlling the dishwasher 1 from a user may be arranged in the outer frame 22.

FIG. 10 illustrates an example in which the display 22*d* is arranged on the upper surface of the first outer frame member 22*a* in the third direction Z, but is not limited thereto. Alternatively, the display 22*d* may be arranged on the front surface of the first outer frame member 22*a*, or the second outer frame member 22*b*, or the handle member 22*c*.

Various electronic components such as a main control device (not shown) configured to control the operation of the dishwasher 1 may be arranged inside the door 20. For example, electronic components such as the main control device may be disposed inside the outer frame 22.

However, the configuration of the outer frame 22 is not limited thereto. For example, the outer frame 22 may be formed as the first outer frame member 22*a*, the second outer frame member 22*b*, and the handle member 22*c* are integrally formed with each other. For example, the outer frame 22 may be formed as the first outer frame member 22*a* and the second outer frame member 22*b* are integrally formed with each other. A handle formed to be gripped by a user for opening the door 20 may be arranged in the first and second outer frame members 22*a* and 22*b*.

The inner frame 21 may be coupled to the outer frame 22. Particularly, the inner frame 21 may be coupled to the outer frame 22 in a direction toward the tub 12 with respect to the outer frame 22 when the door 20 is in the first position 20A. That is, the inner frame 21 may be disposed rearward with respect to the outer frame 22 in the first direction X and coupled to the outer frame 22 when the door 20 is in the first position 20A.

The outer frame 22 and the inner frame 21 may be coupled to each other by various methods such as the screw fastening.

The outer frame 22 may include a front surface facing forward in the first direction X, both side surfaces facing the second direction Y, respectively, and an upper surface facing upward in the third direction Z when the door 20 is in the first position 20A.

The both side surfaces of the outer frame 22 may extend from the front surface of the outer frame 22 toward the inner frame 21. When the door 20 is in the first position 20A, the both side surfaces of the outer frame 22 may extend from both ends of the front surface of the outer frame 22 in the second direction Y to the rear side in the first direction X.

The upper surface of the outer frame 22 may extend from an upper end of the front surface of the outer frame 22 in the third direction Z toward the inner frame 21. When the door 20 is in the first position 20A, the upper surface of the outer frame 22 may extend from an upper end of the front surface of the outer frame 22 in the third direction Z to the rear side in the first direction X.

The inner frame 21 may be formed to include a substantially flat plate shape. When the door 20 is in the first position 20A, the inner frame 21 may be formed to face the first direction X. The inner frame 21 may be formed in parallel to the front surface of the outer frame 22.

The inner frame 21 may be coupled to a rear portion of the upper surface of the outer frame 22 in the first direction X and a rear portion of the both side surfaces of the outer frame 22 in the first direction X, respectively.

However, it is not limited thereto, and the outer frame 22 and the inner frame 21 may each include various shapes and may be coupled to each other by various configurations.

For example, the inner frame 21 may include a rear surface facing the rear side in the first direction X, both side surfaces facing the second direction Y, and an upper surface facing the upper side in the third directions Z when the door 20 is in the first position 20A. The both side surfaces of the inner frame 21 may extend from the rear surface of the inner frame 21 toward the outer frame 22. When the door 20 is in the first position 20A, the both side surfaces of the inner frame 21 may extend from both ends of the rear surface of the inner frame 22 in the second direction Y toward the front side in the first direction. The upper surface of the inner frame 21 may extend from an upper end of the rear surface of the inner frame 21 in the third direction Z toward the outer frame 22. When the door 20 is in the first position 20A, the upper surface of the inner frame 21 may extend from the upper end of the rear surface of the inner frame 21 in the third direction Z to the front side in the first direction X. The outer frame 21 may be formed to include a substantially flat plate shape. When the door 20 is in the first position 20A, the outer frame 22 may be formed to face the first direction X. The outer frame 22 may be formed in parallel to the rear surface of the inner frame 21. The outer frame 22 may be coupled to a front portion of the upper surface of the inner frame 21 in the first direction X and a front portion of the both side surfaces of the inner frame 21 in the first direction X, respectively.

With this configuration, an inner space I (refer to FIG. 19) may be formed between the outer frame 22 and the inner frame 21 coupled to each other. The inner space I may have various shapes or sizes according to the shape and size of the outer frame 22 and the inner frame 21 or a component arranged and mounted on the door 20.

The outer frame 22 and the inner frame 21 may be formed to have sizes corresponding to each other. However, this does not mean that the outer frame 22 and the inner frame 21 have the same size, and the size of the outer frame 22 and the inner frame 21 may vary depending on the coupling relationship between the outer frame 22 and the inner frame 21, the coupling relationship between the door 20 and the main body 10, and the like.

For example, in a state in which the outer frame 22 is coupled to the inner frame 21, the upper end of the outer frame 22 and the upper end of the inner frame 21 may be provided with little or no step difference. A step difference may be generated between the lower end of the outer frame 22 and the lower end of the inner frame 21, and particularly, a step difference between the lower ends thereof may be greater than a step difference between the upper ends thereof. When the door 20 is in the first position 20A, the lower end of the outer frame 22 may extend further downward in the third direction Z than the lower end of the inner frame 21. When the door 20 is in the first position 20A, the outer frame 22 may extend longer than the inner frame 21 in the third direction Z.

With this configuration, when the door 20 closes the tub 12 at the first position 20A, a rear portion, which is in the first direction X, of the lower portion of the outer frame 22 in the third direction Z may be not covered by the inner frame 21. When the door 20 is in the first position 20A, the inner space I may communicate with the tub 12 through the lower space of the inner frame 21.

The automatic detergent dispenser 1000 may be coupled to the inner frame 21. The inner frame 21 may include an automatic detergent dispenser coupler 21*a* formed to allow the automatic detergent dispenser 1000 to be coupled thereto. Particularly the housing 1100 of the automatic detergent dispenser 1000 may be coupled to the automatic detergent dispenser coupler 21*a*.

When the door 20 is in the first position 20A, the automatic detergent dispenser 1000 coupled to the automatic detergent dispenser coupler 21*a* may be arranged to allow the first housing 1110 to face the front side in the first direction X and to allow the second housing 1120 to face the rear side in the first direction X. In other words, when the door 20 is in the first position 20A, the first housing 1110 may be disposed to face the outer frame 22 and the second housing 1120 may be disposed to face the tub 12. The first housing 1110 and the second housing 1120 may be coupled to each other, and the second housing 1120 may be disposed on a side facing the tub 12 with respect to the first housing 1110.

In response, when the door 20 is in the first position 20A, the storage compartment cover 1140 and the inlet cover 1150 may be disposed to face the rear side in the first direction X. In other words, when the door 20 is in the first position 20A, the storage compartment cover 1140 and the inlet cover 1150 may be disposed to face the tub 12.

The automatic detergent dispenser coupler 21*a* may be formed in an opening shape. Particularly the automatic detergent dispenser coupler 21*a* may include an opening shape penetrating the inner frame 21. The automatic detergent dispenser 1000 may be inserted or pass through the automatic detergent dispenser coupler 21*a* and coupled to the inner frame 21.

The housing 1100 may pass through the opening of the automatic detergent dispenser coupler 21*a* so as to allow at least a portion of the housing 1100 to be disposed in the inner space I. For example, at least a portion of the first housing 1110 may be disposed in the inner space I. In this case, the second housing 1110 may be disposed in a direction toward the tub 12 with respect to the inner frame 21. However, it is not limited thereto, and not only the first housing 1110 but also at least a portion of the second housing 1120 may be disposed in the inner space I. Alternatively, approximately all of the housing 1100 may be disposed in the inner space I.

The opening of the automatic detergent dispenser coupler 21*a* may be arranged along the edge of the housing 1100. The opening of the automatic detergent dispenser coupler 21*a* may be formed to have a size corresponding to the size of the housing 1100.

The automatic detergent dispenser coupler 21*a* may include a first housing fixer 21*b* formed to fix the first housing 1110 to the inner frame 21. For example, the first housing 1110 may be fixed to the first housing fixer 21*b* by the screw fastening or the like.

The automatic detergent dispenser 1000 may include a gasket 1700 provided to seal a gap between the housing 1100 and the automatic detergent dispenser coupler 21*a*. The gasket 1700 may be formed to have an opening shape disposed along the edge of the housing 1100. The gasket 1700 may be configured to prevent wash water, which is discharged from the spray device 40 when the dishwasher 1 is operated, from flowing into the inner space I through a gap between the housing 1100 and the automatic detergent dispenser coupler 21*a*.

The gasket 1700 may seal a gap between the first housing 1110 and the second housing 1120.

However, it is not limited thereto, and the automatic detergent dispenser 1000 may be coupled to the inner frame 21 in various ways. For example, when the door 20 is in the first position 20A, the automatic detergent dispenser 1000 may be disposed in a direction in which the entire housing 1100 faces the tub 12 with respect to the inner frame 21. That is, the entirety of the housing 1100 may be disposed outside the inner space I and coupled to the inner frame 21 so as to be disposed on the rear surface of the inner frame 21.

The detergent box 90 provided to accommodate powdery or liquid detergent may be coupled to the inner frame 21. The inner frame 21 may include a detergent box installation member 21*c* to which the detergent box 90 is coupled. The detergent box installation member 21*c* may be formed to have an opening shape, and at least a portion of the detergent box 90 may be formed to be inserted or pass through the opening of the detergent box installation member 21*c*. That is, at least a portion of the detergent box 90 may be disposed in the inner space I. However, it is not limited thereto, and the detergent box 90 may be coupled to the inner frame 21 in various ways.

The door 20 may be detachably fixed to the main body 10 through a locking device (not shown). For example, the locking device may include a locker (not shown) arranged on at least one of the door 20 and the main body 10 and a latch (not shown) arranged on the other one of the door 20 and the main body 10. The latch may be detachably coupled to the locker. The locker and the latch may be provided at positions corresponding to each other in the door 20 and the main body 10, respectively.

The inner frame 21 may include a locking device installation hole 21*d* formed to penetrate the inner frame 21 to allow a component of the locking device to be installed thereinto. The locking device installation hole 21*d* may be formed in a size and shape corresponding to the locker to allow the locker, which is a component of the locking device, to protrude. The locking device installation hole 21*d* may be formed on the edge of the inner frame 21.

The door 20 may include a hinge bracket 25*a* provided to support the hinge 25. The hinge bracket 25*a* may be coupled to at least one of the inner frame 21 and the outer frame 22. The hinge 25 may be coupled to the hinge bracket 25*a* and coupled to the inner frame 21 or the outer frame 22. The hinge bracket 25*a* may be arranged at a position adjacent to the rotation axis of the main body 10 of the door 20, which is in a lower portion of the door 20 in the third direction Z when the door 20 is in the first position 20A.

FIG. 10 illustrates that the inner frame 21 is integrally formed. However, it is not limited thereto, and the inner frame 21 may be formed by assembling a plurality of components together.

The configuration of the inner frame 21 is not limited to the above, and the inner frame 21 may be configured in various ways so as to form the inner surface of the door 20 and to allow the automatic detergent dispenser 1000 to be coupled thereto.

The configuration of the door 20 described above is only an example of the door of the dishwasher according to the disclosure, and the disclosure is not limited thereto.

Figure 19:
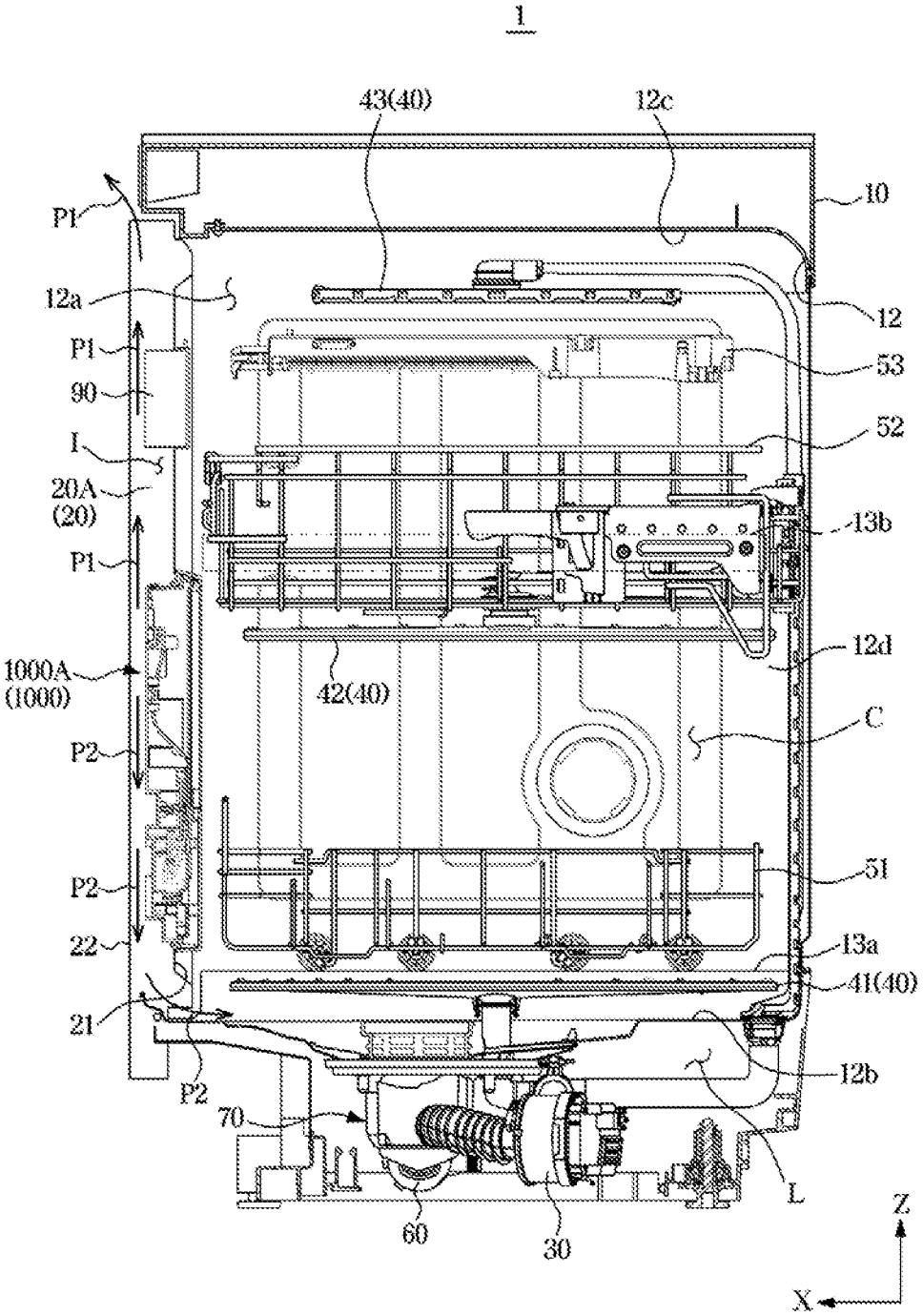
FIG. 19 is a side cross-sectional view of the dishwasher according to an embodiment of the disclosure.

For example, the door 20 may be integrally formed with the inner frame 21 forming the inner surface of the door 20 and the outer frame 22 forming the outer surface of the door 20. Even in this case, the inner space I as shown in FIG. 19 may be formed inside the door 20.

When the inner frame 21 and the outer frame 22 of the door 20 are integrally formed, a part of the door 20 forming the inner surface of the door 20 may be referred to as an inner frame and other part of the door 20 forming the outer surface of the door 20 may be referred to as an outer frame. Based on when the door 20 is in the first position 20A, the inner space I of the door 20 may be provided on the rear side in the first direction X with respect to the outer frame of the door 20, and provided on the front side in the first direction X with respect to the inner frame of the door 20. In other words, the inner space I of the door 20 may be provided between the inner frame and the outer frame of the door 20.

However, in the following description of the dishwasher 1 according to an embodiment of the disclosure, the door 20 will be described based on an assumption that the outer frame 22 and the inner frame 21 are separately formed and coupled to each other.

As illustrated in FIGS. 3 and 4, the automatic detergent dispenser 1000 may include the inlet 1122 provided to communicate with the tub 12 and provided to allow a solid detergent to be input into the tub 12. The inlet 1122 may be provided to face the tub 12 when the door 20 is in the first position 20A. For example, the inlet 1122 may be formed in the second housing 1120.

The automatic detergent dispenser 1000 may include the inlet cover 1150 configured to open and close the inlet 1122. The inlet cover 1150 may be disposed to face the tub 12 when the door 20 closes the tub 12 at the first position 20A.

The inlet cover 1150 may open the inlet 1122 when the solid detergent is input into the tub 12 and close the inlet 1122 before or after the solid detergent is input into the tub 12. For example, the inlet cover 1150 may be rotatably coupled to the second housing 1120.

One of the plurality of solid detergents loaded into the storage compartments 1200 and 1200' may be discharged from the storage compartments 1200 and 1200' by the ejectors 1300 and 1300'. Driving of the ejectors 1300 and 1300' may be controlled by the control device 1900. One solid detergent may be discharged from the storage compartments 1200 and 1200' through the storage compartment outlets 1210 and 1210' and moved to the seating member 1400. The intermediate doors 1250 and 1250' may be opened while one solid detergent is moved to the seating member 1400 through the storage compartment outlets 1210 and 1210'.

One solid detergent moved to the seating member 1400 may be seated in the seating member inner space 1401. One solid detergent seated in the seating member inner space 1401 may be moved toward the inlet 1122 as the seating member door 1410 opens the seating member opening 1420. The seating member door 1410 may be driven by the seating member door driver 1470 to open and close the seating member opening 1420. Driving of the seating member door driver 1470 may be controlled by the control device 1900. A movement of one solid detergent may be guided by the discharge guide 1430 and then moved to the inlet 1122. One solid detergent reaching the inlet 1122 may be moved to the tub 12 as the inlet cover 1150 is opened. For example, the inlet cover 1150 may be opened by being pressed by one solid detergent reaching the inlet 1122.

Through the above-mentioned process, the solid detergent loaded in the storage compartments 1200 and 1200' may be input into the tub 12. The above description is an example of a process in which the solid detergent loaded in the storage compartments 1200 and 1200' is input into the tub 12, but the disclosure is not limited thereto.

On the other hand, as the inlet 1122 facing the tub 12 is opened while the solid detergent is input into the tub 12, the hot and humid air inside the tub 12 may be introduced into the automatic detergent dispenser 1000, particularly, into the inside of the housing 1100, through the inlet 1122.

A plurality of solid detergents may be loaded into the storage compartments 1200 and 1200' formed inside the housing 1100. When hot and humid air is introduced into the housing 1100, the solid detergent may be damaged and the quality of the solid detergent may deteriorate.

Further, various components of the automatic detergent dispenser 1000 may be arranged in the housing 1100. The various components of the automatic detergent dispenser 1000 may include the driver (the driving motor 1320 and the seating member door driver 1470) configured to drive the automatic detergent dispenser 1000 to allow one of the plurality of solid detergents loaded in the storage compartments 1200 and 1200' to be input into the tub 12, and the wire W electrically connecting the driver and the control device 1900. When hot and humid air is introduced into the housing 1100, components of the automatic detergent dispenser 1000 may be damaged, and the lifetime of the automatic detergent dispenser 1000 may be reduced.

Particularly, the process, in which the solid detergent is input into the tub 12, may be performed during the washing operation of the dishwasher 1, and thus the inside of the tub 12 may have a high temperature and high humidity environment due to spraying of wash water. Therefore, the possibility of occurrence of the aforementioned difficulties may be further increased.

To ease the difficulty, the automatic detergent dispenser 1000 may include discharge ducts 1600 and 1600'. The discharge ducts 1600 and 1600' may be provided inside the housing 1100. The discharge ducts 1600 and 1600' may be in communication with the inner space I (refer to FIG. 19) formed between the outer frame 22 and the inner frame 21, and air introduced into the housing 1100 may be discharged into the inner space I.

The discharge ducts 1600 and 1600' may include discharge holes 1610 and 1610' formed to communicate with the inner space I. Based on when the door 20 is in the first position 20A, the discharge holes 1610 and 1610' may be arranged on one side of the discharge ducts 1600 and 1600' that is toward the outer frame 22 along the first direction X. For example, the discharge holes 1610 and 1610' may be formed on one surface, which is at a side toward the outer frame 22, of the first housing 1110.

The automatic detergent dispenser 1000 may include an air flow path P that is from the inlet 1122 to the discharge holes 1610 and 1610'. The air flow path P may be formed between the discharge holes 1610 and 1610' and the inlet 1122.

The discharge ducts 1600 and 1600' may form the air flow path P. Particularly, the air flow path P may be formed in an inner space of the discharge ducts 1600 and 1600'. That is, the discharge ducts 1600 and 1600' may include the air flow path P.

The air flow path P may refer to all flow paths through which air flows from the inlet 1122 toward the discharge holes 1610 and 1610'.

For example, the air flow path P may be formed along a path in which air introduced through the inlet 1122 sequentially flows a space, which is formed at the front or rear of the intermediate housing 1130 in the first direction X, and the discharge ducts 1600 and 1600', and then moves to the discharge holes 1610 and 1610'. The space formed at the front of the intermediate housing 1130 in the first direction X may be a space between the intermediate housing 1130 and the second housing 1120. The space formed at the rear of the intermediate housing 1130 in the first direction X may be a space between the intermediate housing 1130 and the first housing 1110. The space between the intermediate housing 1130 and the first housing 1110 may include the penetration member 1221.

Alternatively, the air flow path P may be formed along a path in which air introduced through the inlet 1122 flows to the lower portion of the storage compartments 1200 and 1200', and sequentially flows a space, which is formed in the lower portion of the left surface 1240 of the first storage compartment 1200 or in the lower portion of the right surface 1230' of the second storage compartment 1200', and the discharge ducts 1600 and 1600', and then moves to the discharge holes 1610 and 1610'.

In addition, the air flow path P may be formed in various ways.

Further, the air flow path P may also refer to a flow path through which air flows from the inlet 1122 toward the storage compartment discharge holes 1200*h* and 1200*h*' to be described later.

The discharge duct 1600 and 1600' may be provided in plurality. For example, the discharge duct 1600 shown on the left side in the second direction Y of FIG. 12 may be referred to as a first discharge duct. The discharge duct 1600' shown on the right side in the second direction Y of FIG. 12 may be referred to as a second discharge duct.

The first discharge duct 1600 may include a first discharge hole 1610 formed to communicate with the inner space I. The second discharge duct 1600' may include a second discharge hole 1610' formed to communicate with the inner space I. The first discharge hole 1610 and the second discharge hole 1610' may be disposed in parallel to each other with respect to the second direction Y, but are not limited thereto.

The discharge ducts 1600 and 1600' may be arranged in the second direction Y, that is, the left and right direction, perpendicular to the third direction Z, which is the vertical direction in which the plurality of solid detergents is stacked, with respect to the storage compartments 1200, and 1200'. For example, the first discharge duct 1600 may be disposed on the left side of the first storage compartment 1200 in the second direction Y, as shown in FIG. 12. For example, as shown in FIG. 12, the second discharge duct 1600' may be disposed on the right side of the second storage compartment 1200' in the second direction Y. The storage compartments 1200 and 1200' may be disposed between the plurality of discharge ducts 1600 and 1600' in the second direction Y.

However, it is not limited thereto, and the arrangement of the discharge ducts 1600 and 1600' is not limited thereto. For example, the discharge ducts 1600 and 1600' may be arranged in a direction in parallel to the third direction Z with respect to the storage compartments 1200 and 1200'.

Alternatively, the discharge ducts 1600 and 1600' may be provided singularly, unlike those shown in FIG. 12.

Hereinafter in describing the automatic detergent dispenser 1000 according to an embodiment of the disclosure, for convenience of description, the first storage compartment 1200, the first discharge duct 1600, and the first discharge hole 1610 may be described in details, and a description thereof will be equally applied to configurations such as the second storage compartment 1200', the second discharge duct 1600', and the second discharge hole 1610'. Accordingly, the first storage compartment 1200, the first discharge duct 1600, and the first discharge hole 1610 may be referred to as the storage compartment 1200, the discharge duct 1600, and the discharge hole 1610, respectively, and an embodiment of the discharge duct and the discharge hole of the automatic detergent dispenser according to the disclosure will be described in detail.

The discharge duct 1600 may be provide to allow air, which is introduced from the tub 12, to be discharged to the vertical direction, that is, in the third direction Z, in which a plurality of solid detergents is stacked inside the storage compartment 1200 when the door 20 is in the first position 20A.

For example, when the door 20 closes the tub 12, the inlet 1122 may be disposed below the discharge duct 1600. When the door 20 closes the tub 12, the discharge hole 1610 may be formed above the discharge duct 1600. When the inlet 1122 is opened, the air introduced into the housing 1100 from the tub 12 may flow from bottom to top with respect to the third direction Z, and then be discharged to the outside of the housing 1100 through the discharge hole 1610. In other words, the air flow path P may be formed from the inlet 1122 toward the discharge hole 1610 in a direction from bottom to top in the third direction Z.

However, it is not limited thereto, and the direction of the air flow path P formed from the inlet 1122 toward the discharge hole 1610 may be formed differently according to the positions of the inlet 1122 and the discharge hole 1610, respectively.

For example, unlike shown in the drawing, the inlet of the housing 1100 may be formed to be positioned above the discharge hole. In this case, the air flowing along the air flow path formed in the discharge duct may flow in a direction from top to bottom in the third direction Z from the inlet toward the discharge hole.

Alternatively, the inlet and discharge hole of the housing 1100 may be arranged side by side in the second direction Y. In this case, the discharge duct may extend along the second direction Y, and the air flowing along the air flow path formed in the discharge duct may flow from the inlet toward the discharge hole along the second direction Y.

The discharge duct 1600 may extend in parallel to the direction in which the plurality of solid detergents is stacked inside the storage compartment 1200. The discharge duct 1600 may extend in parallel to the third direction Z when the door 20 is in the first position 20A.

The discharge duct 1600 may extend in parallel to the long side 1201 of the storage compartment 1200. For example, the discharge duct 1600 may include a long side in parallel to the long side 1201 of the storage compartment 1200.

The discharge hole 1610 may be formed on one side of the discharge duct 1600 in the direction in which the discharge duct 1600 extends. Air introduced from the inlet 1122 may flow from the other side, which is opposite to the one side of the discharge duct 1600 in which the discharge hole 1610 is formed, toward the one side of the discharge duct 1600 in which the discharge hole 1610 is formed. The air flow path P may be formed along a direction from the other side, which is opposite to the one side of the discharge duct 1600 in which the discharge hole 1610 is formed, toward the one side of the discharge duct 1600 in which the discharge hole 1610 is formed.

However, it is not limited thereto, and the direction in which the discharge duct 1600 extends may vary according to the positions of the inlet 1122 and the discharge hole 1610, the internal structure of the housing 1100, and the like. For example, the discharge duct 1600 may be formed to exclude a long side or a short side in a specific direction. For example, the discharge duct 1600 may have a curved shape.

With this configuration, the discharge duct 1600 may communicate with the inner space I of the door 20 through the discharge hole 1610, and the discharge duct 1600 may allow hot and humid air, which flows into the housing 1100 when the inlet 1122 is opened, to be discharged to the inner space I.

However, during the washing operation of the dishwasher 1, the wash water sprayed from the spray device 40 may be sprayed with high water pressure, and thus the wash water may be introduced into the inner space I from the tub 12 through the automatic detergent dispenser coupler 21*a* despite the sealing of the gasket 1700. When the wash water flowing into the inner space I flows into the housing 1100 through the discharge hole 1610, the solid detergent loaded in the storage compartment 1200 may be damaged or reduced in quality. Further, a difficulty such as damage to a component of the automatic detergent dispenser 1000 may occur.

As will be described later, a drain groove 1119 may be provided in the first housing 1110, but as the discharge hole 1610 is open, wash water may be introduced into the housing 1100 through the discharge hole 1610.

The introduction of the wash water may occur not only in a case in which the automatic detergent dispenser 1000 passes through the automatic detergent dispenser coupler 21*a* having the opening shape and then is coupled to the inner frame 21, but also in a case in which the housing 1100 is coupled to the inner frame 21 to allow the entirety of the housing 1100 to be placed outside the inner space I or to be arranged on the rear surface of the inner frame 21.

To ease the difficulty, the automatic detergent dispenser 1000 may further include a discharge hole cover 1113 provided to cover the discharge hole 1610. Particularly, the housing 1100 may further include the discharge hole cover 1113 provided to cover the discharge hole 1610 from the outside of the discharge duct 1600.

The discharge hole cover 1113 may cover at least a portion of the discharge hole 1610 from the outside of the discharge duct 1600. For example, the discharge hole cover 1113 may cover the discharge hole 1610 from the front in the first direction X with respect to the discharge hole 1610. Accordingly, the discharge hole cover 1113 may be provided to prevent wash water from flowing into the housing 1100 through the discharge hole 1610.

The discharge hole cover 1113 may include a cover portion 1113*a* covering the discharge hole 1610. The cover portion 1113*a* may be disposed on the front side of the discharge hole 1610 in the first direction X when the door 20 is in the first position 20A.

The cover portion 1113*a* may be disposed to be spaced apart from the discharge hole 1610. In other words, the cover portion 1113*a* may cover the discharge hole 1610 at a position spaced apart from the discharge hole 1610.

For example, the first housing 1110 may include a cover spacer 1115 protruding forward in the first direction X with respect to the discharge hole 1610. The discharge hole cover 1113 may be disposed in front of the cover spacer 1115 in the first direction X. The discharge hole cover 1113 may be supported by the cover spacer 1115 and may be spaced apart from the discharge hole 1610 in the first direction X by the cover spacer 1115.

The cover portion 1113*a* is spaced apart from the discharge hole 1610 to cover the discharge hole 1610, and thus even when the cover portion 1113*a* covers entire the discharge hole 1610 in the first direction X, the cover portion 1113*a* may not prevent the discharge of the air through the discharge hole 1610.

However, it is not limited thereto, and the cover portion 1113*a* may cover the discharge hole 1610 in a position in close contact without being spaced apart from the discharge hole 1610. In this case, the cover portion 1113*a* may cover a part of the discharge hole 1610 in the first direction X, and air may be discharged from other part of the discharge hole 1610.

The automatic detergent dispenser 1000 may include an air discharge guide 1114 provided to guide air discharged through the discharge hole 1610 to the outside of the discharge hole cover 1113. Particularly, the housing 1100 may include the air discharge guide 1114 and the air discharge guide 1114 may be provided in the first housing 1110. When the flow of air discharged through the discharge hole 1610 is interfered with the discharge hole cover 1113, the air discharge guide 1114 may guide the air to flow to the outside of the discharge hole cover 1113. Accordingly, the air discharged from the discharge hole 1610 may be easily introduced into the inner space I despite of the discharge hole cover 1113.

The air discharge guide 1114 may be inclined downward toward the outer frame 22 when the door 20 closes the tub at the first position 20A. In other words, the air discharge guide 1114 may have a shape inclined downward in the third direction Z as the sir discharge guide 1114 moves forward in the first direction X.

Accordingly, the air discharge guide 1114 may be provided to guide air, which is discharged from the discharge hole 1610, to flow downward in the third direction Z. Air discharged from the discharge hole 1610 may easily flow downward in the third direction Z by gravity. Accordingly, the efficiency of discharging air through the discharge hole 1610 may be improved.

Further, the air discharge guide 1114 is inclined downward toward the outer frame 22, and thus even when the wash water falls on the air discharge guide 1114, the air discharge guide 1114 may guide the water wash to move downward in the third direction Z along the inclination direction of the air discharge guide 1114, and the air discharge guide 1114 may prevent the wash water from flowing into the housing 1100 through the discharge hole 1610.

The first housing 1110 may include a cover support 1114*a* supporting the discharge hole cover 1113. The cover support 1114*a* may be provided on the air discharge guide 1114. For example, the cover support 1114*a* may protrude from the air discharge guide 1114 toward the discharge hole cover 1113.

However, it is not limited thereto, and the air discharge guide 1114 may be provided to have various shapes.

The discharge hole cover 1113 may be coupled to the discharge hole 1610. Particularly, the discharge hole cover 1113 may be detachably coupled to the discharge hole 1610.

For example, the discharge hole cover 1113 may be hooked to the discharge hole 1610. The discharge hole cover 1113 may include a hook 1113*b* hooked to the discharge hole 1610. The hook 1113*b* may extend toward the discharge hole 1610 from the cover portion 1113*a*. A hook structure that is bent so as to be hooked to an edge of the discharge hole 1610 may be provided at an end of the hook 1113*b*.

However, it is not limited thereto, and the discharge hole cover 1113 may be coupled to the discharge hole 1610 by various methods such as the screw fastening. Alternatively, the discharge hole cover 1113 may be provided to be non-separable from the discharge hole 1610. Alternatively, the discharge hole cover 1113 may not be directly coupled to the discharge hole 1610.

The automatic detergent dispenser 1000 may include the driver configured to drive the automatic detergent dispenser 1000 to allow one of the plurality of solid detergents loaded in the storage compartment 1200 to be input into the tub 12. The driver may include the driving motor 1320 of the ejector 1300, the seating member door driver 1470 of the seating member 1400, and the like. The driver may be disposed inside the housing 1100.

The control device 1900 of the automatic detergent dispenser 1000 may be configured to control driving of the driver. The automatic detergent dispenser 1000 may include the wire W electrically connecting the control device 1900 and the driver. The control device 1900 and the driver may be electrically connected to transmit and receive electrical signals to each other.

In addition, the wire W may connect various sensors of the automatic detergent dispenser 1000 and the control device 1900. The control device 1900 may receive electrical signals output from various sensors through the wire W.

Various types of sensors of the automatic detergent dispenser 1000 may include various types of sensors such as a hall sensor and an optical sensor. Various sensors of the automatic detergent dispenser 1000 may be disposed inside the housing 1100.

For example, the automatic detergent dispenser 1000 may include the seating member sensor 1440, and the seating member sensor 1440 may sense whether a solid detergent is seated in the seating member inner space 1401. The wire W may electrically connect the seating member sensor 1440 and the control device 1900 to each other.

For example, the automatic detergent dispenser 1000 may include a sensor module (se) for sensing a driving state of the driver. The wire W may electrically connect the sensor module (se) and the control device 1900.

The wire W may be connected to the driver or the sensor of the automatic detergent dispenser 1000, and thus at least a portion thereof may be disposed inside the housing 1100.

At least a portion of the wire W may be disposed along the discharge duct 1160. The wire W may be disposed along the discharge duct 1160 within a range, which is required by the design to connect the control device 1900 to the driver, according to the arrangement of the control device 1900 or the driver.

As mentioned above, the control device 1900 may be disposed outside the inner space formed by the first housing 1110 and the second housing 1120. The control device 1900 may be disposed on the control device seating member 1111. In this case, it is easy to protect the control device 1900 from moisture of the inner space of the housing 1100, and to effectively prevent damage to the control device 1900.

In other words, the driver or the sensor of the automatic detergent dispenser 1000 may be disposed in the inner side with respect to the discharge hole 1160, and the control device 1900 may be disposed in the outside with respect to the discharge hole 1160.

Accordingly, the wire W may be provided to penetrate the discharge hole 1610.

However, it is not limited thereto, and the wire W may not penetrate the discharge hole 1160. For example, the control device 1900 may be disposed in the inner space formed by the first housing 1110 and the second housing 1120, or the control device 1900 may be disposed inside the discharge duct 1600. In this case, the wire W connecting the control device 1900 to the driver or the sensor may not penetrate the discharge hole 1160.

Alternatively, even when the control device 1900 is disposed outside the inner space formed by the first housing 1110 and the second housing 1120 as shown in FIG. 11, the wire W may penetrate other hole (not shown) other than the discharge hole 1610, and then connect components such as the control device 1900 and the driver.

However, when the wire W is disposed along the discharge duct 1600 and further penetrates the discharge hole 1610 and is connected to the control device 1900, it is possible to more simplify the configuration of the automatic detergent dispenser 1000 such as the housing 1100.

Hereinafter a description will be described on the assumption that the wire W penetrates the discharge hole 1160.

The housing 1100 may include the control device cover 1112 covering the control device 1900. The control device cover 1112 may cover a portion of the wire W together.

Based on when the door 20 is in the first position 20A, the control device cover 1112 may cover the control device 1900 from the front in the first direction X. Based on when the door 20 is in the first position 20A, the control device cover 1112 may cover a portion of the wire W from the front in the first direction X.

The control device cover 1112 may cover the discharge hole 1610. In other words, the control device cover 1112 may cover the discharge hole 1610, the control device 1900, and a portion of the wire W that passes through the discharge hole 1610 and then connected to the control device 1900.

The control device cover 1112 may be integrally provided with the discharge hole cover 1113. Accordingly, all of the above-described characteristics of the discharge hole cover 1113 may be applied to the control device cover 1112.

For example, the control device cover 1112 may include a cover portion spaced apart from the discharge hole 1610 to cover the discharge hole 1610. The cover portion of the control device cover 1112 may be spaced apart from the discharge hole 1610 by the cover spacer 1115 and may cover the discharge hole 1610. The air discharge guide 1114 may be provided to guide the air discharged through the discharge hole 1610 to the outside of the control device cover 1112. The control device cover 1112 may be detachably coupled to the discharge hole 1610, and may be hooked to the discharge hole 1610 by the hook 1113*b*. A description thereof is described above with respect to the discharge hole cover 1113, and thus it will be omitted.

However, it is not limited thereto, and the control device cover 1112 may be provided separately from the discharge hole cover 1113.

For example, the control device cover 1112 may cover the control device 1900 or a portion of the wire W connected to the control device 1900 and adjacent to the control device 1900, but may not cover the discharge hole 1610. The discharge hole 1610 may be covered by the discharge hole cover 1113 that is separated from the control device cover 1112. In this case, a part of the wire W disposed between the control device cover 1112 and the discharge hole cover 1113 may be exposed to the outside. Alternatively, a separate cover provided to connect the control device cover 1112 and the discharge hole cover 1113 may be disposed between the control device cover 1112 and the discharge hole cover 1113, and thus a portion of the wire W arranged between the control device cover 1112 and the discharge hole cover 1113 may be covered together.

The wire W may be guided by a plurality of wire guides 1160*a*, 1160*b*, and 1160*c*.

A first wire guide 1160*a* may guide a portion of the wire W disposed between the discharge hole 1610 and the driver or sensor. The first wire guide 1160*a* may be disposed in the inner space formed by the first housing 1110 and the second housing 1120 to guide a portion of the wire W. For example, at least a portion of the first wire guide 1160*a* may be provided inside the discharge duct 1600. For example, at least a portion of the first wire guide 1160*a* may be provided in the intermediate housing 1130.

A second wire guide 1160*b* may guide a portion of the wire W disposed between the discharge hole 1610 and the control device 1900. For example, the second wire guide 1160*b* may be covered by the control device cover 1112.

A third wire guide 1160*c* may be a part of the wire W connected to the control device 1900, and may guide a part of the wire W disposed outside the control device cover 1112. For example, the third wire guide 1160*c* may guide a portion of the wire W provided to electrically connect the main control device (not shown) of the dishwasher 1 and the control device 1900 of the automatic detergent dispenser 1000.

However, the wire guides 1160*a*, 1160*b*, and 1160*c* described above are only examples of a configuration for guiding or supporting the wire W, and the disclosure is not limited thereto.

For example, unlike the description above, the wire W may be configured to electrically connect some of components such as the driver, the sensor, the control device 1900 of the automatic detergent dispenser 1000, or the main control device of the dishwasher 1.

Further, components such as the driver, the sensor, the control device 1900 of the automatic detergent dispenser 1000 described above, or the main control device of the dishwasher 1 may not be electrically connected to each other by wires, but may be configured to transmit and receive signals to each other through a wireless communication. That is, the wire W shown in FIGS. 10 to 14 may not be provided in the automatic detergent dispenser 1000 of the dishwasher 1.

Air which is introduced into the housing 1100 from the tub 12 when the inlet 1122 is opened, may be discharged to the outside of the housing 1100 through the storage compartment discharge holes 1200*h* and 1200*h*' that are formed separately from the discharge holes 1600 and 1600'.

The storage compartments 1200 and 1200' may include the storage compartment discharge holes 1200*h* and 1200*h*' formed to communicate with the inner space I of the door 20. The storage compartment discharge holes 1200*h* and 1200*h*' may include a first storage compartment discharge hole 1200*h* formed in the first storage compartment 1200 and a second storage compartment discharge hole 1200*h*' formed in the second storage compartment 1200'.

Hereinafter for convenience of description, the first storage compartment discharge hole 1200*h* will be described in detail, but the following description may be equally applied to the second storage compartment discharge hole 1200*h*'. Hereinafter the first storage compartment discharge hole 1200*h* will be referred to as the storage compartment discharge hole 1200*h*.

Based on when the door 20 is in the first position 20A, the storage compartment discharge hole 1200*h* may be located on one side of the storage compartment 1200 in the direction toward the outer frame 22 along the first direction X. For example, the storage compartment discharge hole 1200*h* may be formed on one surface, which is at a side toward the outer frame 22, of the storage compartment 1200.

The storage compartment discharge hole 1200*h* may be formed on one side of the storage compartment 1200 in a direction in which a plurality of solid detergents is stacked. In other words, the storage compartment discharge hole 1200*h* may be formed on one side of the storage compartment 1200 in the third direction Z when the door 20 is in the first position 20A.

An air flow path P disposed between the inlet 1122 and the storage compartment discharge hole 1200*h* may be formed inside the housing 1100. That is, the automatic detergent dispenser 1000 may include the air flow path P formed from the inlet 1122 toward the storage compartment discharge hole 1200*h*.

In FIG. 10, the storage compartment discharge hole 1200*h* is provided in plurality, that is three storage compartment discharge holes 1200*h* are provided, but the number of the storage compartment discharge holes 1200*h* is not limited thereto.

Because the storage compartment discharge hole 1200*h* is provided separately from the discharge hole 1610, the air inside the housing 1100 may be more easily discharged. Further, air introduced into the storage compartment 1200 may be directly discharged through the storage compartment discharge hole 1200*h*, and thus it is possible to efficiently prevent damage and quality deterioration of the solid detergent loaded in the storage compartment 1200.

However, it is not limited thereto, and unlike the embodiments shown in FIGS. 10 to 14, the automatic detergent dispenser 1000 may include the storage compartment discharge holes 1200*h* and 1200*h*', but not include the discharge holes 1610 and 1610' which are formed separately from the storage compartment discharge holes 1200*h* and 1200*h*'. In this case, the storage compartment discharge holes 1200*h* and 1200*h*' may perform the function of the discharge holes 1610 and 1610' according to the above-described embodiment. Similarly, the storage compartments 1200 and 1200' may perform the functions of the discharge ducts 1600 and 1600' according to the above-described embodiment. Accordingly, the storage compartment discharge holes 1200*h* and 1200*h*' according to an embodiment may include a configuration corresponding to the configuration of the discharge holes 1610 and 1610' according to the above-described embodiment. For example, the storage compartment discharge holes 1200*h* and 1200*h*' may be covered by the discharge hole cover. For example, the flow of air discharged from the storage compartment discharge holes 1200*h* and 1200' may be guided by the discharge guide. For example, the storage compartment discharge holes 1200*h* and 1200*h*' may be provided to allow the wire W to pass therethrough.

However, when the discharge ducts 1600 and 1600' and the discharge holes 1610 and 1610' are formed separately from the storage compartments 1200 and 1200' and the storage compartment discharge holes 1200*h* and 1200*h*' as in the embodiment shown in FIGS. 10 to 14, it is possible to guide at least a portion of air, which is introduced into the inlet 1122, toward the discharge ducts 1600 and 1600'. Accordingly, it is possible to more effectively prevent damage and quality degradation of the solid detergent loaded into the storage compartments 1200 and 1200'.

With the above configuration, in the dishwasher 1 according to the embodiment of the disclosure, hot and humid air, which is introduced from the tub 12 into the automatic detergent dispenser 1000 when the inlet 1122 is opened, may be discharged to the outside of the automatic detergent dispenser 1000 and may flow to the inner space I formed between the inner frame 21 and the outer frame 22 of the door 20.

Figure 15:
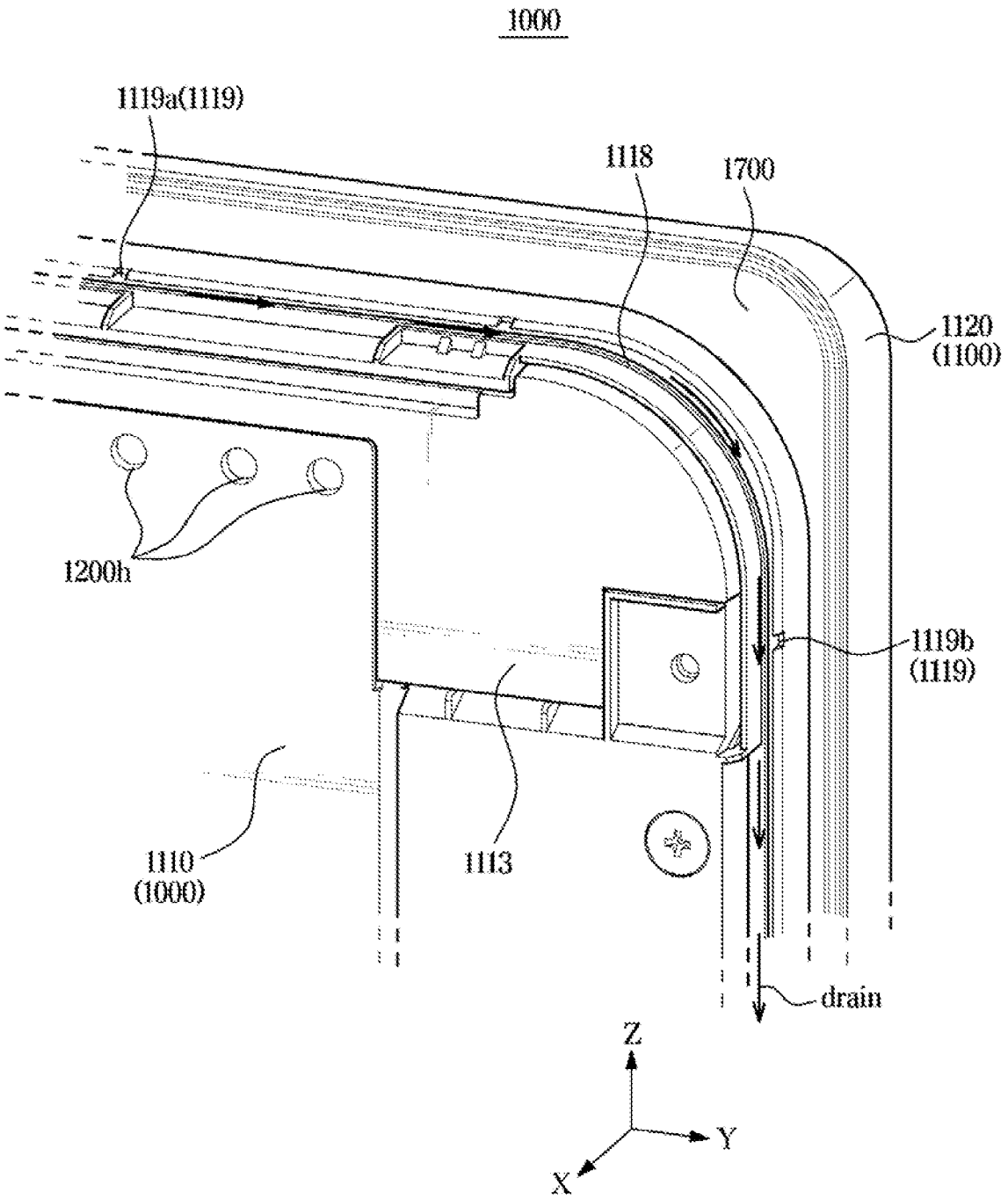
FIG. 15 is an enlarged view illustrating some components of the automatic detergent dispenser of the dishwasher according to an embodiment of the disclosure.
Figure 16:
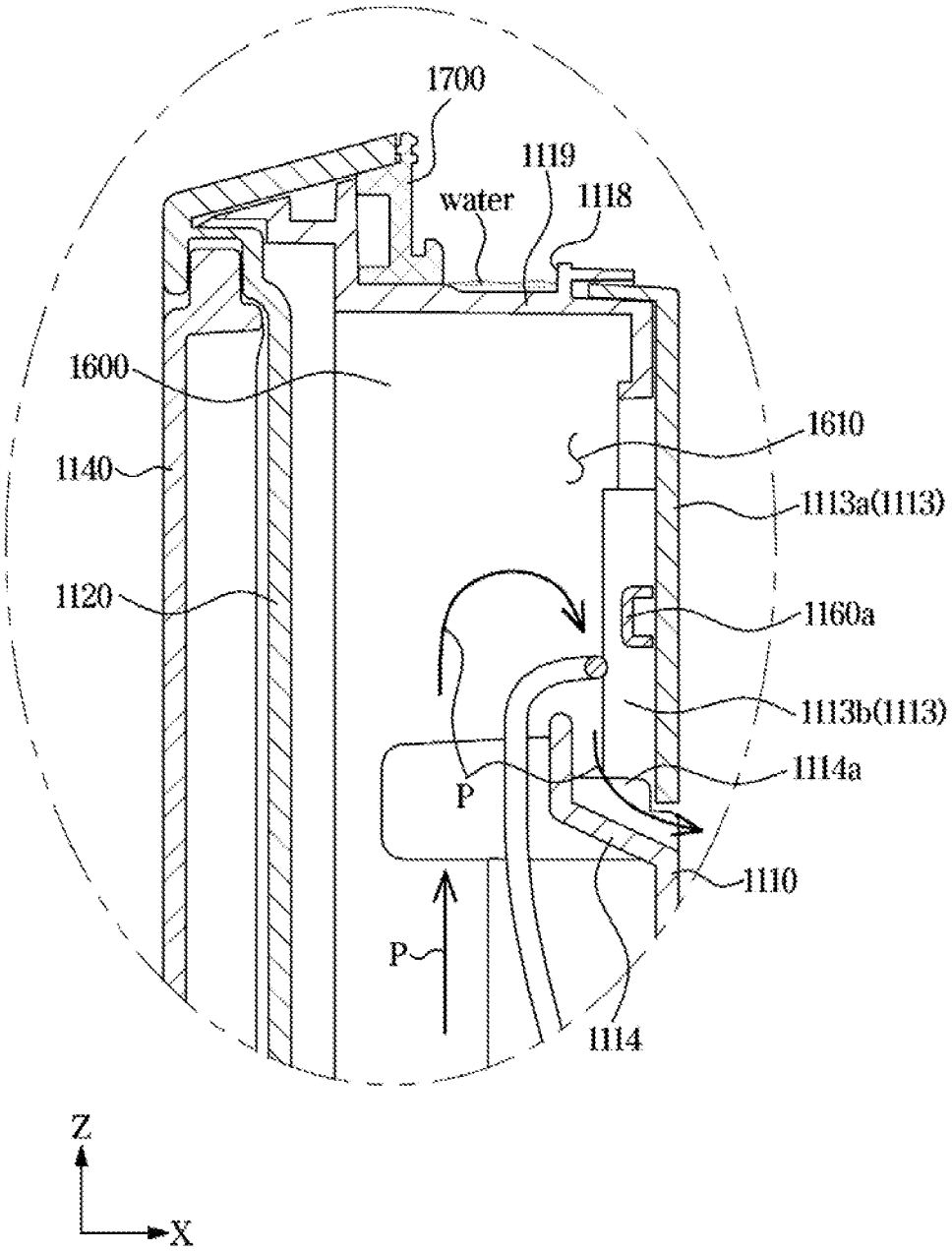
FIG. 16 is a view illustrating a state in which water is collected in a drain groove in the automatic detergent dispenser of the dishwasher according to an embodiment of the disclosure.

FIG. 15 is an enlarged view illustrating some components of the automatic detergent dispenser of the dishwasher according to an embodiment, and FIG. 16 is a view illustrating a state in which water (wash water, etc.) is collected in a drain groove in the automatic detergent dispenser of the dishwasher according to an embodiment.

Wash water discharged from the spray device 40 during the operation of the dishwasher 1 may have high water pressure. Accordingly, although the gasket 1700 seals the gap between the housing 1100 and the automatic detergent dispenser coupler 21*a*, the wash water may be introduced from the tub 12 into the inner space I (refer to FIG. 19) through the gap between the housing 1100 and the automatic detergent dispenser coupler 21*a*.

The wash water introduced into the inner space I of the door 20 may be introduced into the inside of the housing 1100 through the discharge holes 1610 and 1610' or the storage compartment discharge holes 1200*h* and 1200*h*'. The wash water introduced into the housing 1100 may damage components inside the housing 1100 or damage the solid detergent loaded in the storage compartment 1200. Further, the wash water introduced into the inner space I of the door 20 may flow into electronic components such as the control device 1900 and cause damage to the electronic components.

Although the control device cover 1112 covers the control device 1900 in the first direction X and the discharge hole cover 1113 covers the discharge hole 1610 in the first direction X, there is still the above-mentioned difficulty when the introduced wash water is not sufficiently drained.

On the other hand, unlike the above, it may be assumed that the discharge holes 1610 and 1610' or the storage compartment discharge holes **1200*h* and 1200*h*' are not formed in the housing 1100 and thus there is little or no risk in that water, which is introduced into the inner space I of the door 20, is introduced into the inside of the housing 1100. Further, it may be assumed that the control device 1900 is disposed in a space completely separated from the inner space I of the door 20 and thus there is little or no risk in that water, which is introduced into the inner space I of the door 20, is introduced into the control device 1900. Even in this case, when the door 20 is rotated from the first position 20A to the second position 20B in a state in which water remains on the outer surface of a part of the housing 1100 disposed on the inner space I, the water remaining on the outer surface of the housing 1100 may flow into electronic components such as the main control device disposed inside the door 20**.

To ease the difficulty, referring to FIGS. 15 and 16, the housing 1100 of the automatic detergent dispenser 1000 may include the drain groove 1119 provided to drain water, which is introduced from the tub 12, from the housing 1100 to the lower side of the door 20 when the door 20 is closed. In other words, the drain groove 1119 may guide water introduced from the tub 12 to flow to the lower side of the door 20.

The drain groove 1119 may be formed on the outer surface of the housing 1100. At least a portion of the wash water reaching the outer surface of the housing 1100 may be collected in the drain groove 1119 and drained along the drain groove 1119. That is, the drain groove 1119 may be provided to allow water, which is introduced from the tub 12, to be collected on the outer surface of the housing 1100 and to be drained along the outer surface of the housing 1100.

The drain groove 1119 may be formed to have a concave shape. Particularly, the drain groove 1119 may be formed to have a shape concavely recessed from the outer surface of the housing 1100. Water introduced from the tub 12 may be collected in the concave shape of the drain groove 1119. Water collected in the drain groove 1119 may flow along the concave shape of the drain groove 1119 and may be drained to the lower side of the door 20 along the concave shape of the drain groove 1119.

The meaning that the drain groove 1119 has a concave shape does not mean that the outer surface of the drain groove 1119 should be formed to be recessed in comparison with the entire outer surface of other parts of the housing 1100 or at least most of the housing 1100. That is, the meaning that the drain groove 1119 has a concave shape is not limited to the meaning that the drain groove 1119 should have a characteristic such as having the deepest depth or the lowest height among the outer surface of the housing 1100. The meaning that the drain groove 1119 has a concave shape may include a case in which the drain groove 1119 has a concave shape in comparison with a part of its periphery, and furthermore, at least a part of an inner side of an edge of the concave shape is recessed in comparison with the edge of the concave shape.

The drain groove 1119 may include a shape in which an outer side thereof is open. Accordingly, water may easily flow into the drain groove 1119. In addition, when the outer side of the drain groove 1119 is open, a structure thereof may be simple and the manufacturing cost may be reduced in comparison with a case in which the outer side of the drain groove 1119 is covered.

The drain groove 1119 may be disposed in the inner space I. The drain groove 1119 disposed in the inner space I may collect water flowing into the inner space I from the tub 12, and the collected water may be drained to the lower side of the inner space I along the drain groove 1119.

The drain groove 1119 may be provided in a part of the housing 1100 disposed in the inner space I. For example, as shown in FIGS. 15 and 16, the drain groove 1119 may be provided in the first housing 1110.

When the door 20 closes the tub 12, the drain groove 1119 may be provided to drain water, which is introduced from the tub 12, to the lower side of the inner space I, and the lower side of the inner space I may communicate with the lower portion of the tub 12. Therefore, the water collected in the drain groove 1119 may flow to the lower side of the inner space I along the drain groove 1119, and the water reaching the lower side of the inner space I may flow through the lower portion of the tub 12. Accordingly, water flowing from the tub 12 to the drain groove 1119 may return to the tub 12 again.

The drain groove 1119 may be disposed in a direction toward the outer surface of the door 20 with respect to the gasket 1700. In other words, the drain groove 1119 may be disposed in a direction toward the outer frame 22 with respect to the gasket 1700. In other words, the drain groove 1119 may be disposed to face the front side in the first direction X with respect to the gasket 1700.

Although the gasket 1700 covers the gap between the automatic detergent dispenser coupler **21*a* and the housing 1100, the high-pressure wash water may pass through the gap and the gasket 1700. As described above, the drain groove 1119 is disposed toward the outer surface of the door 20 with respect to the gasket 1700, and thus the drain groove 1119 may collect wash water passing through the gasket 1700**.

However, the arrangement of the drain groove 1119 is not limited thereto, and the drain groove 1119 may be disposed in various positions.

For example, the drain groove 1119 may be disposed in a direction toward the tub 12 with respect to the door 20 when the door 20 is in the first position 20A. That is, the drain groove 1119 may be disposed outside the inner space I of the door 20. In this case, the drain groove 1119 may be disposed in a direction toward the tub 12 with respect to the gasket 1700, that is, a direction toward the rear in the first direction X.

However, hereinafter for convenience of description, it is assumed that the drain groove 1119 is disposed in the inner space I.

The drain groove 1119 may be formed along at least a portion of an outer edge of the housing 1100. Particularly, the drain groove 1119 may be formed along at least a portion of an outer edge of the first housing 1110.

As described in FIGS. 10 to 16, the discharge holes 1610 and 1610' or the storage compartment discharge holes **1200*h* and 1200*h*' may be formed on the front surface of the housing 1100 in the first direction X. Further, as described in FIGS. 10 to 16, the control device seating member 1111 on which the control device 1900 is seated may be provided on the front surface of the first housing 1110 in the first direction X. In this case, when the drain groove 1119 is disposed on the outer edge of the first housing 1110, the drain groove 1119 may avoid the discharge holes 1610 and 1610', the storage compartment discharge holes 1200***h* and 1200*h'*, or the control device 1900. Accordingly, the drain groove 1119 may more effectively prevent the collected water from flowing into the discharge holes 1610 and 1610', the storage compartment discharge holes 1200*h* and 1200*h'*, or the control device 1900.

In addition, the outer edge of the housing 1100 may be provided in parallel to the automatic detergent dispenser coupler 21*a* as shown in FIG. 10. Therefore, when the drain groove 1119 is provided on the outer edge of the housing 1100, the water, which is introduced from the tub 12 through the gap between the automatic detergent dispenser coupler 21*a* and the housing 1100, may be collected to the drain groove 1119, more efficiently.

The drain groove 1119 may be provided along an upper edge disposed on an upper surface of the housing 1100 in the third direction Z. That is, at least a portion of the drain groove 1119 may be provided on an upper portion of the outer edge of the housing 1100. A portion of the drain groove 1119 provided on the upper edge of the housing 1100 may be referred to as a first member 1119*a*. The first member 1119*a* may be disposed on the upper surface of the first housing 1110 in the third direction Z.

The first member 1119*a* may extend along the second direction Y. That is, the first member 1119*a* may extend along the left and right direction of the first housing 1110 in the second direction Y.

The drain groove 1119 may be provided along at least one of a left edge disposed on the left surface of the housing 1100 and a right edge disposed on the right surface of the housing 1100 with respect to the second direction Y. That is, at least a portion of the drain groove 1119 may be provided on at least one of the left side of the outer edge of the housing 1100 or the right side of the outer edge of the housing 1100. A portion of the drain groove 1119 provided on the left or right edge of the housing 1100 may be referred to as a second member 1119*b*. The second member 1119*b* may be disposed on the left surface or the right surface of the first housing 1110 with respect to the second direction Y.

At least a portion of the drain groove 1119 may extend along the vertical direction of the housing 1100 when the door 20 closes the tub 12. Accordingly, when the door 20 closes the tub 12, the water introduced into the drain groove 1119 may be drained to the lower side of the door 20.

Particularly, as in the embodiment shown in FIG. 15, the second member 1119*b* may extend along the vertical direction of the housing 1100 in the third direction Z.

The drain groove 1119 may be provided along only a part of the outer edge of the housing 1100.

For example, the drain groove 1119 may be provided along the upper edge, the left edge, and the right edge of the housing 1100. The drain groove 1119 may not be provided on the lower edge disposed on the lower surface of the housing 1100 in the third direction Z.

The drain groove 1119 may be provided to allow water to be collected in each of the first member 1119*a* or the second member 1119*b*. The collected water may be drained downward in the third direction Z by flowing along the first member 1119*a* and the second member 1119*b*. Even when the drain groove 1119 is not provided on the lower edge of the housing 1100, water reaching the lower end of the second member 1119*b* in the third direction Z may be discharged from the drain groove 1119.

For example, the drain groove 1119 may extend from the second member 1119*b* to a portion of the lower edge of the housing 1100.

For example, the drain groove 1119 may be provided along only a part of the upper edge of the housing 1100. For example, the drain groove 1119 may be provided along only a part of the left edge of the housing 1100. For example, the drain groove 1119 may be provided along only a part of the right edge of the housing 1100.

For example, the drain groove 1119 may be provided along the entire outer edge of the housing 1100. In other words, the drain groove 1119 may be provided along all of the upper and lower edges and the left and right edges of the housing 1100.

The drain groove 1119 may be disposed along at least a part of the opening of the automatic detergent dispenser coupler 21*a*. The drain groove 1119 may be formed in parallel to at least a part of the opening of the automatic detergent dispenser coupler 21*a*.

The drain groove 1119 may be disposed along at least a portion of the gasket 1700. The drain groove 1119 may be formed in parallel to at least a portion of the gasket 1700.

At least a portion of the drain groove 1119 may include a curved shape. The curved shape of the drain groove 1119 may be formed in such a way that a slope gently changes along the outer edge of the housing 1100.

For example, a portion connecting the first member 1119*a* and the second member 1119*b* of the drain groove 1119 may be formed in a curved shape. Accordingly, water discharged from the first member 1119*a* toward the second member 1119*b* may gently flow along the curved surface.

The housing 1100 may include a housing rib 1118. The housing rib 1118 may be disposed along the drain groove 1119. The housing rib 1118 may include a protruding shape.

The housing rib 1118 may be provided to prevent water collected in the drain groove 1119 from being discharged to the outside of the drain groove 1119 before reaching the lower side of the door 20. For example, as shown in FIGS. 15 and 16, the housing rib 1118 may be provided to prevent water collected in the drain groove 1119 from being discharged from the drain groove 1119 in the first direction X.

For example, the housing rib 1118 may be disposed in a direction toward the outer surface of the door 20 relative to the drain groove 1119. In other words, the housing rib 1118 may be disposed in a direction toward the outer frame 22 relative to the drain groove 1119. That is, the housing rib 1118 may be disposed forward of the drain groove 1119 in the first direction X.

In this case, the housing rib 1118 may be provided to prevent water collected in the drain groove 1119 from being discharged from the drain groove 1119 toward the outer surface of the door 20. That is, the housing rib 1118 may be provided to prevent water collected in the drain groove 1119 from being discharged forward from the drain groove 1119 in the first direction X. Accordingly, the housing rib 1118 may effectively prevent that water collected in the drain groove 1119 is discharged in the first direction X and flows into the discharge holes 1610 and 1610', the storage compartment discharge holes 1200*h* and 1200*h'*, and the control device 1900.

The housing rib 1118 may be formed to protrude beyond the edge portion of the drain groove 1119. For example, the housing rib 1118 may be formed to protrude beyond the rear edge portion of the drain groove 1119 in the first direction X.

The housing rib 1118 may be disposed to correspond to the drain groove 1119.

For example, the housing rib 1118 may be disposed in the inner space I. The housing rib 1118 may be provided on a part of the housing 1100 disposed in the inner space I. For example, as shown in FIGS. 15 and 16, the housing rib 1118 may be provided in the first housing 1110.

The housing rib 1118 may be disposed in a direction toward the outer surface of the door 20 with respect to the gasket 1700. In other words, the housing rib 1118 may be disposed to face the front side in the first direction X with respect to the gasket 1700.

The housing rib 1118 may be formed along at least a portion of the outer edge of the housing 1100. Particularly, the housing rib 1118 may be formed along at least a portion of the outer edge of the first housing 1110.

The housing rib 1118 may be provided along the upper edge of the housing 1100. That is, at least a portion of the housing rib 1118 may be provided above the outer edge of the housing 1100.

The housing rib 1118 may be provided along at least one of the left edge disposed on the left surface or the right edge disposed on the right surface of the housing 1100 in the second direction Y. That is, at least a portion of the drain groove 1119 may be provided on at least one of the left side of the outer edge of the housing 1100 or the right side of the outer edge of the housing 1100.

At least a portion of the housing rib 1118 may extend along the vertical direction of the housing 1100 when the door 20 closes the tub 12.

The housing rib 1118 may be provided along only a part of the outer edge of the housing 1100.

For example, the housing rib 1118 may be provided along the upper edge, the left edge, and the right edge of the housing 1100. The housing rib 1118 may not be provided on the lower edge of the housing 1100.

For example, the housing rib 1118 may be provided along only a part of the upper edge of the housing 1100. For example, the housing rib 1118 may be provided along only a part of the left edge of the housing 1100. For example, the housing rib 1118 may be provided along only a part of the right edge of the housing 1100.

For example, the housing rib 1118 may be provided along the entire outer edge of the housing 1100. In other words, the housing rib 1118 may be provided along all of the upper and lower edges and the left and right edges of the housing 1100.

The housing rib 1118 may be disposed along at least a part of the opening of the automatic detergent dispenser coupler 21*a*. The housing rib 1118 may be formed in parallel to at least a part of the opening of the automatic detergent dispenser coupler 21*a*.

The housing rib 1118 may be disposed along at least a portion of gasket 1700. The housing rib 1118 may be formed in parallel to at least a portion of the gasket 1700.

The drain groove 1119 may be formed between the gasket 1700 and the housing rib 1118. The drain groove 1119 may be provided on the front side of the gasket 1700 in the first direction X, and may be provided on the rear side of the housing rib 1118 in the first direction X. In other words, the water introduced from the tub 12 may be collected between the gasket 1700 and the housing rib 1118, and the collected water may be drained to the lower side of the door 20 by flowing along the gasket 1700 and the housing rib 1118.

However, it is not limited thereto, and the housing rib 1118 may be provided to include various configurations according to configurations such as the shape and arrangement of the drain groove 1119.

Figure 17:
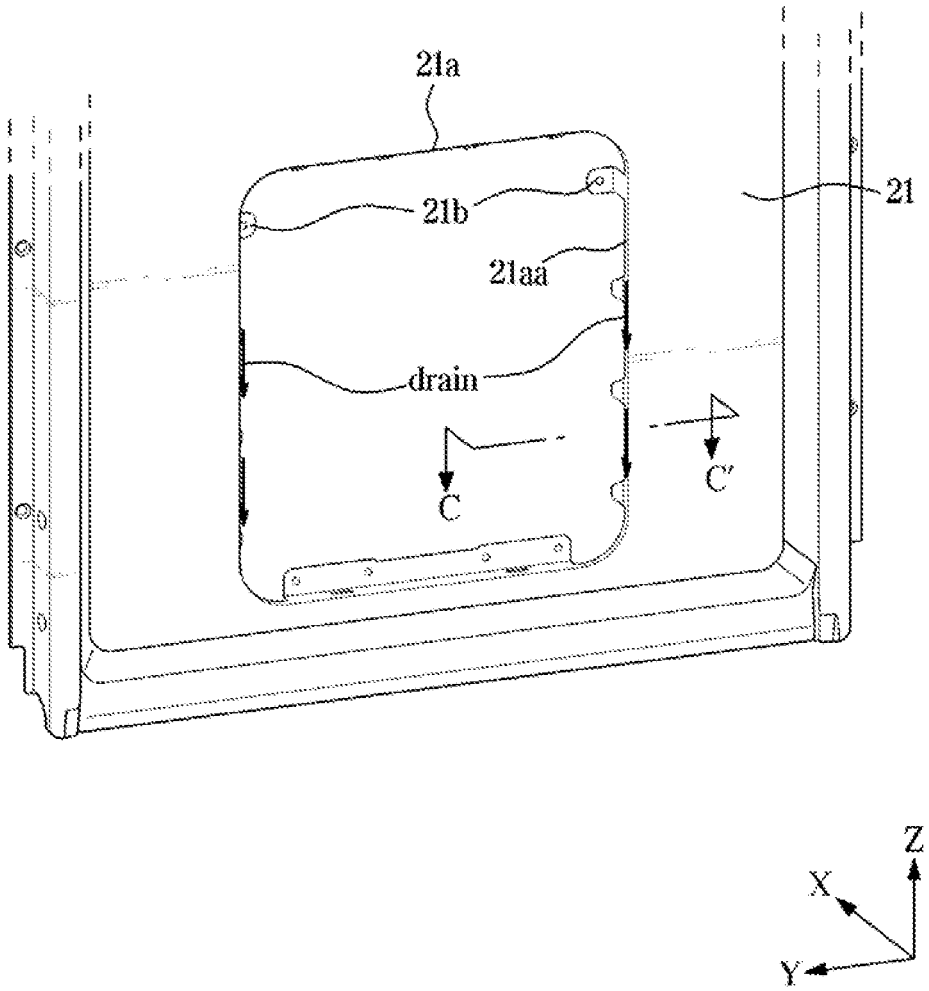
FIG. 17 is a view illustrating a state in which the automatic detergent dispenser is separated from an inner frame of the dishwasher according to an embodiment of the disclosure.
Figure 18:
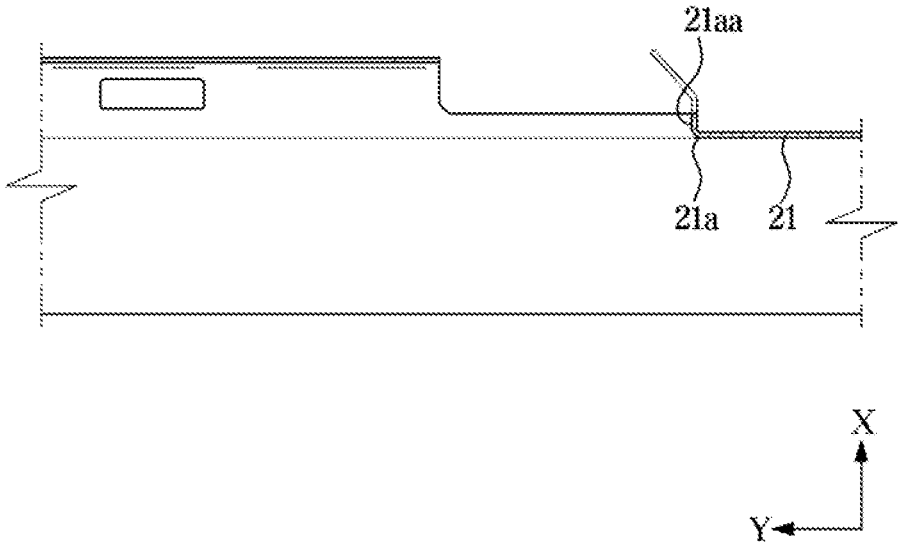
FIG. 18 is an enlarged cross-sectional view taken along a line C-C' of FIG. 17.

FIG. 17 is a view illustrating a state in which the automatic detergent dispenser is separated from an inner frame of the dishwasher according to an embodiment, and FIG. 18 is an enlarged cross-sectional view taken along a line C-C' of FIG. 17.

Referring to FIGS. 17 and 18, the door 20 may include the inner frame 21 including the opening. The inner frame 21 may include the automatic detergent dispenser coupler 21*a* having an opening shape. The opening of the automatic detergent dispenser coupler 21*a* may be formed to penetrate the inner frame 21 in the first direction X.

The housing 1100 of the automatic detergent dispenser 1000 may pass through the opening of the automatic detergent dispenser coupler 21*a* and be coupled to the inner frame 21. Particularly, the housing 1100 may pass through the inner frame 21 through the opening. At least a portion of the housing 1100 may be disposed in the inner space I of the door 20, and at least another portion of the housing 1100 may be placed on the side of the tub 12.

The automatic detergent dispenser coupler 21*a* may further include a bending member 21*aa* that is bent and extends from the edge of the opening to the outer frame 22. The bending member 21*aa* may be bent from the edge of the opening of the automatic detergent dispenser coupler 21*a* and extend forward in the first direction X. The bending member 21*aa* may be provided along the edge of the opening of the automatic detergent dispenser coupler 21*a*.

For example, the bending member 21*aa* may be formed by the press working which presses and bends an edge portion of the opening of the automatic detergent dispenser coupler 21*a*. However, it is not limited thereto, and the bending member 21*aa* may be formed by various manufacturing methods.

As the bending member 21*aa* is provided in the automatic detergent dispenser coupler 21*a*, a contact area between the automatic detergent dispenser coupler 21*a* and the automatic detergent dispenser 1000 may increase. Particularly, the contact area between the automatic detergent dispenser coupler 21*a* and the automatic detergent dispenser 1000 may increase along the first direction X by the bending member 21*aa*.

When the door 20 is in the first position 20A, the bending member 21*aa* may be provided to allow water, which is introduced from the tub 12 to the opening of the automatic detergent dispenser coupler 21*a*, to be drained to the lower side of the door 20. In other words, the bending member 21*aa* may be provided to allow water, which is introduced from the tub 12 into the opening of the automatic detergent dispenser coupler 21*a*, to be drained downward along the bending member 21*aa*.

Particularly, the bending member 21*aa* may form a surface extending in the first direction X from the edge of the opening of the automatic detergent dispenser coupler 21*a*, and water, which is introduced from the tub 12 to the opening, may be drained downward along the surface of the bending member 21*aa*.

The drain groove 1119 may be disposed in a direction toward the outer frame 22 with respect to the bending member 21*aa*. The drain groove 1119 may be disposed on the front side in the first direction X with respect to the bending member 21*aa*. Water introduced into the inner space I without being drained by the bending member 21*aa* may be drained by the drain groove 1119.

The drain groove 1119 may be provided in the housing 1100 of the automatic detergent dispenser 1000, and further the bending member 21*aa* may be provided in the automatic detergent dispenser coupler 21*a*. Accordingly, it is possible to efficiently drain water that is introduced from the tub 12.

FIG. 19 is a side cross-sectional view of the dishwasher according to an embodiment.

Referring to FIG. 19, air introduced into the inner space I formed between the inner frame 21 and the outer frame 22 through the discharge hole 1610 may be discharged to the outside of the door 20.

For example, the air flow path formed to discharge air from the inner space I to the outside of the door 20 may include an upper flow path P1 through which air flows upward with respect to the third direction Z of the door 20 based on when the door 20 is in the first position 20A. The upper flow path P1 may be formed to face a gap formed in the upper portion of the door 20 from the inner space I, for example, a gap formed in the locking device installation hole 21*d*. At least portion of the air in the inner space I may be discharged to the outside of the upper side of the door 20 through the upper flow path P1.

For example, the air flow path formed to discharge air from the inner space I to the outside of the door 20 may include a lower flow path P2 through which air flows downward with respect to the third direction Z of the door 20 based on when the door 20 is in the first position 20A. As described above, the inner space I may be in communication with the tub 12 when the door 20 is in the first position 20A, and the lower flow path P2 may be formed to face the lower portion of the tub 12 from the inner space I. At least portion of the air in the inner space I may be introduced into the lower portion of the tub 12 through the lower flow path P2.

In addition to the air flow paths P1 and P2 shown in FIG. 19, the air of the inner space I may be discharged to the outside of the door 20 along various flow paths through the gap formed in the outer frame 22 or the inner frame 21 or the gap formed between the outer frame 22 and the inner frame 21.

Referring to FIG. 19, the water discharged to the lower side of the door 20 along the drain groove 1119 may flow into the lower side of the tub 12 communicating with the lower side of the inner space I, and return to the tub 12.

For example, the water discharged from the housing 1100 to the lower side of the door 20 along the drain groove 1119 may flow in parallel to the lower air flow path P2, and then be discharged into the inner space I of the door 20.

Figure 20:
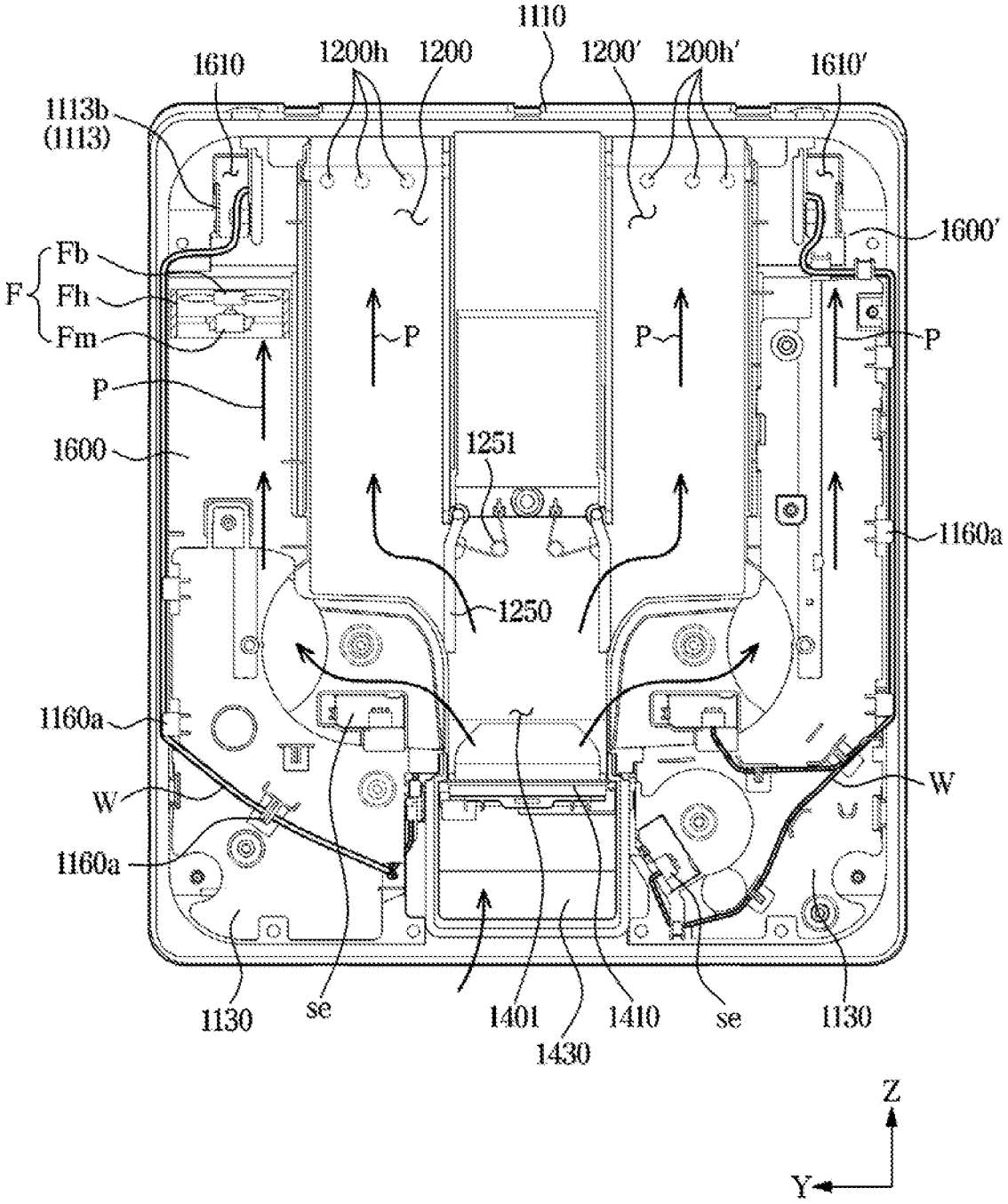
FIG. 20 is a view illustrating a state in which some components of an automatic detergent dispenser of a dishwasher according to an embodiment of the disclosure are removed.

FIG. 20 is a view illustrating a state in which some components of an automatic detergent dispenser of a dishwasher according to an embodiment are removed.

The automatic detergent dispenser according to an embodiment of the disclosure will be described with reference to FIG. 20. In describing the embodiment shown in FIG. 20, the same reference numerals are given to the same components as those shown in FIGS. 1 to 19, and a description thereof may be omitted.

Referring to FIG. 20, the automatic detergent dispenser 1000 may further include a blowing fan F provided inside the housing 1100.

The blowing fan F may include a fan motor Fm configured to generate a rotational force, a fan blade Fb connected to the fan motor Fm and configured to be rotated, and a fan housing Fh provided to support the fan motor Fm and the fan blade Fb.

The blowing fan F may be provided inside the discharge duct 1600. The blowing fan F may be disposed on the air flow path P. For example, the fan housing Fh of the blowing fan F may be supported on the inner wall of the discharge duct 1600.

As the fan blade Fb is rotated, the blowing fan F may generate an air pressure difference between an upstream and a downstream of the air flow path P with respect to the blowing fan F. Flow efficiency of the air flowing along the air flow path P may be improved due to the air pressure difference generated by the blowing fan F. For example, the blowing fan F may improve flow efficiency of air flowing from the inlet 1122 toward the discharge hole 1610.

As the blowing fan F is disposed inside the discharge ducts 1600 and 1600', at least a part of the air introduced through the inlet 1122 may be induced to flow toward the discharge ducts 1600 and 1600'. Accordingly, it is possible to more effectively prevent damage and quality degradation of the solid detergent loaded into the storage compartments 1200 and 1200'.

FIG. 20 illustrates that the blowing fan F is disposed inside the first discharge duct 1600, but the blowing fan F may be disposed inside the second discharge duct 1600'. Alternatively, the blowing fan F may be disposed inside both the first and second discharge ducts 1600 and 1600'.

FIG. 20 illustrates that the blowing fan F is an axial fan type, but the blowing fan F may be a centrifugal fan type. The blowing fan F may be configured in various types according to the shape of the discharge ducts 1600 and 1600' and the arrangement of the discharge holes 1610 and 1610'.

In the above, the configuration and operation of the automatic detergent dispenser 1000 of the dishwasher 1 according to an embodiment of the disclosure have been described with reference to FIGS. 10 to 20. However, the disclosure is not limited thereto, and the contents described above are merely examples of the dishwasher and the automatic detergent dispenser according to the disclosure.

For example, at least a part of the drain groove provided in the housing 1100 of the automatic detergent dispenser 1000 may be formed on the front surface of the housing 1100 in the first direction X (based on when the door 20 is in the first position 20A). At least a portion of the drain groove may extend from the front surface of the housing 1100 in the vertical direction corresponding to the third direction Z. For example, the drain groove may be connected to the upper surface of the housing 1100, and water introduced into the upper surface of the housing 1100 may flow toward the drain groove and be drained along the front surface of the housing 1100 in the first direction X.

For example, the drain groove provided in the housing 1100 of the automatic detergent dispenser 1000 may be formed to include a shape in which the outer side is covered. For example, at least a portion of the drain groove may be formed to include a pipe-like shape (not shown). After the water introduced from the tub 12 is collected in the drain groove, the collected water may flow along the inside of the pipe shape of the drain groove and be drained to the lower side of the door 20.

For example, the automatic detergent dispenser 1000 may be disposed on the inner surface of the inner frame 21 facing the tub 12. In other words, the automatic detergent dispenser 1000 may be disposed on the rear surface of the inner frame 21 in the first direction X. In other words, the automatic detergent dispenser 1000 may not penetrate the inner frame 21, and be arranged on the inner side (the rear side in the first direction X relative to the inner frame 21) toward the tub 12 relative to the inner frame 21.

Particularly, the automatic detergent dispenser coupler of the inner frame 21, to which the automatic detergent dispenser 1000 is coupled, may include a groove shape (not shown) into which at least a portion of the housing 1100 of the automatic detergent dispenser 1000 is inserted. The groove of the inner frame 21 may be provided on the rear surface of the inner frame 21 in the first direction X. In this case, wash water from the tub 12 may not flow into the inner space I of the door 20 through the gap between the automatic detergent dispenser coupler and the housing 1100, but wash water of the tub 12 may be introduced to the groove of the automatic detergent dispenser coupler into which the housing 1100 is inserted. The housing 1100 of the automatic detergent dispenser 1000 may include the drain groove provided to drain water introduced into the groove of the automatic detergent dispenser coupler. The drain groove may drain water, which is introduced into the groove when the door 20 is in the first position 20A, to the lower side. At the lower side of the groove of the automatic detergent dispenser coupler, a separate drain hole (not shown) or a drain duct (not shown) may be provided for draining water, which is drained to the lower side of the groove, to the lower side of the door 20.

In the automatic detergent dispenser of the dishwasher according to the disclosure, the drain groove 1119 may be not limited to draining water that is introduced from the tub 12 through the gap between the automatic detergent dispenser coupler 21*a* of the door 20 and the housing 1100. The drain groove 1119 may drain water, which is introduced by various causes, to the lower side of the door 20.

For example, liquid water formed by condensation of water vapor introduced into the inner space I of the door 20 may remain in the inner space I. Further, the inner frame 21 may be provided with the detergent box installation member 21*c* in which the detergent box 90 is installed, and the detergent box installation member 21*c* may be formed in an opening shape (refer to FIG. 10). At this time, high-pressure wash water may be introduced into the inner space I through the gap between the opening of the detergent box installation member 21*c* and the detergent box 90. When the door 20 is in the first position 20A, the drain groove may be provided to allow water remaining in the inner space I to be drained to the lower side of the door 20 for this reason.

Further, the drain groove provided in the housing 1100 of the automatic detergent dispenser 1000 may be disposed inside the tub 12 when the door 20 is in the first position 20A. That is, the drain groove may be disposed outside the inner space I of the door 20. In this case, the drain groove may collect water that directly flows into the drain groove from the tub 12, and the collected water may be drained to the lower side of the door 20 when the door 20 is in the first position 20A.

Hereinafter a cross-sectional area of the storage compartment 1200 according to an example will be described in detail.

Figure 21:
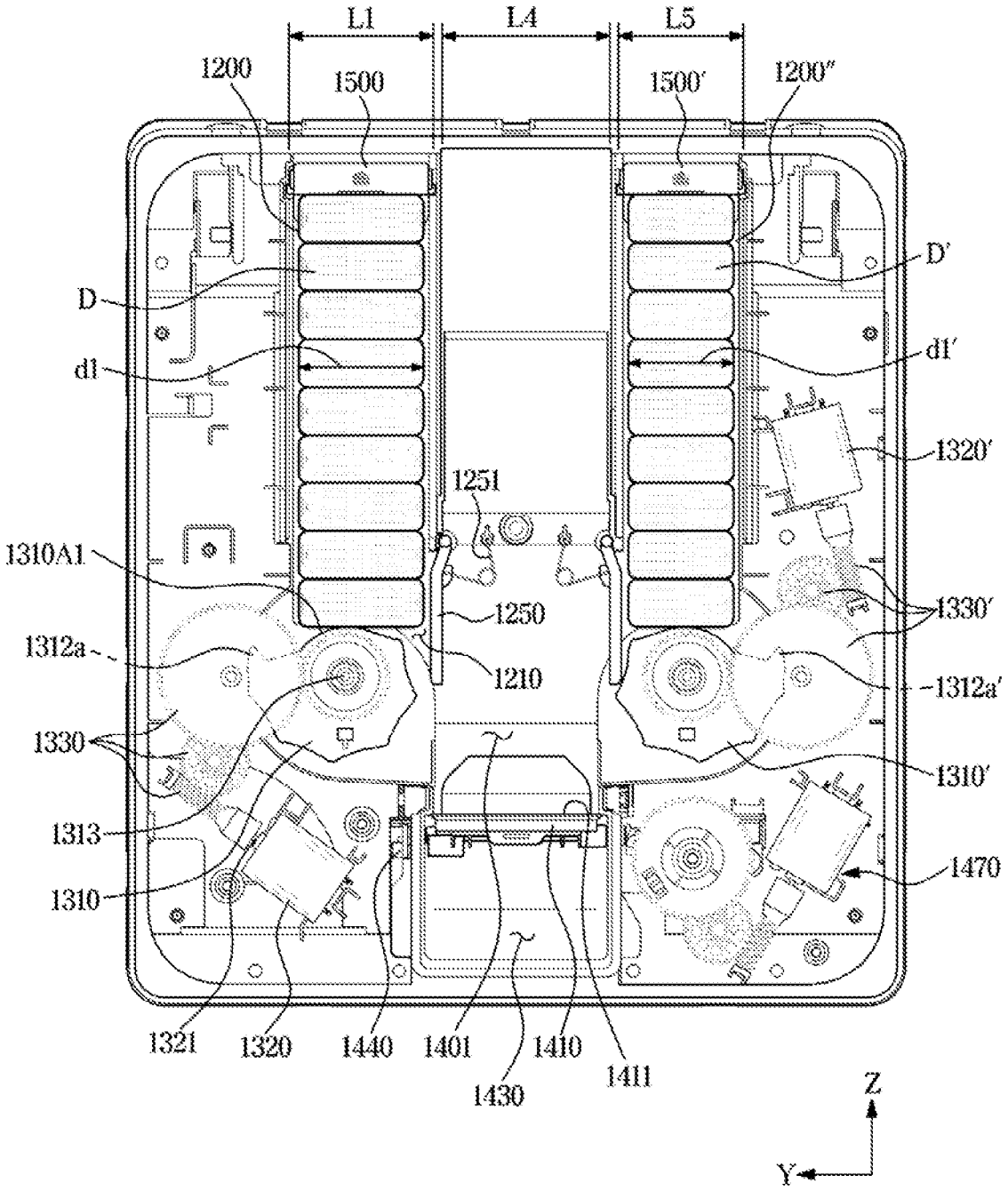
FIG. 21 is a view illustrating a state in which some components of the automatic detergent dispenser of the dishwasher according to an embodiment of the disclosure are removed.

FIG. 21 is a view illustrating a state in which some components of the automatic detergent dispenser of the dishwasher according to an embodiment are removed.

For example, as shown in FIG. 21, the horizontal length L1 of the first storage compartment 1200 and a horizontal length L5 of the second storage compartment 1200' may be different from each other.

For example, the horizontal length L1 of the first storage compartment 1200 may be provided to have a predetermined length to allow the above-described solid detergent D to be stored in the storage compartment 1200. The horizontal length L5 of the second storage compartment 1200' may be less than the horizontal length L1 of the first storage compartment 1200.

For example, the horizontal length L5 of the second storage compartment 1200' may be greater than the horizontal length L1 of the first storage compartment 1200.

The width L4 of the seating member 1400 in the second direction Y may be substantially similar to the width L1 of the first storage compartment 1200. This is because, when the solid detergent is discharged from the first storage compartment 1200 to the seating member 1400 in a state in which the width L4 of the seating member 1400 is excessively less than the width L5 of the second storage compartment 1200', the solid detergent may be stuck in the seating member inner space 1401 without being seated on the seating member door 1410.

Conversely, when the width L4 of the seating member 1400 in the second direction Y is excessively greater than the width L1 of the first storage compartment 1200 or the width L5 of the second storage compartment 1200', the volume of the seating member 1400 in the second direction Y may increase more than necessary and thus the volume of the automatic detergent dispenser 1000 in the second direction Y may increase more than necessary.

Therefore, as described above, it is appropriate that the width L4 of the seating member 1400 may have a length similar to the width L1 of the first storage compartment 1200 having a cross-sectional area S in accordance with the size of the solid detergent, in the second direction Y.

When the above-described solid detergent D is defined as a general solid detergent D that has an appropriate volume for washing in accordance with a capacity of the tub 12 of the general dishwasher 1 and has a predetermined horizontal length d1 according to the appropriate volume, a small solid detergent D' stored in the second storage compartment 1200' may be defined as a small solid detergent D' that has a smaller volume than the general solid detergent D and thus has a shorter horizontal length than the horizontal length d1 of the solid detergent D. Further, the small solid detergent D' may be a solid detergent D' in a shape in which the general solid detergent D is partially cut in the direction of the horizontal length d1.

When a user wants to wash only a small number of dishes, it may be possible to wash the small number of dishes with a smaller detergent than the general solid detergent D that is generally used according to the capacity of the tub 12.

Apart from the general solid detergent D stored in the first storage compartment 1200, the second storage compartment 1200' may be provided to store the small solid detergent D', which is different in volume from the solid detergent D. Accordingly, a user can selectively perform the washing process using the general solid detergent D or the small solid detergent D' as needed.

A user can input information about the washing mode of the dishwasher 1 through the inputter of the dishwasher 1 or a mobile device to allow the dishwasher 1 to selectively perform one of a normal washing mode and a small amount washing mode.

The control device 1900 may control the automatic detergent dispenser 1000 to drive the first ejector 1300 or the second ejector 1300' based on a user input obtained from the main control device.

When a user selects the normal washing mode, the control device 1900 may control the automatic detergent dispenser 1000 to allow the first ejector 1300 to be driven.

When a user selects the small amount washing mode, the control device 1900 may control the automatic detergent dispenser 1000 to allow the second ejector 1300' to be driven.

Hereinafter an adjusting member 1270 configured to adjust the cross-sectional area of the storage compartment 1200 according to an embodiment will be described in detail.

Figure 22:
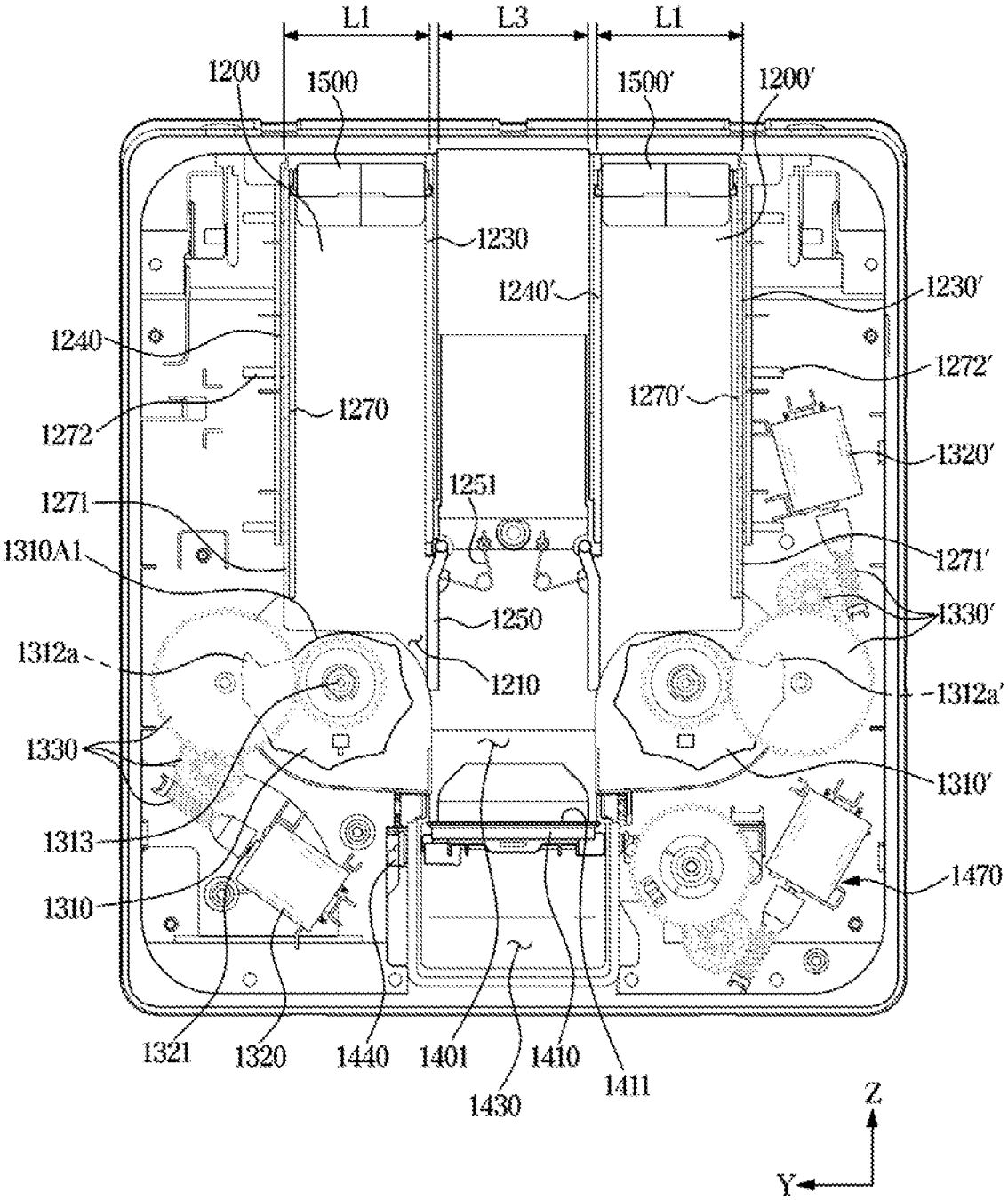
FIG. 22 is a view illustrating a state in which some components of the automatic detergent dispenser of the dishwasher according to an embodiment of the disclosure are removed.
Figure 23:
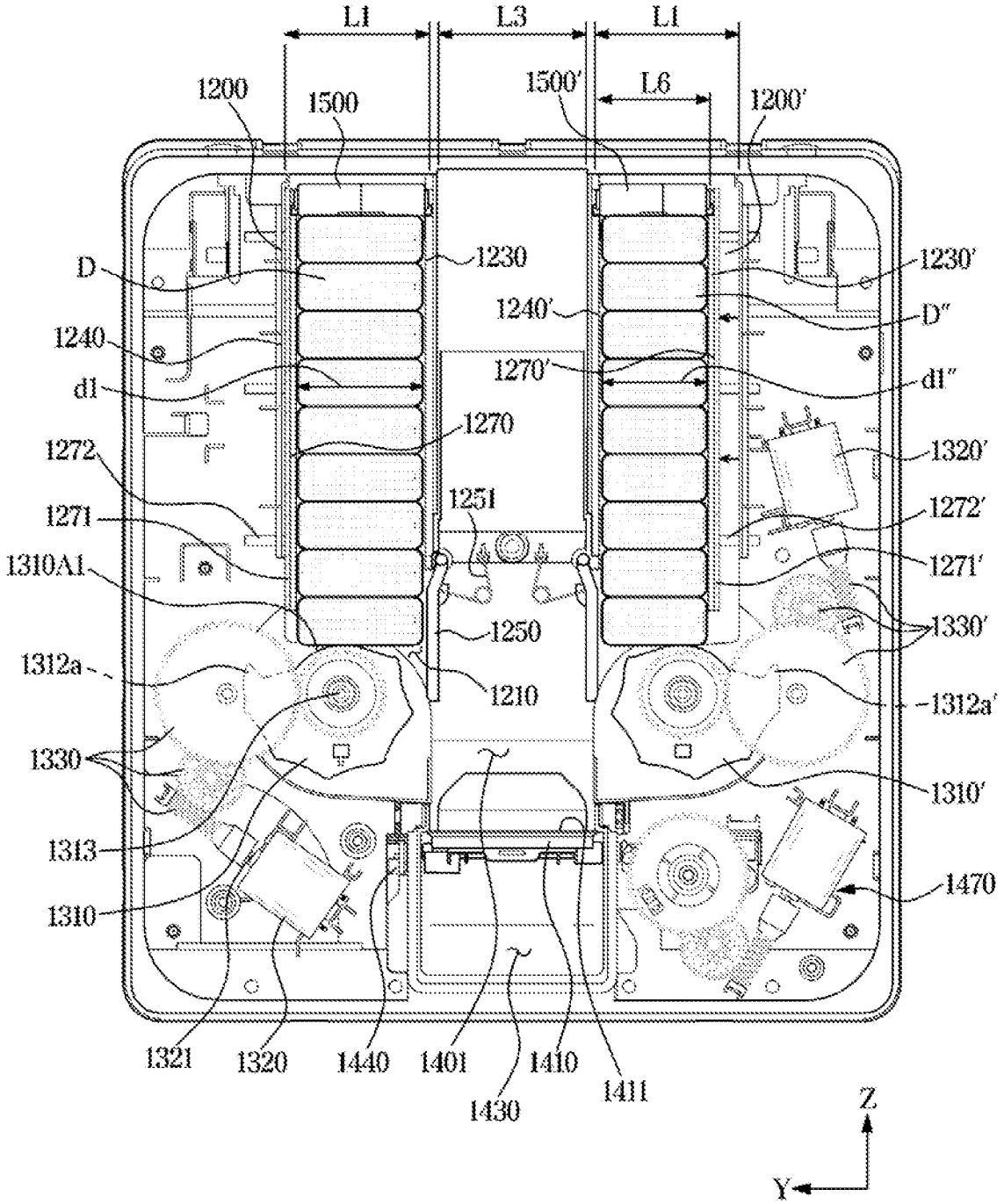
FIG. 23 is a view illustrating a state in which an adjusting member of a second storage compartment is moved in FIG. 22.

FIG. 22 is a view illustrating a state in which some components of the automatic detergent dispenser of the dishwasher according to an embodiment are removed, and FIG. 23 is a view illustrating a state in which an adjusting member of the second storage compartment is moved in FIG. 22.

For example, as shown in FIGS. 22 and 23, the storage compartment 1200 may include the adjusting member 1270 configured to adjust an internal width of the storage compartment 1200.

When the above-described solid detergent D is defined as a general solid detergent D that has an appropriate volume for washing in accordance with a capacity of the tub 12 of the general dishwasher 1 and has a predetermined horizontal length d1 according to the appropriate volume, some solid detergents D" may have a smaller volume than the general solid detergent D, and thus a width d1" of the solid detergents D" may be less than the width d1 of the general solid detergents D.

For example, when the some solid detergents D" are stacked in the storage compartment 1200 having the width L1 corresponding to the width d1 of the general solid detergent D, the some solid detergents D" may be moved in the second direction Y due to a gap between the right surface 1230 or the left surface 1240 of the storage compartment 1200 and the some solid detergents D" in the storage compartment 1200, and thus some solid detergents D" may be separated from the stacked arrangement of the solid detergents D". When the ejector 1300 is driven in a state in which the some solid detergents D" are separated, the plurality of solid detergents D" may not be moved to the third direction Y by the ejector 1300 and the some solid detergents D" may be stuck in the storage compartment 1200 and thus may not be discharged to the outside of the storage compartment 1200.

For example, the storage compartment 1200 may include the adjusting member 1270 configured to adjust the width of the storage compartment 1200 in the second direction Y, and the adjusting member 1270 may be moved in the second direction Y so as to adjust the width of the storage compartment 1200.

Even when a width d1" of some solid detergent D" is less than the width d1 of the general solid detergent D, the adjusting member 1270 may adjust a width L6 of the storage compartment 1200 to correspond to the width d1" of the some solid detergent D", and thus the stacked state of the solid detergents D" may be maintained in the storage compartment 1200.

The adjusting member 1270 may include a support wall 1271 provided to support a plurality of solid detergents and a mover 1272 connected to the support wall 1271 in the second direction Y so as to move a position of the support wall 1271 toward the second direction Y.

The adjusting member 1270 may be disposed on the right surface 1230 or the left surface 1240 of the storage compartment 1200.

When the support wall 1271 is disposed closest to the right surface 1230 or the left surface 1240, the width L1 of the storage compartment 1200 may be approximately the same as the width d1 of the general solid detergent D.

A user can adjust the width of the storage compartment 1200 by pressing the support wall 1271 toward the second direction Y. For example, a user can move the support wall 1271, which is disposed adjacent to the right surface 1230 or the left surface 1240, toward the second direction Y so as to allow the width d1" of some solid detergents D" to correspond to the width L6 of the storage compartment 1200.

For example, the mover 1272 may be extended or contracted in the second direction Y to allow the support wall 1271 to be moved in the second direction Y inside the storage compartment 1200.

For example, the mover 1272 may be provided to be movable in the second direction Y between the outside and the inside of the storage compartment 1200 to allow the support wall 1271 to be moved in the second direction Y inside the storage compartment 1200.

For example, a user can open the storage compartment cover 1140 to open the storage compartment 1200 and move the adjusting member 1270 toward the second direction Y to have a width of the storage compartment 1200 that is desired by the user. A user can selectively adjust the width of the storage compartment 1200 by gripping the support wall 1271 and moving the support wall 1271 toward the second direction Y to form the width of the storage compartment 1200 desired by the user. As a user presses the support wall 1271, the mover 1272 may be extended or contracted in the second direction Y.

For example, the adjusting member 1270 may be driven by the control of the control device 1900 by an adjusting member driver. A user can input information about the width of the storage compartment 1200 to the dishwasher 1 through the inputter of the dishwasher 1 or a mobile device, and the control device 1900 may control the adjusting member 1270 to move the mover 1272 or to expand or contract the mover 1272 so as to allow the adjusting member 1270 to be moved in the second direction Y by a predetermined distance based on the user input obtained from the main control device.

The holder 1500 may be provided to move between the support wall 1271 and one surface, on which the adjusting member 1270 is not disposed, of the right surface 1230 or the left surface 1240.

For example, the guide rail 1290 provided to guide the movement of the holder 1500 may be disposed on the support wall 1271. The holder 1500 may be translated in the third direction Z by being guided by the guide rail 1290 disposed on the support wall 1271 and the guide rail disposed on one surface, on which the adjusting member 1270 is not disposed, of the right surface 1230 or the left surface 1240.

The holder 1500 may be provided in a shape that is contracted in the second direction Y when the support wall 1271 is moved in a direction away from the right surface 1230 or the left surface 1240.

The holder 1500 may be provided in a shape that is contracted or expanded in the second direction Y. For example, the holder 1500 may be provided in a telescopic shape. Accordingly, when the support wall 1271 is moved toward the center of the storage compartment 1200, the holder 1500 may be overlapped and contracted, and when the support wall 1271 is moved in the opposite direction of the center direction of the storage compartment 1200, the holder 1500 may be expanded and extended.

The adjusting member 1270 may include a first adjusting member 1270 provided inside the first storage compartment 1200 and a second adjusting member 1270' provided inside the second storage compartment 1200'.

For example, a user can adjust the width of the first storage compartment 1200 and the second storage compartment 1200' by moving the first adjusting member 1270 and the second adjusting member 1270', respectively.

For example, a user can maintain the width L1 of the first storage compartment 1200 and the second storage compartment 1200' by not moving both the first adjusting member 1270 and the second adjusting member 1270'.

For example, a user can adjust the widths of the first storage compartment 1200 and the second storage compartment 1200' by moving one of the first and second adjusting members 1270 and 1270'.

For example, the first adjusting member 1270 may be disposed on the left surface 1240 of the first storage compartment 1200. The second adjusting member 1270' may be disposed on the right surface 1230' of the second storage compartment 1200'.

Alternatively, the second adjusting member 1270' may be disposed on the left surface 1240' of the second storage compartment 1200'. The first adjusting member 1270 may be disposed on the right surface 1230 of the first storage compartment 1200.

Alternatively, the first adjusting member 1270 and the second adjusting member 1270' may be disposed on the left surface 1240 of the first storage compartment 1200 and the left surface 1240' of the second storage compartment 1200', respectively.

Alternatively, the first adjusting member 1270 and the second adjusting member 1270' may be disposed on the right surface 1230 of the first storage compartment 1200 and the right surface 1230' of the second storage compartment 1200', respectively.

Alternatively, the adjusting member 1270 may be provided in only one of the first storage compartment 1200 and the second storage compartment 1200'.

For example, as shown in FIG. 23, the adjusting member 1270 of the first storage compartment 1200 may be disposed adjacent to the left surface 1240 to allow the width L1 of the first storage compartment 1200 to correspond to the width d1 of the general solid detergent D, and the adjusting member 1270' of the second storage compartment 1200' may be moved in the second direction Y from the right surface 1230' to allow the width L6 of the second storage compartment 1200' to correspond to the width d1" of some solid detergent D".

At this time, a user can load the general solid detergent D into the first storage compartment 1200 and load some solid detergent D" into the second storage compartment 1200'.

The storage compartment 1200 may include an adjusting member detection sensor configured to detect a position of each of the support walls 1271 and 1271'. The adjusting member detection sensor may detect a position in which the support wall 1271 of the first storage compartment 1200 and the support wall 1271' of the second storage compartment 1200' are disposed, and the control device 1900 may be configured to recognize the type of solid detergent loaded in the first storage compartment 1200 and the type of the solid detergent loaded in the second storage compartment 1200' based on the detected value.

For example, the adjusting member detection sensor may measure a distance to a position of each of the support walls 1271 and 1271', or detect a distance to a position of each of the support walls 1271 and 1271' by detecting a distance in which each of the movers 1272 and 1272' is moved, extended or contracted.

A user can input information about the washing mode of the dishwasher 1 through the inputter of the dishwasher 1 or a mobile device to allow the dishwasher 1 to selectively perform one of the normal washing mode and the small amount washing mode.

The control device 1900 may control the automatic detergent dispenser 1000 to allow the first ejector 1300 or the second ejector 1300' to be driven based on the user input obtained from the main control device, and a value sensed by the adjusting member detection sensor.

For example, when a user selects the normal washing mode, the control device 1900 may control the automatic detergent dispenser 1000 to allow the first ejector 1300 to be driven. When a user selects the small amount washing mode, the controller 1900 may control the automatic detergent dispenser 1000 to allow the second ejector 1300' to be driven.

Embodiments of the disclosure may provide a washer a dishwasher including a main body, a tub provided inside the main body, a door configured to open and close the tub, and an automatic detergent dispenser arranged on the door and configured to input a solid detergent toward an inside of the tub while the tub is closed by the door. The automatic detergent dispenser may include a storage compartment provided to allow a plurality of solid detergents to be stacked and loaded, and a housing coupled to the door and in which the storage Compartment is provided. The housing may include a drain groove formed along at least a portion of an outer edge of the housing to include a concave shape and provided to drain water, which flows from the tub, from the housing to a lower side of the door while the door is closed.

The housing may further include a housing rib disposed along the drain groove and including a protruding shape. The housing rib may be disposed in a direction toward an outer surface of the door with respect to the drain groove.

The door may include an outer frame forming an outer surface of the door, an inner frame coupled to the outer frame and forming an inner surface of the door, and an inner space arranged between the outer frame and the inner frame. A portion of the housing may be disposed in the inner space. The drain groove may be disposed in the inner space to drain water, which flows from the tub into the inner space, to a lower side of the inner space.

The housing may further include a discharge hole formed to communicate with the inner space. The drain groove may be provided to prevent water, which flows from the tub, from flowing into the discharge hole.

Embodiments of the disclosure may provide a dishwasher including a main body, a tub provided inside the main body, a door configured to open and close the tub and including an inner space provided to communicate with the tub in response to the tub being closed, and an automatic detergent dispenser coupled to the door and configured to input a solid detergent toward an inside of the tub while the tub is closed by the door. The automatic detergent dispenser may include a housing including a drain groove formed on an outer surface of the housing, the housing coupled to the door, a storage compartment provided inside the housing and provided to allow a plurality of the solid detergents to be loaded therein, and a discharge hole arranged on the outer surface of the housing and provided to allow an inside of the housing and an inside of the door to communicate with each other. The drain groove may be provided to drain water, which flows from the tub into the inner space, to a lower side of the inner space so as to prevent the water from flowing into the discharge hole.

As is apparent from the above description, an automatic detergent dispenser of a dishwasher may include a storage, and thus a plurality of solid detergents may be stacked and loaded in the storage compartment of the automatic detergent dispenser.

An automatic detergent dispenser of a dishwasher may include an ejector configured to move one of a plurality of solid detergents loaded in a storage compartment to an outside of the storage compartment, and thus the solid detergent may be input during a washing process.

An automatic detergent dispenser of a dishwasher may include a discharge duct formed to communicate with an inner space of a door of the dishwasher, and thus air introduced from a tub into the automatic detergent dispenser may be discharged to an outside of the automatic detergent dispenser.

An automatic detergent dispenser of a dishwasher may include a discharge duct provided to discharge air flowing from a tub, and thus it is possible to prevent damage to a solid detergent loaded in a storage compartment and to prevent the quality deterioration of the solid detergent.

An automatic detergent dispenser of a dishwasher may include a discharge duct provided to discharge air flowing from a tub, and thus it is possible to prevent damage to the automatic detergent dispenser and to increase a lifetime of the automatic detergent dispenser.

An automatic detergent dispenser of a dishwasher may include a drain groove, and thus it is possible to discharge water to an inner space between an inner frame and an outer frame.

An automatic detergent dispenser of a dishwasher may include a housing rib, and thus it is possible to prevent water collected in a drain groove from being discharged to an outside of the drain groove.

Additional aspects of the disclosure will be set forth in part in the description which follows and, in part, will be obvious from the description, or may be learned by practice of the disclosure.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:
a tub;
a door configured to open and close the tub, the door including:
an outer frame forming an outer surface of the door, and
an inner frame coupled to the outer frame and forming an inner surface of the door, with an inner space between the outer frame and the inner frame; and
an automatic detergent dispenser coupled to the inner frame and configured to dispense a solid detergent toward an inside of the tub while the tub is closed by the door, the automatic detergent dispenser including:
a storage compartment in which a plurality of solid detergents are stackable so as to be loaded along one direction, and
a discharge duct including a discharge hole formed to communicate with an inner space, the discharge duct configured to discharge air, which flows from the tub into the automatic detergent dispenser, to the inner space through the discharge hole.

2. The dishwasher of claim 1, wherein
the discharge duct extends parallel to the one direction along which the plurality of solid detergents are loaded,
wherein the discharge hole is formed at one side of the discharge duct with respect to the one direction.

3. The dishwasher of claim 1, wherein
the discharge duct is disposed in a direction perpendicular to the one direction with respect to the storage compartment.

4. The dishwasher of claim 1, wherein
the automatic detergent dispenser includes:
a discharge hole cover covering the discharge hole from an outside of the discharge duct.

5. The dishwasher of claim 4, wherein
the discharge hole cover includes:
a cover portion facing the discharge hole at a position spaced apart from the discharge hole.

6. The dishwasher of claim 4, wherein
the automatic detergent dispenser includes:
an air discharge guide to guide air discharged through the discharge hole to an outside of the discharge hole cover, and
the air discharge guide is inclined downward toward the outer frame while the tub is closed by the door.

7. The dishwasher of claim 1, wherein
the automatic detergent dispenser includes:
a housing coupled to the inner frame and in which the storage compartment and the discharge duct are disposed,
a driver configured to drive the automatic detergent dispenser to discharge one solid detergent among the plurality of solid detergents into the tub, the driver disposed inside the housing,
a control device configured to control the driver, and
a wire configured to electrically connect the driver and the control device, at least a portion of the wire being disposed along the discharge duct.

8. The dishwasher of claim 7, wherein
the wire passes through the discharge hole, and
the housing includes:
a control device cover to cover a portion of the wire, the discharge hole, and the control device.

9. The dishwasher of claim 1, wherein
the automatic detergent dispenser includes:
a housing coupled to the inner frame,
the housing includes:
a drain groove formed to have a concave shape on an outer surface of the housing,
the storage compartment and the discharge duct are disposed inside the housing,
the discharge hole is disposed on the outer surface of the housing, and
the drain groove is configured to prevent water, which flows from the tub, from flowing into the discharge hole.

10. The dishwasher of claim 9, wherein
the drain groove is disposed in the inner space, and is configured to drain the water, which flows from the tub into the inner space, from the housing to a lower side of the inner space while the door is closed.

11. The dishwasher of claim 9, wherein
the drain groove is arranged along an outer edge of the housing.

12. The dishwasher of claim 9, wherein
the discharge hole is formed on one surface of the housing at a side toward the outer frame, wherein the housing includes:
a housing rib disposed along the drain groove and formed to have a protruding shape,
the housing rib is disposed in a direction toward the outer frame with respect to the drain groove.

13. The dishwasher of claim 1, wherein
the storage compartment includes:
a storage compartment discharge hole to communicate with the inner space.

14. The dishwasher of claim 13, wherein the storage compartment discharge hole is at one side of the storage compartment along the one direction in which the plurality of solid detergents are loaded.

15. The dishwasher of claim 1, wherein the automatic detergent dispenser includes:

an inlet communicating with the tub and configured so that one solid detergent among the plurality of solid detergents to be discharged, the one solid detergent having been discharged from the storage compartment, into the tub, and while the tub is closed by the door:

the plurality of solid detergents are stacked in a vertical direction inside the storage compartment, the inlet is disposed below the discharge duct, and the discharge hole is formed at an upper side of the discharge duct.

16. The dishwasher of claim 1, wherein the automatic detergent dispenser includes:

a seating member to seat a solid detergent discharged from the storage compartment, and from which the seated solid detergent is discharged into the tub, and the discharge duct extends between the seating member and the discharge hole.

* * * * *